US005861863A

United States Patent [19]

Kudo et al.

[11] Patent Number: 5,861,863

[45] Date of Patent: Jan. 19, 1999

[54] LIQUID CRYSTAL DRIVING METHOD AND LIQUID CRYSTAL DISPLAY DEVICE

[75] Inventors: Yasuyuki Kudo, Yokohama; Hiroyuki Mano, Chigasaki; Tsutomu Furuhashi, Yokohama; Toshio Futami, Mobara; Satoru Tsunekawa, Higashimurayama; Tatsuhiro Inuzuka, Odawara, all of Japan

[73] Assignee: Hitachi, Ltd., Tokyo, Japan

[21] Appl. No.: 638,127

[22] Filed: Apr. 26, 1996

[30] Foreign Application Priority Data

| | | | |
|---|---|---|---|
| Apr. 27, 1995 | [JP] | Japan | 7-103785 |
| Jun. 12, 1995 | [JP] | Japan | 7-144775 |
| Jan. 31, 1996 | [JP] | Japan | 8-015422 |

[51] Int. Cl.[6] ..... G09G 3/36

[52] U.S. Cl. ..... 345/100

[58] Field of Search ..... 345/89, 100

[56] References Cited

U.S. PATENT DOCUMENTS

| | | | |
|---|---|---|---|
| 5,250,937 | 10/1993 | Kikuo et al. | 345/89 |
| 5,420,604 | 5/1995 | Scheffer et al. . | |
| 5,459,495 | 10/1995 | Scheffer et al. | 345/89 |
| 5,485,173 | 1/1996 | Scheffer et al. | 345/100 |
| 5,640,174 | 6/1997 | Kamei et al. | 345/89 |
| 5,644,329 | 7/1997 | Asari et al. | 345/89 |
| 5,684,502 | 11/1997 | Fukui et al. | 345/89 |
| 5,689,280 | 11/1997 | Asari et al. | 345/100 |

FOREIGN PATENT DOCUMENTS 6-67628 3/1994 Japan .

OTHER PUBLICATIONS

T. Ruckmongathan, "A Generalized Addressing Technique for RMS Responding Matrix LCDs", *1988 International Display Research Conference,* pp. 80–85, IEEE, 1988.

*Liquid Crystal Device Handbook,* pp. 395–399 and 404–405, Nikkan Kogyo Shinbun Co., Sep. 29, 1989 (in Japanese).

T. Scheffer et al., "Active Addressing Method for High–Contrast Video–Rate STN Displays", *SID 92 Digest,* pp. 228–231, 1992.

B. Clifton et al., "Optimum Row Functions and Algorithms for Active Addressing", *SID 93 Digest,* pp. 89–92, 1993.

*Primary Examiner*—Jeffery Brier

*Attorney, Agent, or Firm*—Antonelli, Terry, Stout & Kraus, LLP

[57] ABSTRACT

A scanning voltage driving device suitable for a liquid crystal panel with plural output terminals, the scanning voltage driving device producing a 2-level selection voltage to plural scanning electrode groups which drive the liquid crystal panel according to a value of an orthogonal function data, the 2-level selection voltage having a positive polarity and a negative polarity with respect to a center point being a non-selection voltage, includes orthogonal function producing means for producing the orthogonal function data from input synchronous display signal groups, scanning line selecting means for creating a scanning line selection signal from the synchronous display signal groups to indicate an output terminal for the selection voltage, and voltage selecting means for selectively outputting a voltage amount the 2 levels of the selection voltages and the non-selection voltage every output terminal according to the value of the scanning line selection signal and the value of the orthogonal function data, the scanning line selecting means dividing one frame period into plural virtual block periods and then repeatedly creating the scanning line selection signal which sequentially selects all the scanning electrodes to be selected for the block period every plural scanning electrodes.

43 Claims, 59 Drawing Sheets

| | | | | |
|---|---|---|---|---|
| YA | −1 | −1 | +1 | +1 |
| YB | −1 | +1 | −1 | +1 |
| | [0] | [1] | [2] | [3] |

COMBINATION

FIG.11

| FIRST AND SECOND COMBINATIONS IN A BLOCK n | FIRST AND SECOND COMBINATIONS POSSIBLE IN THE NEXT BLOCK (n+1) |
|---|---|
| { [0] 、 [1] } | { [1] 、 [3] }<br>{ [2] 、 [3] }<br>{ [1] 、 [0] }<br>{ [2] 、 [0] } |
| { [0] 、 [2] } | { [1] 、 [3] }<br>{ [2] 、 [3] }<br>{ [1] 、 [0] }<br>{ [2] 、 [0] } |
| { [3] 、 [1] } | { [1] 、 [3] }<br>{ [2] 、 [3] }<br>{ [1] 、 [0] }<br>{ [2] 、 [0] } |
| { [3] 、 [2] } | { [1] 、 [3] }<br>{ [2] 、 [3] }<br>{ [1] 、 [0] }<br>{ [2] 、 [0] } |
| { [1] 、 [0] } | { [0] 、 [1] }<br>{ [0] 、 [2] } |
| { [2] 、 [0] } | { [0] 、 [1] }<br>{ [0] 、 [2] } |
| { [1] 、 [3] } | { [3] 、 [1] }<br>{ [3] 、 [2] } |
| { [2] 、 [3] } | { [3] 、 [1] }<br>{ [3] 、 [2] } |

| FLM COUNT \ CL1 COUNT | 0<br>1<br>2 | 3<br>4<br>5 | 6<br>7<br>8 | 9<br>10<br>11 | 12<br>13<br>14 | 15<br>16<br>17 | 18<br>19<br>20 | 21<br>22<br>23 |
|---|---|---|---|---|---|---|---|---|
| 0 | [0] | [2] | [1] | [3] | [3] | [1] | [2] | [0] |
| 1 | [1] | [0] | [0] | [1] | [2] | [3] | [3] | [2] |
| 2 | [3] | [1] | [2] | [0] | [0] | [2] | [1] | [3] |
| 3 | [2] | [3] | [3] | [2] | [1] | [0] | [0] | [1] |
| 4 | [1] | [3] | [3] | [1] | [2] | [0] | [0] | [2] |
| 5 | [0] | [1] | [2] | [3] | [3] | [2] | [1] | [0] |
| 6 | [2] | [0] | [0] | [2] | [1] | [3] | [3] | [1] |
| 7 | [3] | [2] | [1] | [0] | [0] | [1] | [2] | [3] |

FIG.43

| BLOCK n | VALUE IN BLOCK (n+1) |
|---|---|
| { [0] , [1] } | { [1] , [3] }<br>{ [2] , [3] } |
| { [0] , [2] } | { [1] , [3] }<br>{ [2] , [3] } |
| { [3] , [1] } | { [1] , [0] }<br>{ [2] , [0] } |
| { [3] , [2] } | { [1] , [0] }<br>{ [2] , [0] } |
| { [1] , [0] } | { [0] , [1] }<br>{ [0] , [2] } |
| { [2] , [0] } | { [0] , [1] }<br>{ [0] , [2] } |
| { [1] , [3] } | { [3] , [1] }<br>{ [3] , [2] } |
| { [2] , [3] } | { [3] , [1] }<br>{ [3] , [2] } |

FIG.44

| CL1 COUNT / FLM COUNT | X+0<br>X+1<br>X+2 | X+3<br>X+4<br>X+5 | X+6<br>X+7<br>X+8 | X+9<br>X+10<br>X+11 | X+12<br>X+13<br>X+14 | X+15<br>X+16<br>X+17 | X+18<br>X+19<br>X+20 | X+21<br>X+22<br>X+23 |
|---|---|---|---|---|---|---|---|---|
| Y+0 | [0] | [1] | [1] | [3] | [3] | [2] | [2] | [0] |
| Y+1 | [3] | [2] | [2] | [0] | [0] | [1] | [1] | [3] |
| Y+2 | [1] | [3] | [3] | [2] | [2] | [0] | [0] | [1] |
| Y+3 | [2] | [0] | [0] | [1] | [1] | [3] | [3] | [2] |

X, Y=NATURAL NAMBER

| FLM COUNT \ CL1 COUNT | X+0<br>X+1<br>X+2 | X+3<br>X+4<br>X+5 | X+6<br>X+7<br>X+8 | X+9<br>X+10<br>X+11 | X+12<br>X+13<br>X+14 | X+15<br>X+16<br>X+17 | X+18<br>X+19<br>X+20 | X+21<br>X+22<br>X+23 | X+24<br>X+25<br>X+26 | X+27<br>X+28<br>X+29 | X+30<br>X+31<br>X+32 | X+33<br>X+34<br>X+35 | X+36<br>X+37<br>X+38 | X+39<br>X+40<br>X+41 | X+42<br>X+43<br>X+44 | X+45<br>X+46<br>X+47 |
|---|---|---|---|---|---|---|---|---|---|---|---|---|---|---|---|---|
| Y+0 | [0] | [1] | [1] | [3] | [3] | [2] | [2] | [0] | [0] | [2] | [2] | [3] | [3] | [1] | [1] | [0] |
| Y+1 | [3] | [2] | [2] | [0] | [0] | [1] | [1] | [3] | [3] | [1] | [1] | [0] | [0] | [2] | [2] | [3] |
| Y+2 | [1] | [3] | [3] | [2] | [2] | [0] | [0] | [1] | [1] | [0] | [0] | [1] | [1] | [0] | [0] | [1] |
| Y+3 | [2] | [0] | [0] | [1] | [1] | [3] | [3] | [2] | [2] | [3] | [3] | [1] | [1] | [0] | [0] | [2] |

X, Y=NATURAL NAMBER

FIG.52

| FLM COUNT \ CL1 COUNT | X+0 X+1 X+2 | X+3 X+4 X+5 | X+6 X+7 X+8 | X+9 X+10 X+11 | X+12 X+13 X+14 | X+15 X+16 X+17 | X+18 X+19 X+20 | X+21 X+22 X+23 | X+24 X+25 X+26 | X+27 X+28 X+29 | X+30 X+31 X+32 | X+33 X+34 X+35 | X+36 X+37 X+38 | X+39 X+40 X+41 | X+42 X+43 X+44 | X+45 X+46 X+47 | |
|---|---|---|---|---|---|---|---|---|---|---|---|---|---|---|---|---|---|
| Y+0 | [0] | [1] | [1] | [3] | [3] | [2] | [2] | [0] | [0] | [2] | [2] | [3] | [3] | [1] | [1] | [0] | |
| Y+1 | [3] | [2] | [2] | [0] | [0] | [1] | [1] | [3] | [3] | [1] | [1] | [0] | [0] | [2] | [2] | [3] | |
| Y+2 | [1] | [3] | [3] | [2] | [2] | [0] | [0] | [1] | [1] | [0] | [0] | [1] | [1] | [0] | [0] | [1] | A |
| Y+3 | [2] | [0] | [0] | [1] | [1] | [3] | [3] | [2] | [2] | [3] | [3] | [1] | [1] | [0] | [0] | [2] | |
| Y+4 | [3] | [2] | [2] | [0] | [0] | [1] | [1] | [3] | [3] | [1] | [1] | [0] | [0] | [2] | [2] | [3] | |
| Y+5 | [0] | [1] | [1] | [3] | [3] | [2] | [2] | [0] | [0] | [2] | [2] | [3] | [3] | [1] | [1] | [0] | $\overline{A}$ |
| Y+6 | [2] | [0] | [0] | [1] | [1] | [3] | [3] | [2] | [2] | [3] | [3] | [1] | [1] | [0] | [0] | [2] | |
| Y+7 | [1] | [3] | [3] | [2] | [2] | [0] | [0] | [1] | [1] | [0] | [0] | [1] | [1] | [0] | [0] | [1] | |
| Y+8 | [3] | [2] | [2] | [0] | [0] | [1] | [1] | [3] | [3] | [1] | [1] | [0] | [0] | [2] | [2] | [3] | |
| Y+9 | [0] | [1] | [1] | [3] | [3] | [2] | [2] | [0] | [0] | [2] | [2] | [3] | [3] | [1] | [1] | [0] | $\overline{A}$ |
| Y+10 | [2] | [0] | [0] | [1] | [1] | [3] | [3] | [2] | [2] | [3] | [3] | [1] | [1] | [0] | [0] | [2] | |
| Y+11 | [1] | [3] | [3] | [2] | [2] | [0] | [0] | [1] | [1] | [0] | [0] | [1] | [1] | [0] | [0] | [1] | |
| Y+12 | [0] | [1] | [1] | [3] | [3] | [2] | [2] | [0] | [0] | [2] | [2] | [3] | [3] | [1] | [1] | [0] | |
| Y+13 | [3] | [2] | [2] | [0] | [0] | [1] | [1] | [3] | [3] | [1] | [1] | [0] | [0] | [2] | [2] | [3] | |
| Y+14 | [1] | [3] | [3] | [2] | [2] | [0] | [0] | [1] | [1] | [0] | [0] | [1] | [1] | [0] | [0] | [1] | A |
| Y+15 | [2] | [0] | [0] | [1] | [1] | [3] | [3] | [2] | [2] | [3] | [3] | [1] | [1] | [0] | [0] | [2] | |
| Y+16 | [3] | [2] | [2] | [0] | [0] | [1] | [1] | [3] | [3] | [1] | [1] | [0] | [0] | [2] | [2] | [3] | |
| Y+17 | [0] | [1] | [1] | [3] | [3] | [2] | [2] | [0] | [0] | [2] | [2] | [3] | [3] | [1] | [1] | [0] | $\overline{A}$ |
| Y+18 | [2] | [0] | [0] | [1] | [1] | [3] | [3] | [2] | [2] | [3] | [3] | [1] | [1] | [0] | [0] | [2] | |
| Y+19 | [1] | [3] | [3] | [2] | [2] | [0] | [0] | [1] | [1] | [0] | [0] | [1] | [1] | [0] | [0] | [1] | |
| Y+20 | [0] | [1] | [1] | [3] | [3] | [2] | [2] | [0] | [0] | [2] | [2] | [3] | [3] | [1] | [1] | [0] | |
| Y+21 | [3] | [2] | [2] | [0] | [0] | [1] | [1] | [3] | [3] | [1] | [1] | [0] | [0] | [2] | [2] | [3] | |
| Y+22 | [1] | [3] | [3] | [2] | [2] | [0] | [0] | [1] | [1] | [0] | [0] | [1] | [1] | [0] | [0] | [1] | A |
| Y+23 | [2] | [0] | [0] | [1] | [1] | [3] | [3] | [2] | [2] | [3] | [3] | [1] | [1] | [0] | [0] | [2] | |
| Y+24 | [0] | [1] | [1] | [3] | [3] | [2] | [2] | [0] | [0] | [2] | [2] | [3] | [3] | [1] | [1] | [0] | |
| Y+25 | [3] | [2] | [2] | [0] | [0] | [1] | [1] | [3] | [3] | [1] | [1] | [0] | [0] | [2] | [2] | [3] | |
| Y+26 | [1] | [3] | [3] | [2] | [2] | [0] | [0] | [1] | [1] | [0] | [0] | [1] | [1] | [0] | [0] | [1] | A |
| Y+27 | [2] | [0] | [0] | [1] | [1] | [3] | [3] | [2] | [2] | [3] | [3] | [1] | [1] | [0] | [0] | [2] | |
| Y+28 | [3] | [2] | [2] | [0] | [0] | [1] | [1] | [3] | [3] | [1] | [1] | [0] | [0] | [2] | [2] | [3] | |
| Y+29 | [0] | [1] | [1] | [3] | [3] | [2] | [2] | [0] | [0] | [2] | [2] | [3] | [3] | [1] | [1] | [0] | $\overline{A}$ |
| Y+30 | [2] | [0] | [0] | [1] | [1] | [3] | [3] | [2] | [2] | [3] | [3] | [1] | [1] | [0] | [0] | [2] | |
| Y+31 | [1] | [3] | [3] | [2] | [2] | [0] | [0] | [1] | [1] | [0] | [0] | [1] | [1] | [0] | [0] | [1] | |
| | B | | | | $\overline{B}$ | | | | C | | | | $\overline{C}$ | | | | |

LIQUID CRYSTAL DRIVING METHOD AND LIQUID CRYSTAL DISPLAY DEVICE

BACKGROUND OF THE INVENTION

1. Field of the Invention

The present invention relates to a liquid crystal display device, and particularly to a liquid crystal display device and liquid crystal driving method which enable to drive a passive matrix liquid crystal display device at low power consumption and with high-display quality.

2. Description of the Related Art

A plural line selection driving system disclosed, for example, in Japanese Patent Laid-open Publication (Tokkai-Hei) No. 6-67628 is listed as a driving system which drives a liquid crystal display including a passive matrix liquid crystal panel. A prior art on the 2-line selection driving operation will be described below.

As shown in FIG. 2, a selection voltage is applied to scanning electrodes Yi (i=1 to n) corresponding to a row of a liquid crystal panel. The selection voltage is applied to each pairs of the scanning electrodes with a period of 2t which is sequentially shifted one pair of the electrodes to the next. The period t is expressed by the following formula:

$$t=(1/n)\times f \tag{1}$$

where n is the number of lines per screen and f is the duration of a frame period being a time to scan all the lines per screen.

Some type of liquid crystal controllers which output image data to be displayed on a liquid crystal panel set, one frame period to be consisting of a display interval in which the selection voltage is applied to all the scanning electrodes and a retrace line interval (to be called "blank interval" hereafter) in which the selection voltage is not applied to any of the scanning electrodes.

In such a case, it is assumed in this specification that the frame period f corresponds to the display interval and the period t corresponds to a value of {(the display interval)/(the total number of the scanning electrodes)}.

The selection voltage has two levels, namely a positive level and a negative level with respect to a non-selection voltage level. The polarities of a selection voltage have an orthogonality between two selected scanning electrodes. In the 2-line selection driving system, the period 2t is divided into two t periods. A selection voltage having different polarities in the earlier half and later half of the selection period is applied to one of the selected scanning electrodes. A selection voltage having the same polarities in the earlier half and later half of the selection period is applied to the other of the selected scanning electrodes.

On the other hand, a data voltage, which corresponds to a sum of identity values between the polarity (+1 representing the positive side and −1 representing the negative side) of the selection voltage applied to the scanning electrode during the selection period and the display data (−1 representing power-on and +1 representing power-off) on the scanning electrode, is applied to the data electrode.

The voltage level applied to the scanning electrode is expressed as follows:

$$\text{Selection voltage} = \pm\sqrt{(n/2)}\cdot\sqrt{\sqrt{n}/(2\sqrt{n}-1)}\cdot V\text{off} \tag{2}$$

$$\text{Non-selection voltage} = 0$$

where Voff is an effective voltage value applied to a liquid crystal at a display-off period.

On the other hand, the voltage level applied to a data electrode is expressed as follows:

$$\text{Data voltage } A = +\sqrt{2}\cdot\sqrt{\sqrt{n}/(2\sqrt{n}-1)}\cdot V\text{off} \tag{3}$$

$$\text{Data voltage } B = 0$$

$$\text{Data voltage } C = -\sqrt{2}\cdot\sqrt{\sqrt{n}/(2\sqrt{n}-1)}\cdot V\text{off}$$

where Voff is an effective voltage value applied to a liquid crystal at a display-off period.

FIG. 4 illustrates an example of a drive voltage's waveform when the liquid crystal panel displays as shown in FIG. 3 using the above-mentioned driving method. The horizontal axis shown in FIG. 3 corresponds to the position of a data electrode Xi (i=1 to n) and the vertical axis shown in FIG. 4 corresponds to a time.

In a passive matrix liquid crystal panel, a voltage applied to a liquid crystal cell corresponds to a potential difference between a scanning electrode and a data electrode. In the use of the plural line selection driving system, the voltage waveforms applied to the points A (display-off), B (display-on) and C (display-on) of the liquid crystal panel of FIG. 3 are shown, for example, in FIG. 5. The effective value of a voltage applied to the liquid crystal panel corresponds to meshed portions in the figure. The effective value of the voltage at the point A (display-off) for the selection period is lower than those of the point B (display-on) and the point C (display-on). These points have the same effective value of voltage for a non-selection period.

Since the light transmittance of the liquid crystal varies depending on the effective value of the applied voltage, on and off of the display of the liquid crystal panel can be controlled by the effective value of voltage in the selection period.

However, in the prior art of the plural line selection driving system when it is actually operated, a distortion of the scanning electrode voltage waveform which is called crosstalk due to, for example, the liquid crystal capacitance or the resistance component of the electrode, occurs when a waveform applied to a data electrode changes its shape. This distortion affects differently depending on the effective value of voltage to some columns during the non-selection period. In an actual case shown in FIG. 6, in the comparison with Points B and C both in the display-on state, the effective value during the non-selection period at the point C increases more than that of an ideal state, but decreases at the point B. For that reason, the point C has a higher transmittance.

For example, in the 2-line selection driving system, when the vertical line as shown in FIG. 3 is displayed, the distortion due to crosstalk occurs once every 1t period. The effective value of voltage is shifted due to the distortion at a high frequency of once every 2t period. For that reason, the display unevenness which occurs at above and below of the vertical line pattern becomes apparent, thus causing image deterioration.

In order to relieve the display unevenness, the orthogonal functions used in the driving system can be combined, for example, as shown in FIG. 7. In this case, as shown in FIG. 8, the crosstalk occurrence frequency is once in 2t period and the shifting of the effective value of voltage occurs once in 4t period.

However, the above-mentioned orthogonal function combination cannot completely remove the display unevenness and the frequency of crosstalk occurrence and effective value of voltage shift occurrence are considered to be too high.

Considering the waveform of a voltage applied to the scanning electrode while neglecting the above mentioned crosstalk for time being, there is a difference in amount of dullness of a waveform when the selection voltage changes as shown in FIG. 9, because the selection voltages of two selected electrodes are changed in a different number of times with reference to each other in the prior art driving method. As a result, the effective value of voltage applied to a liquid crystal is varied on some rows of a display panel so that a display variation occurs horizontally, thus causing image deterioration.

In the plural line driving method, the selection voltage applied to the scanning electrode, as well as the voltage level of the data voltage, are decided by the orthogonal function values. For that reason, the orthogonal function used in the driving method affects on factors regarding image quality besides the display unevenness. Hence, it is important to set the orthogonal function with which the display quality of a liquid crystal panel in total becomes as good as possible.

Next, a prior art configuration that influences power consumption of a liquid crystal display device will be explained.

The voltage averaging method described in "Liquid Crystal Device Handbook", pp. 395–399, has been widely used as a driving system for a liquid crystal display device having a passive matrix liquid crystal panel. In this method, the selection scanning voltage is sequentially applied to the scanning electrodes one by one each of which corresponds to a row of the liquid crystal panel at every scanning period, and then the same operation is again repeated after all the scanning electrodes have been scanned for one frame period. A data voltage corresponding to a display data value, and with respect to a non-selection scanning voltage acting as the center is applied to data electrodes each of which corresponds to a column in the liquid crystal display. Moreover, an alternating operation is performed to reverse the polarity of the liquid crystal applied voltage every fixed period.

On the other hand, the plural line selection driving method disclosed in Japanese Patent Laid-open Publication (Tokkai-Hei) No. 6-67628 is listed as a driving system for a liquid crystal display device having a passive matrix liquid crystal panel. In this method, the selection scanning voltage corresponding to the orthogonal function (e.g. Walsh function) is sequentially applied to scanning electrodes corresponding to a column of the liquid crystal panel so as to be scanned every plural scanning electrodes. When all scanning electrodes have been scanned for a duration called one frame period, the same operation is again repeated. The data voltage, which corresponds to the identity value between the orthogonal function value of a selectively scanned line and a display data value, is applied to the data electrode corresponding to a column of the liquid crystal display.

In this case, according to the voltage averaging method, since the voltage of the data driver and the voltage of the scanning driver are shifted near to the selection voltage of the scanning driver, the output amplitudes VLCD of the data driver is equalized. The equalized value is provided by a following formula (5):

$$VLCD = (\sqrt{N} + 1) \cdot \sqrt{\sqrt{n} / (2\sqrt{n} - 1)} \cdot V\text{off} \tag{5}$$

where N is a number of the scanning electrodes.

In contrast, in the plural line selection driving system, the output amplitude Vg of the data driver as well as the output amplitude Vf of the scanning driver are expressed the following formulas (6) and (7):

$$Vg = 2\sqrt{m} \cdot \sqrt{\sqrt{n} / (2\sqrt{n} - 1)} \cdot V\text{off} \tag{6}$$

$$Vf = 2\sqrt{(N/m)} \cdot \sqrt{\sqrt{n} / (2\sqrt{n} - 1)} \cdot V\text{off} \tag{7}$$

where m is a number of lines to be selected at one time, and N is a number of the scanning electrodes, and Voff is the effective value of voltage applied to the liquid crystal at a display-off time, usually between 2.0 to 2.5 volts.

In the plural line selection driving system, when the line number m is relatively small, for example, the number m of selection lines is 1, the number N of scanning electrodes is 240, and the effective value of the applied voltage Voff at a display-off time is about 2.2 volts, the formula (6) provides that the amplitude of the data driver is about 3.3 volts. Hence, compared with the amplitude of the data driver in the voltage averaging method (25 volts arrived at using the formula (5)), the amplitude of the data driver can be significantly decreased. Since the power of the data driver is larger than that of the scanning driver, the plural line selection driving system is a low power consumption driving system, compared with the voltage averaging system.

In the plural line selection driving system, although the output amplitude of the data voltage driving means (hereinafter, referred to as a data driver) is small with a small value of the selection line number m, the output amplitude of the scanning voltage driving means (hereinafter, referred to as a scanning driver) becomes large. The output amplitude of the scanning driver increases as the scanning electrode number N increases. Hence, there is a problem that the scanning driver becomes difficult to manufacture because of the withstand voltage problem which depends on the number N of the scanning electrodes.

On the other hand, when the number m of selection scanning lines which are selected simultaneously is large, the difference in amplitude levels between the selection scanning voltage and the display data voltage decreases. For that reason, even if the number N of scanning electrodes is increased, the withstand-voltage of the scanning driver can be lowered sufficiently for manufacturing. However, since the amplitude of the display data voltage increases, the withstand-voltage of the data driver increases. For example, when the withstand-voltage exceeds 5 volts, integrated circuits manufactured embodying the low withstand-voltage standard logic process cannot be used. Hence, the manufacturing cost increases sharply, and a problem arises.

Measuring the liquid crystal module which employs the voltage averaging method in a practical condition, the data driver and the scanning driver are the same drive voltage, but a ratio of the drive current in these drivers is about 10:1. For that reason, in order to reduce the power consumption of the whole liquid crystal module, it is an important problem to reduce the drive voltage of the data driver further, namely to lower the amplitude of the display data voltage.

Moreover, there is the problem that the increased number m of scanning lines which are simultaneously selected as well as the increased scale of the arithmetic-logic circuitry that calculates the identity values between the orthogonal function and the display data result in increasing power consumption and a manufacturing cost of the circuit.

SUMMARY OF THE INVENTION

In order to overcome the above mentioned problems related to the display image quality of the liquid crystal display device, the first object of the present invention is to provide a liquid crystal driving method, and a liquid crystal display device employing the method which enable to prevent occurrences of possible image quality degradation phenomena, or decrease its effect.

In order to achieve the first object of the present invention, the liquid crystal driving method which drives a liquid crystal panel including dots where scanning electrodes and data electrodes intersect is characterized by the steps of applying a 2-level selection voltage to the scanning electrodes which belong to a scanning electrode group according to an orthogonal function data value, the 2-level selection voltage having a positive polarity and a negative polarity with respect to a non-selection voltage acting as a center point, the scanning electrode group being formed of a set of n (≧2) scanning electrodes; summing identity values every scanning electrode group, the identity values being a number of times that a display data value on each scanning electrode of a scanning electrode group on which the selection voltage is applied agrees with the orthogonal function data value provided to each of the scanning electrodes; and applying a data voltage corresponding to the summation value to each of the data electrodes, comprising the steps of; dividing one frame period into plural virtual block periods; dividing a selection period in which the selection voltage is applied, into n divisional selection periods which are separated from each other at predetermined intervals, for all the scanning electrode groups to be selected in each of the virtual block period; and applying the selection voltage every divisional selection period.

In order to achieve the first object of the present invention, a liquid crystal panel including dots where scanning electrodes and data electrodes intersect; scanning voltage driving means for applying a 2-level selection voltage to the scanning electrode which belong to a scanning electrode group according to an orthogonal function data value, the 2-level selection voltage having a positive polarity and a negative polarity with respect to a non-selection voltage acting as a center point, the scanning electrode group being formed of a set of n (≧2) scanning electrodes; data voltage driving means for summing identity values every scanning electrode group, the identity value being a number of times that a display data value on each scanning electrode of each scanning electrode group on which the selection voltage is applied agrees with the orthogonal function data value provided to each of the scanning electrodes, and then applying a data voltage corresponding to the sum value to each of the data electrodes; and power supply means for producing drive voltages to the scanning voltage driving means and the data voltage driving means to drive the liquid crystal panel; wherein the scanning voltage driving means dividing one frame period into plural virtual block periods; the scanning voltage driving means dividing a selection period in which the selection voltage is applied, into n divisional selection periods which are separated from each other at predetermined intervals, for all the scanning electrode groups to be selected in each of the block periods; and the scanning voltage driving means applying the selection voltage every divisional selection period.

More concretely, in the liquid crystal display device in accordance with the present invention, for example, a divisional selection period for each scanning electrode group may be set for every block period, according to a predetermined order in selecting the scanning electrode groups which are included in each block period.

Moreover, the first i-th divisional selection period of each of the remaining scanning electrode groups may be sequentially set, following the i-th (i=1 to n) divisional selection period of the scanning electrode group which is assumed to be selected at first for each block period.

In the liquid crystal display device of the present invention, for example, the orthogonal function may be used, which is set in such a manner that the number of positive polarities of the data voltage with respect to the non-selection voltage, applied to each dot for one frame period equals or nearly equal the number of negative polarities thereof when the number of positive polarities of the selection voltage applied to each dot for 2 frame periods equals the number of negative polarities thereof, and liquid crystal panel displays the same data over the whole screen. Or, the orthogonal function may be used, which is set in such a manner that a combination of the positive polarities and negative polarities of the selection voltage applied to each dot during the n divisional selection periods is equally provided to all the scanning electrodes within one completion period of the orthogonal function.

In a displaying of the liquid crystal panel,when the liquid crystal panel has a display area, where a display on/off operation is repeated every one dot, and the background area, where the same data is displayed, the orthogonal function may be used, which is set in such a manner that the phase of a voltage waveform applied to the data electrode corresponding to the display area is switched every constant period and the phase of a voltage waveform applied to the data electrode corresponding to a background area is not changed, or that the above-mentioned relation between both the applied voltage waveforms are reversed.

In order to perform a gray-scale display using the FRC system, the orthogonal function may be used, which is set in such a manner that twice of an unit frame period which complete the gray-scale display is set as the unit period of the orthogonal function and the polarity of the orthogonal function is reversed every unit frame period of the FRC method.

In order to perform a gray-scale display using the FRC system, the number of scanning electrode groups to be selected during the block period is neither a factor of a unit line number which realizes the gray-scale modulation display of the FRC method, nor a multiple of the unit line number.

In the present invention, the above-mentioned problems regarding the power consumption are also considered. The second object of the present invention is to provide a liquid crystal display device which operates with low power consumption, and is realized by driving the scanning driver and data driver logic circuits of the matrix liquid crystal display device within a range of the standard logic voltage (low voltage range).

In order to realize the above-mentioned system, it is necessary to select the selection line number m in which the scanning driver's withstand voltage can be satisfied, according to the number N of scanning electrodes. At the same time, it is necessary to set the data driver's withstand voltage to less than about 5 volts, e.g. between 3 to 5 volts, which can be established through the standard logic process at a lower manufacturing cost. In this specification, the standard logic process is called a low withstand voltage process. The voltage range of logic signals used in logic circuits such as CMOS and TTL manufactured by the low withstand voltage process (or the standard logic voltage range) is called a low voltage range (low withstand voltage). The voltage higher than the low voltage range is called a high voltage range (high-withstand voltage).

The relationship of the withstand voltage of the scanning driver to the number N of scanning lines, and the relationship of the withstand voltage of the data driver to the number m of the selection lines, are obtained with the effective voltage value applied to the liquid crystal in a display-off state being 2.3 volts. FIGS. 58A and 58B show such results. FIG. 58A shows a case where the voltage effective value of the data driver applied to the liquid crystal in a display-off state is 2.3 volts. FIG. 58B shows a case where the voltage effective value of the scanning driver applied to the liquid crystal in a display-off state is 2.3 volts.

As it to be apparent from FIG. 58B, when the limit of withstand voltage of the scanning driver is set to 50 volts, the output amplitude Vf is 50 volts with the number m of lines simultaneously selected being 1 and the number N of scanning lines being 245 rows. Therefore the scanning line number N of up to 245 rows can be realized. Similarly, when the simultaneous selection line number m=2, the number N of scanning lines up to 500 can be realized. Moreover, when the simultaneous selection line number m=3, it is understood that the scanning line number N of 600 rows or more can be realized. On the other hand, as shown in from FIG. 58A, the output voltage Vg of the data driver which is less than 5 volts applicable to the low withstand voltage process corresponds to the case where the simultaneous selection line number m is 2 or less.

Hence, in order to realize a 640 columns×480 rows display, for example, which is a standard resolution of a computer display, the low withstand voltage process can be applied by driving a 2-screen configuration formed of two 640 columns×240 rows displays with the simultaneous selection line number m of 1 or 2. Moreover, in order to realize a 800 columns×600 rows display, which is a standard resolution of a computer display, the low withstand voltage process can be applied by driving a 2-screen configuration formed of two 800 columns×300 rows displays with the simultaneous selection line number m of 2.

In order to achieve the second object of the present invention considering the above-mentioned points, the liquid crystal display device of the present invention is driven with the simultaneous selection scanning line number m of 1 or 2, according to the resolution of the liquid crystal panel. In order to realize this configuration, the liquid crystal display device includes the data driver which drives all internal logic circuits and liquid crystal driver circuits with a low voltage between VCC (5 volts) and GND (0 volts)

On the other hand, since the data driver is driven on a low voltage between VCC and GND, the non-selection voltage is set to an intermediate voltage Vx1 (2.5 volts) between VCC and GND, and two voltages VyH and VyL of ±25 volts with respect to the non-selection voltage are set to a positive scanning selection voltage VyH (27.5 volts) and a negative scanning selection voltage VyL (−22.5 volts), and a high voltage of 50 volts between VyH and VyL are used by the scanning driver to drives the liquid crystal driver circuit.

It is preferable that the reference potential of the low voltage logic portion in the scanning driver equals that of the high voltage liquid crystal driver circuit. It is necessary that the reference potential is set to VyH or VyL because of the relationship to the drive voltage of the data driver. For that reason, since the drive signal supplied from the liquid crystal controller to the scanning driver is generally a signal with a voltage between VCC and GND, means to drive the internal logic circuits at a low voltage (e.g. between 0 to 5 volts) with respect to the reference of VyH or VyL, is used after standardizing the signal level to the reference potential in the driver.

FIGS. 59A and 59B illustrate the voltage levels of the data driver voltage and the scanning driver described above. FIG. 59A illustrates the drive voltage of the data driver and FIG. 59B illustrates the drive voltage of the scanning driver. An input signal having two modes of the liquid crystal drive voltage, namely VCCs (5 volts) and GND (0 volts), is fed to the data driver. The internal logic operates in two modes depending on VCC (5 volts) or GND (0 volts). A voltage ranging from Vx2 to Vx0, being its intermediate potential Vx1 (2.5 volts), between the liquid crystal drive voltages VCC (5 volts) and GND (0 volts) is applied to the liquid crystal driving circuit. On the other hand, with the reference potential of the scanning driver being VyL, the internal logic is driven at a voltage between the high withstand-voltage portion drive voltage VyL and the internal logic reference voltage VyC (VyL+5 (volts)). A voltage between the positive selection voltage Vy2 and the negative selection voltage Vy0 is applied to the liquid crystal driving device. Here, Vy2 is sum of the positive drive voltage and the non-selection potential Vy1 being its intermediate potential between the liquid crystal drive voltages VCC and GND, and Vy0 being sum of the negative drive voltage and the Vy1. The drive voltage VyL of the high voltage portion is equal to the negative selection voltage Vy0.

A DC/DC converter which produces voltages ranging VyH to VyL based on the VCC voltage (5 volts) can be used as the power supply circuit which supplies the drive voltages. The internal logic reference voltage VyC, non-selection voltage Vy1, negative selection voltage Vy0, positive selection voltage Vy2, data driver reference voltage Vx1, and drive voltages Vx0 and Vx2 are produced by dividing the voltages between VyH to VyL by means of resistor divides. The power supply's reference voltages between VyH to VyL can be varied by using an adjusting voltage Vcon which is input to the DC/DC converter.

In concrete, in order to achieve the above-mentioned second object of the present invention, the liquid crystal display device according to the present invention, comprises a liquid crystal panel including dots at which a scanning electrode intersects perpendicularly with a data electrode; scanning voltage driving means for applying a selection voltage and a non-selection voltage to the scanning electrode; data voltage driving means for applying a data voltage to the data electrode; and a power supply circuit for producing drive voltages to the liquid crystal panel, the scanning voltage driving means and the data voltage driving means; wherein the scanning voltage driving means producing an orthogonal function and outputting the selection voltage corresponding to the orthogonal function every two scanning electrodes; the data voltage driving means outputting and a data voltage corresponding to an arithmetic value of the display data the orthogonal function input from the scanning voltage driving means, to the data electrode; the scanning voltage driving means driving an internal logic circuit with a standard logic voltage and driving a liquid crystal voltage output means, which outputs the selection voltage, with a voltage higher than the standard logic voltage; the data voltage driving means driving the internal logic circuit and an output circuit which outputs the data voltage with the standard logic voltage.

According to the present invention, since the output voltage range of the data driver is 5 V or less, all the internal logic and the liquid crystal voltage output portion can be fabricated using the low withstand voltage process. This feature allows the liquid crystal voltage output portion to operate with lower power consumption compared to a prior art high withstand voltage averaging driving system.

When the output voltage range of the data driver exceeds 5 volts, a problem does not particularly arise by driving the internal logic and liquid crystal voltage output portion at a range of the standard power supply voltage (e.g. 5 volts ±10%) which is allowable in the low withstand voltage process.

Moreover, since the orthogonal function generating means, and the display data and the orthogonal function arithmetic-logic means are incorporated, the prior art liquid crystal controller can be used without any change, whereby a system of a higher versatility can be built.

BRIEF DESCRIPTION OF THE DRAWINGS

FIG. 11 is an explanatory diagram showing a combination of polarities of scanning selection voltages related to the first embodiment;

FIG. 43 is an explanatory diagram showing a combination of orthogonal functions related to the fifth embodiment;

FIG. 44 is an explanatory diagram showing an orthogonal function related to the fifth embodiment;

FIG. 52 is an explanatory diagram used for explaining an orthogonal function related to the seventh embodiment;

DESCRIPTION OF THE PREFERRED EMBODIMENTS

Figure 1:
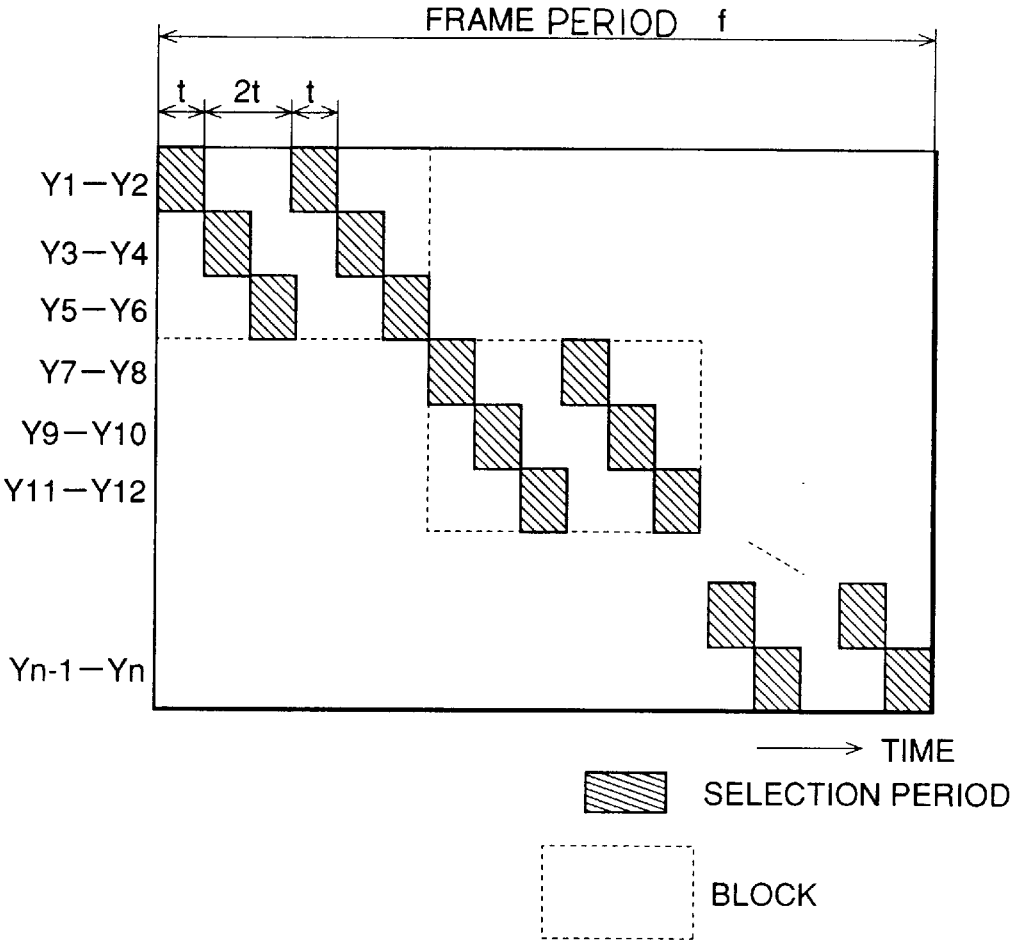
FIG. 1 is a timechart showing an example of the scanning selection period in the liquid crystal driving method according to an embodiment of the present invention, to achieve the first object.
Figure 2:
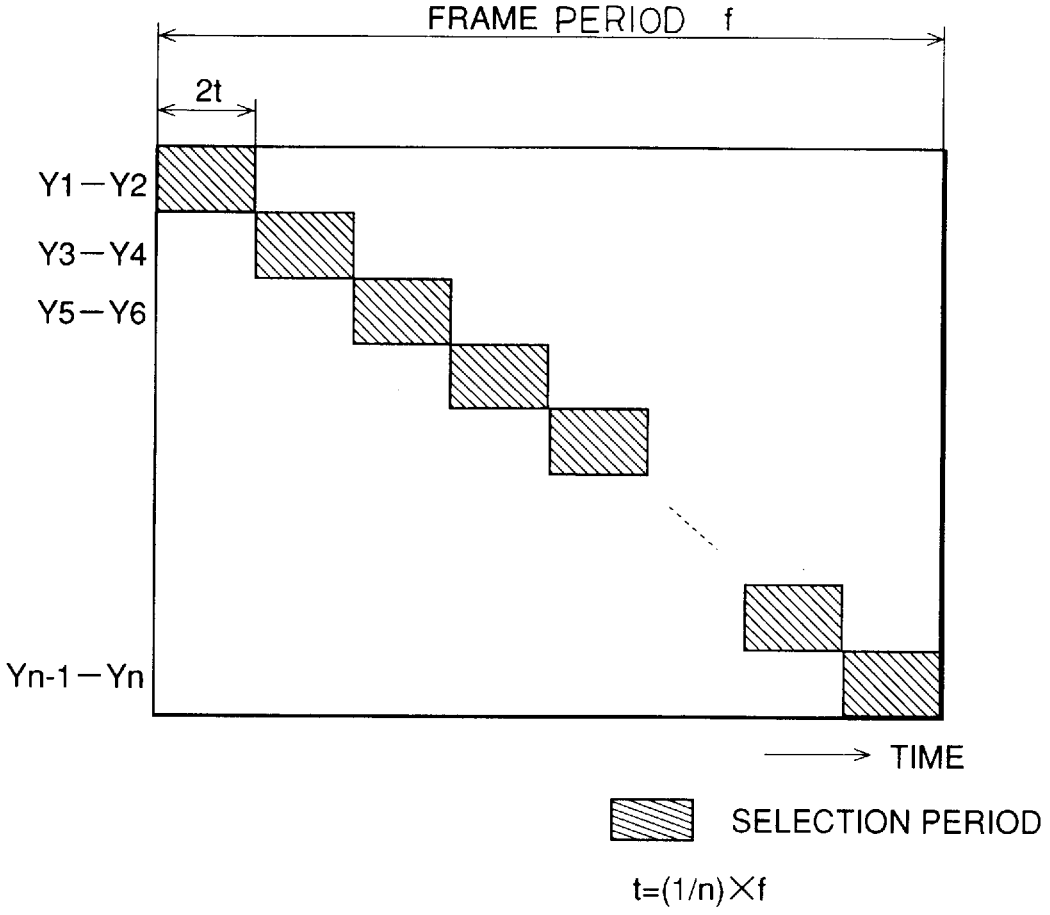
FIG.2 PRIOR ART
FIG. 2 is a timechart showing a scanning selection period in a prior art.

The method and device for displaying the liquid crystal which achieves the first object of the present invention, constituting the first to seventh embodiments, will be explained hereafter.

In order to reduce the display unevenness when displaying a vertical line, which is one of the above-mentioned problems corresponding to the first object, the change frequency of a voltage waveform applied to the data electrode should be made as low as possible. This means that the identity number between the polarity value of a scanning selection voltage and the display data value should be maintained at a constant value for as a long period of time as possible.

Since the display data value on the vertical line display is formed of a series of "on" or "off" states, the polarity value of the scanning selection voltage should be maintained constant for a long period of time in order to set the sum of the identity number being a constant value for a long period of time.

According to the present invention, one frame period is divided into plural virtual block periods, and a selection period during which the selection voltage is applied, is divided into plural divisional selection periods which are separated from each other at predetermined intervals, and the selection voltages are applied to each of the divisional selection periods to all scanning electrode groups to be selected in each block period.

For example, in the case where the present invention is applied to the 2-line selection driving method, the selection period 2t which forms one continuous period in the prior art is divided into two of 1t periods in every block period set as described above; and spaces these 1t periods over an amount of period 1t; and the selection voltages with the same polarity are applied to the scanning electrodes during an interval between these two 1t periods while applying each of the selection voltages being sequentially shifted by two scanning electrodes.

In some liquid crystal controllers each which output image data to be displayed on the liquid crystal panel, one frame period may be formed of a display interval in which the selection voltage is applied to all the scanning electrodes, and a retrace line interval (blank interval) in which the selection voltage is not applied to any scanning electrode. In such a case, in this specification, the frame period corresponds to the display interval and the period t corresponds to a value of number calculated by dividing the display interval by the total number of scanning electrodes per screen.

According to the present invention, the changing period of the voltage waveform applied to the data electrode is prolonged in proportion to the interval between two selection periods. As a result, the amount of shifting in effective value due to the crosstalk is reduced, and the display unevenness (or variation) in the vertical direction can be reduced.

Furthermore, according to the present invention, since the waveforms applied to the scanning electrode changes with same number of times (four times) during one frame period for all the scanning electrodes, the display unevenness in the horizontal direction can be reduced.

The first embodiment of the liquid crystal display driving method and device according to the present invention, embodying the 2-line selection driving system, will be described below by referring to FIG. 1 and FIGS. 10 to 23.

Firstly, the liquid crystal driving method according to the present embodiment will be described. FIG. 1 illustrates an example of a timing of the selection voltage applying period according to the present embodiment. Referring to FIG. 1, shaded portions correspond to divisional selection periods, in each of which the selection voltage is applied. There are two selection periods for one frame period f with respect to each pair of the scanning electrodes.

According to the present embodiment, one frame period is divided into plural block periods, and the divisional selection periods for every block period are set. Each of the divisional selection periods has a period of t. The interval between the divisional selection periods has a period of 2t. In this case, the period t of time is expressed as the formula (1).

That is, the waveform applied to the scanning electrode according to the present embodiment, for example, provides the first divisional selection period of the scanning electrodes Y1 and Y2 which are selected as the first scanning electrodes in the block, and before its second divisional selection period, the first divisional selection periods to the next scanning electrodes Y3 and Y4 and the successive following scanning electrodes Y5 and Y6 are provided.

Thereafter, the second divisional selection period is allocated to the scanning electrodes Y1 and Y2, and the second divisional selection periods are also sequentially provided to the scanning electrodes Y3, Y4 and Y5, Y6. As described above, where six scanning electrodes composing one block, the application of the selection period for one block is completed in the period 6t. Like the operation of the scanning electrodes Y1 to Y6, the same operation is made for the block which includes the scanning electrodes Y7 to Y12 in the next period of 6t. Thereafter, the same operation is repeated sequentially.

In the selection order of the scanning electrode groups used in the present embodiment, as shown in FIG. 1, scanning electrode groups arranged spatially disposed next to each other are selected one after another. However, the selection order of the scanning electrode groups according to the present invention should not be limited only to the present embodiment. The scanning electrode groups which are not spatially disposed next to each other may be also selected according to a predetermined sequential order.

Figures 9, 10:
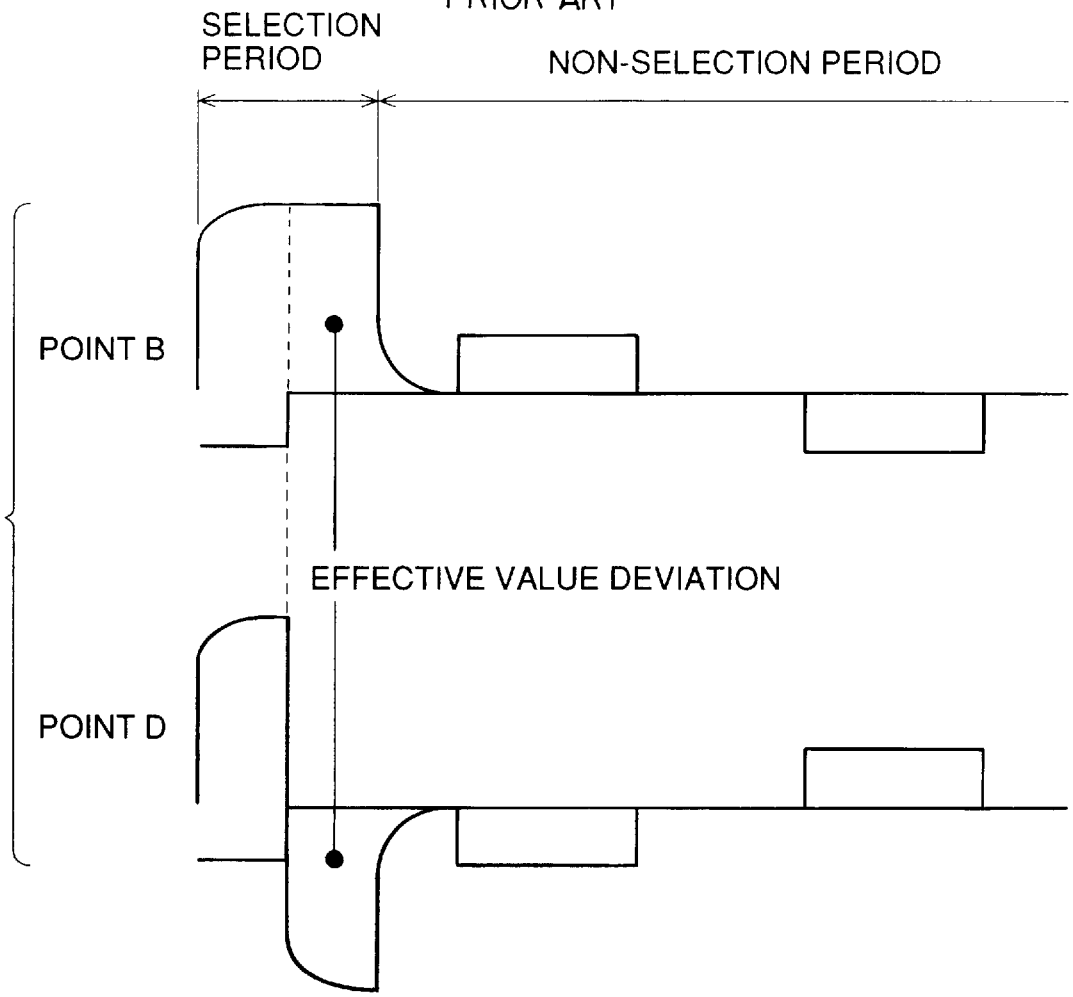
FIG.9 PRIOR ART
FIG. 9 is a timechart showing an example of voltages applied across a liquid crystal corresponding to a display unevenness horizontally occurring in a prior art.
FIG. 10 is an explanatory diagram showing a combination of polarities of scanning selection voltages related to the first embodiment.

The combinational condition for the polarities of selection voltages according to the present embodiment will be explained using FIGS. 10 to 12.

Here, it is assumed that the polarity of the selection voltage being on the positive side with respect to the non-selection voltage is defined as +1, that the polarity of a selection voltage being on the negative side with respect to the non-selection voltage is defined as −1, and the scanning electrode with an odd number is YA, and that a scanning electrode with an even number is YB. Then there are four possible combinations of [0] to [3] as shown in FIG. 10.

With the stipulation that the combinations [0] to [3] are in the orthogonal state, there are 8 combinations of the first selection voltage and the second selection voltage as follows:

$$[\text{First, Second}] = ([0],[1]),([0],[2]),$$
$$([1],[3]),([2],[3]),$$
$$([1],[0]),([2],[0]),$$
$$([3],[1]),([3],[2])$$

In the present embodiment, the following two conditions are added in order to reduce occurrence of shifting in the effective value of the liquid crystal applied voltage accompanying a change in the data electrode applied waveform.

The first condition requires selecting of one kind of combination per block (refer to FIG. 1) among the above-mentioned first and the second selection voltage combinations. The second condition requires to equalize a ratio of numbers of the positive polarities to the negative polarities in the levels of the selection voltages in the last divisional selection period (second selection) of a block and that in the first divisional selection period (first selection) of the next block as shown in FIG. 11.

Figure 3:
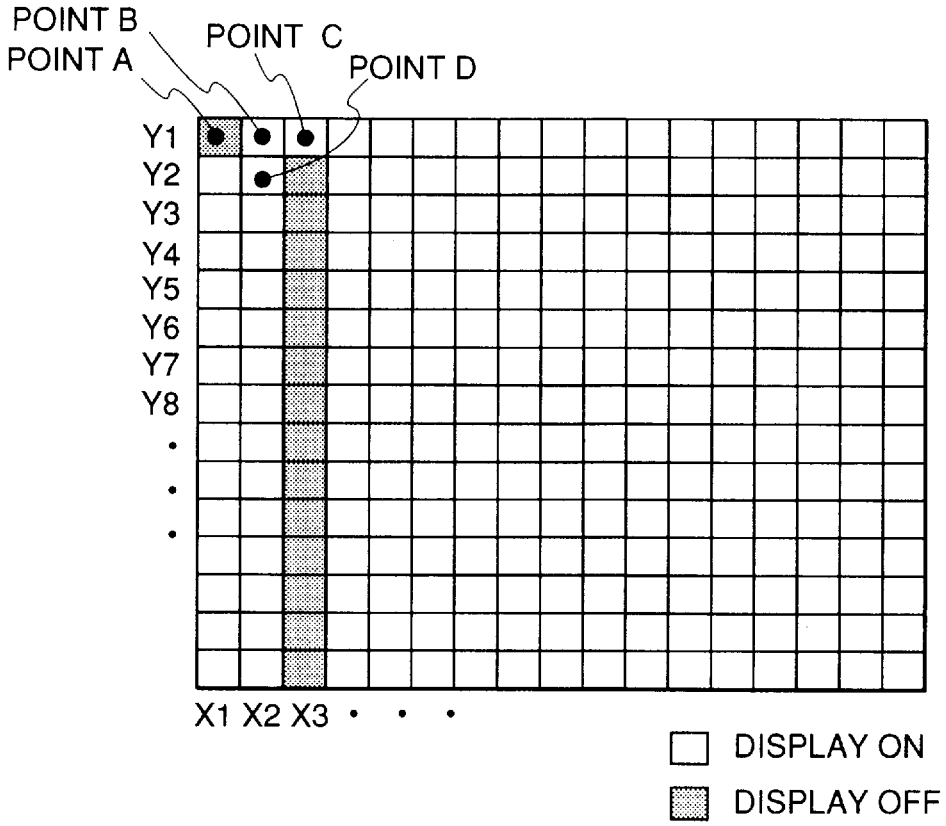
FIG.3 PRIOR ART
FIG. 3 is an explanatory view illustrating an example of a display on/off operation of a liquid crystal panel.
Figure 4:
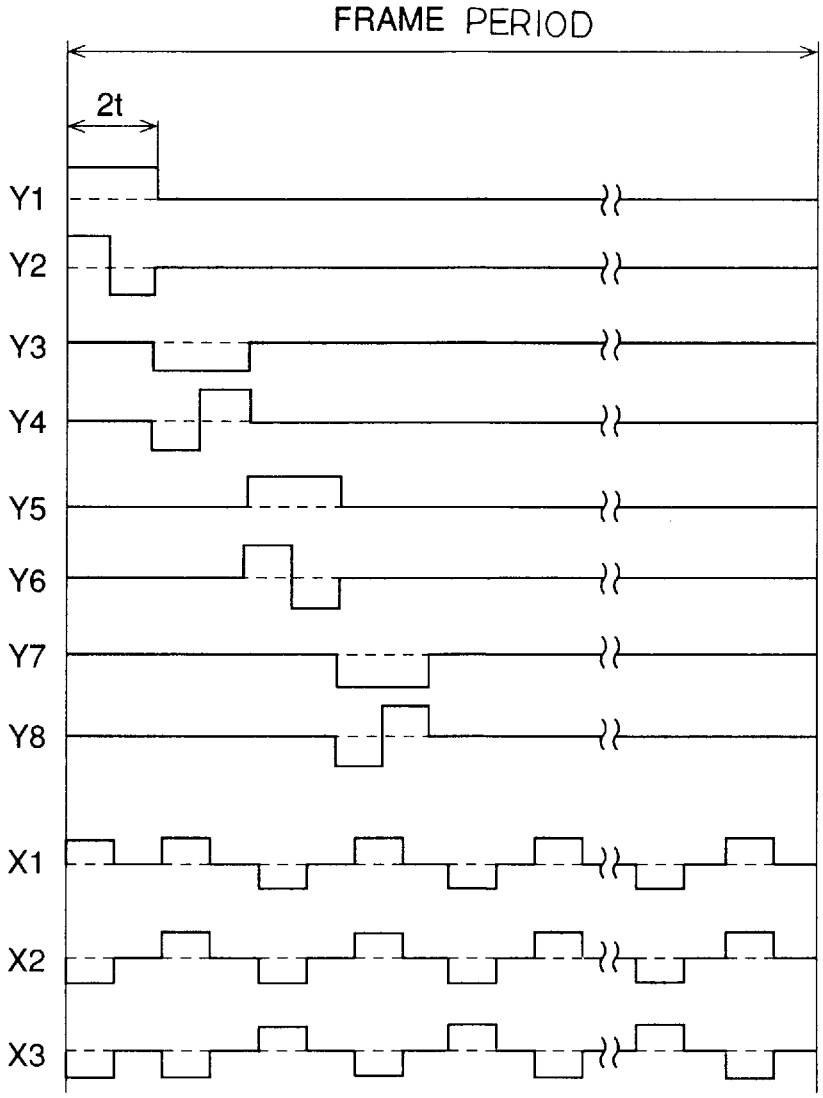
FIG.4 PRIOR ART
FIG. 4 is a timechart showing an example of voltages applied across a liquid crystal in a prior art.
Figure 5:
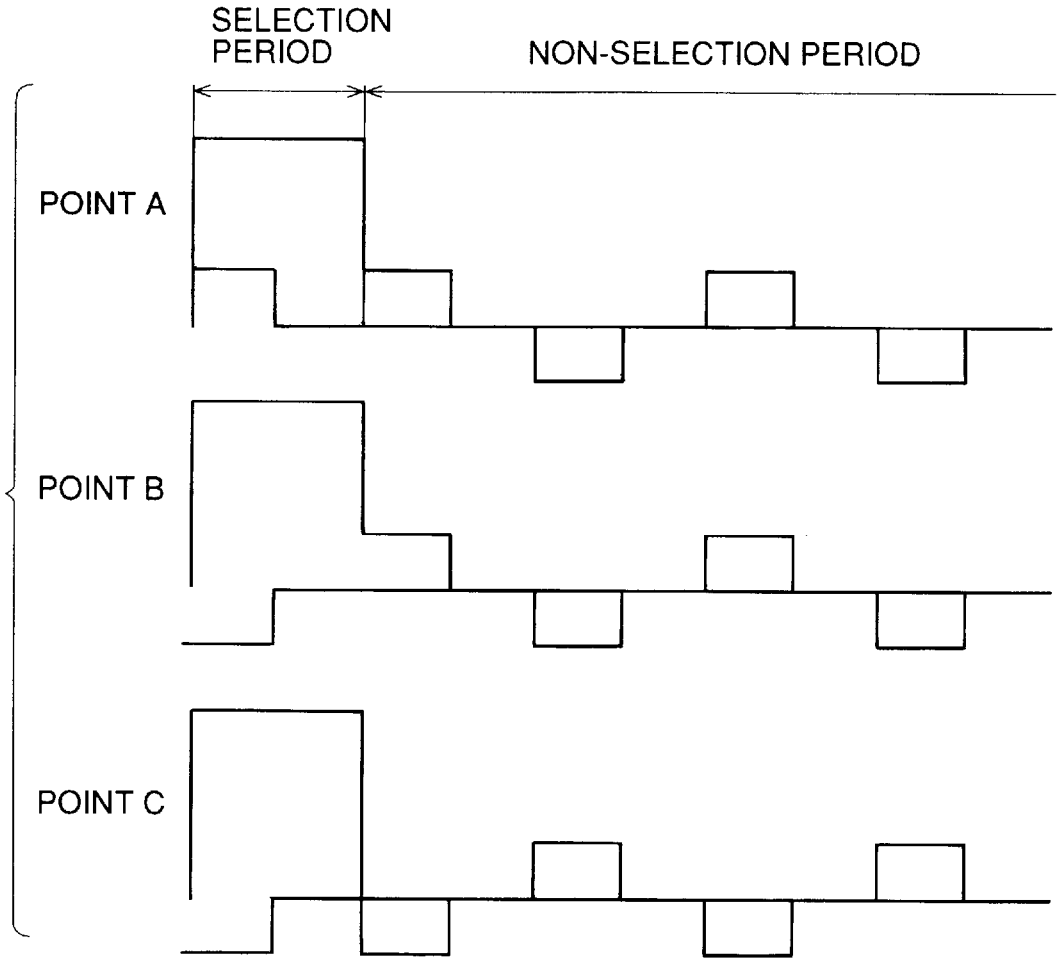
FIG.5 PRIOR ART
FIG. 5 is a timechart showing an example of voltages applied across a liquid crystal at various points on a liquid crystal panel in a prior art.
Figure 6:
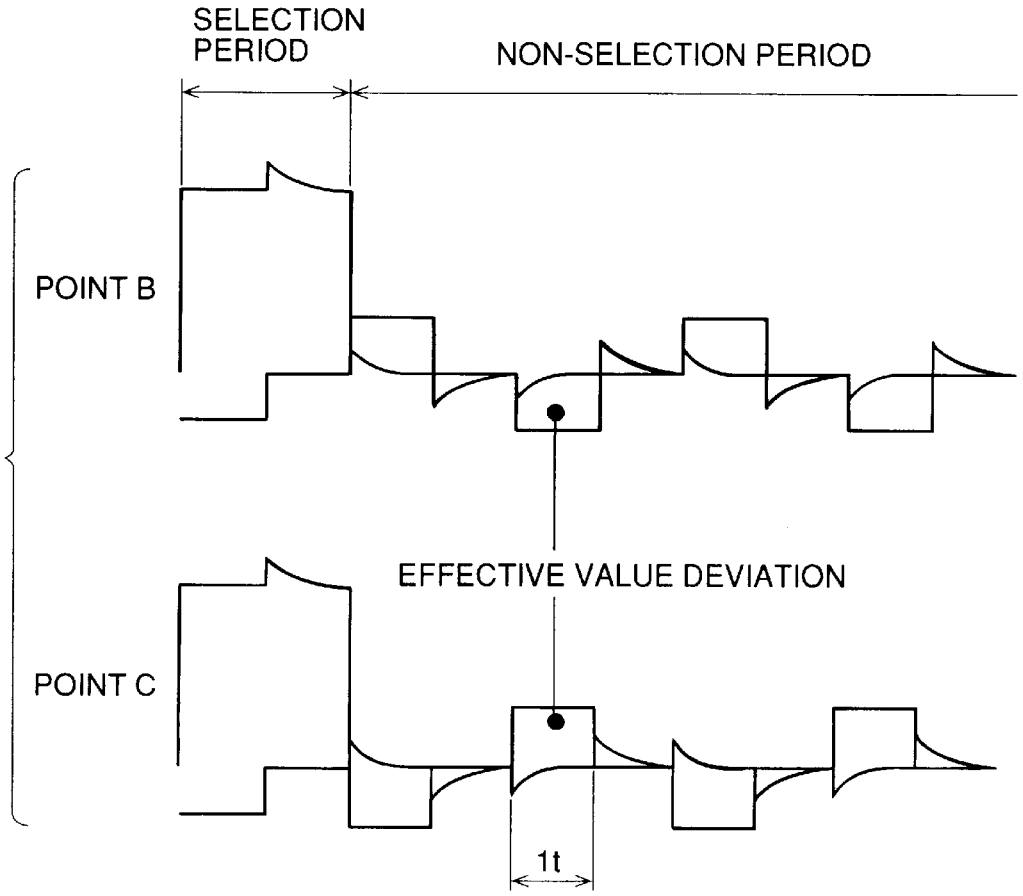
FIG.6 PRIOR ART
FIG. 6 is a timechart showing an example of (actual) voltages applied across a liquid crystal at various points on a liquid crystal panel in a prior art.
Figure 7:
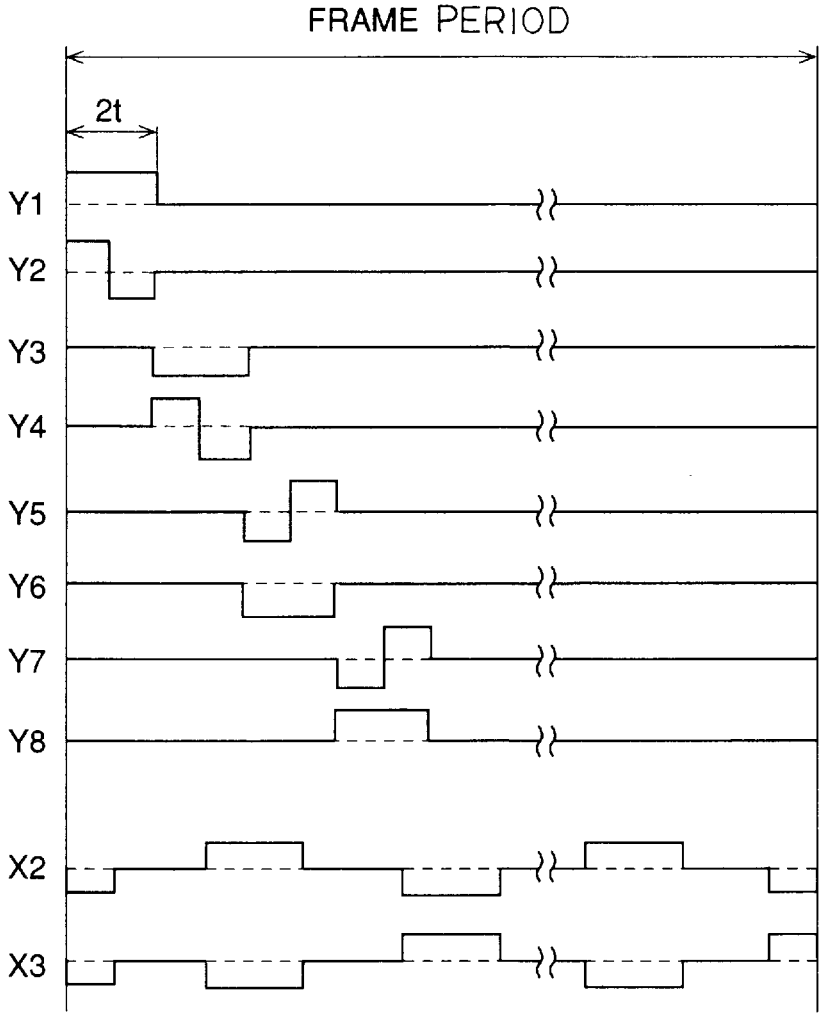
FIG.7 PRIOR ART
FIG. 7 is a timechart showing another example of voltages applied across a liquid crystal in a prior art.
Figure 8:
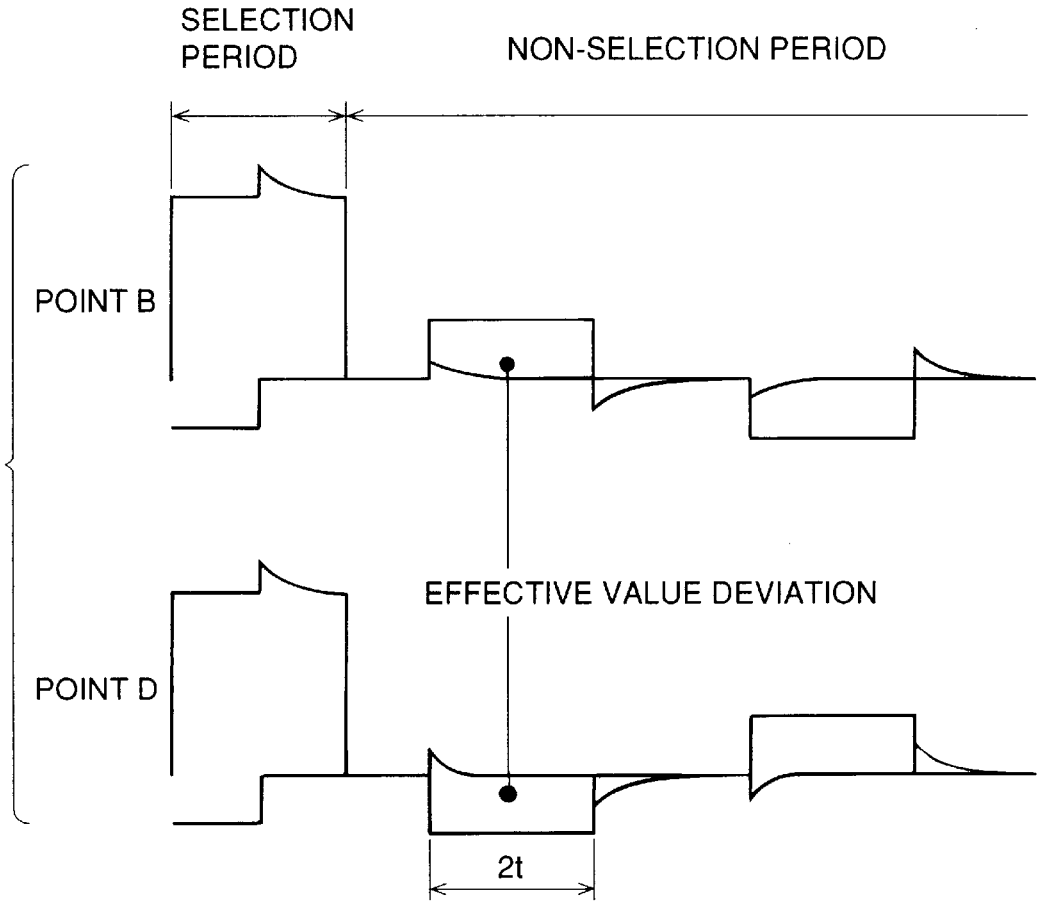
FIG.8 PRIOR ART
FIG. 8 is a timechart showing an example of voltages applied across a liquid crystal corresponding to a display unevenness vertically occurring in a prior art.
Figure 12:
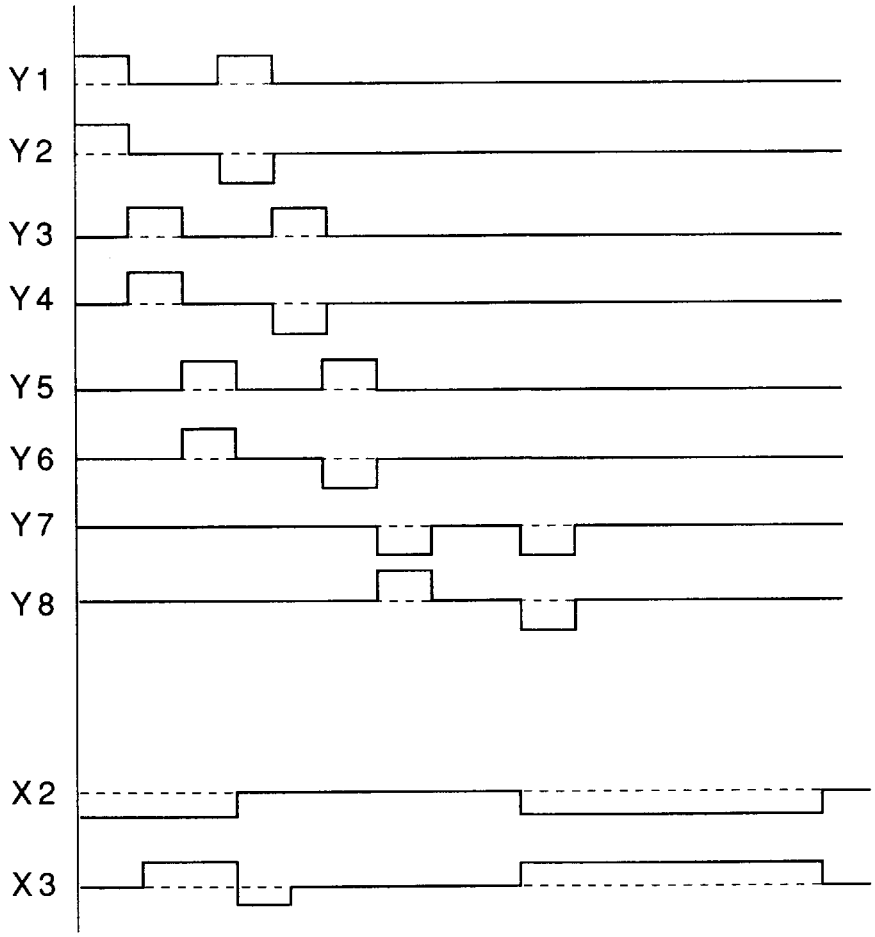
FIG. 12 is a timechart showing an example of a liquid crystal applied voltage according to the first embodiment.
Figure 13:
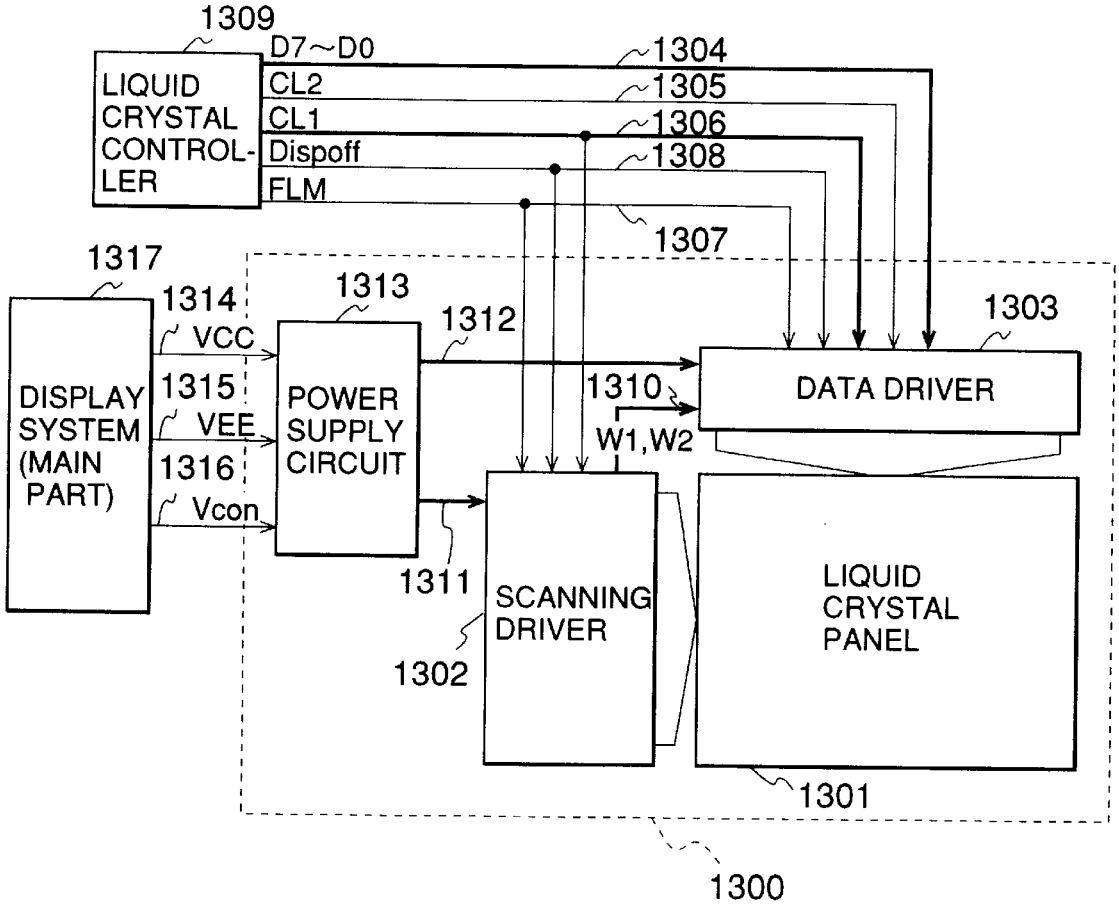
FIG. 13 is a block diagram showing an example of the liquid crystal display device according to the first embodiment.

FIG. 12 illustrates an example of the scanning electrode voltage waveform satisfying the above two conditions. Where the vertical line pattern, for example, shown in FIG. 3 is displayed using the scanning voltage waveform of the present embodiment, the applied voltage waveforms of the data electrodes X2 and X3 change during the 6t period for the non-selection period, as shown at the bottom of FIG. 12. Hence, since the frequency is decreased, compared with that in the 2t period in the prior art system, the display variation in the vertical direction can be reduced.

It is assumed that the waveform applied to the data electrode in the present embodiment is set according to the method similar to the well-known plural line selection driving method, which is described in the description of the related art. That is, the identity numbers between the display data voltage of the scanning electrode on which the selection voltage is applied and the data value of the orthogonal function assigned to the scanning electrode are summed for every scanning electrode to which the selection voltage is applied. Then the corresponding data voltage according to the summation is applied to the data electrode.

According to the present embodiment, since the scanning electrode applied waveform changes on all the scanning electrodes four times during one frame period, the dullness of waveform resulting from the changes in the waveform is averaged between lines so that the horizontal display unevenness can be reduced.

Next, an example of the liquid crystal display device realizing the above-mentioned liquid crystal driving method will be explained below by referring to FIGS. 13 to 23.

The liquid crystal display device 1300 according to the present embodiment includes a liquid crystal panel 1301 formed of m horizontal dots and n vertical dots; a scanning driver 1302; and a data driver 1303 for driving the liquid crystal panel 1301; and a power supply circuit 1313 for supplying electrical power to both the drivers.

A liquid crystal driver controller 1309 in a prior art inputs display data, a synchronous signal, and the like to the scanning driver 1302 and the data driver 1303. More specifically, there are 8-bit-parallel display data signals (D7 to D0) 1304, a data latch clock CL2 signal (1305) synchronous to the display data signal 1304, a line clock CL1 signal (1306), and a leading line clock FLM signal 1307, and a display-off control signal DISPOFF, as signals output from the liquid crystal driver controller 1309 to the data driver 1303.

When the display-off control signal 1308 is at a low level no data is displayed. One period of the leading line clock signal 1307 corresponds to one frame period. Data for each line is transmitted in synchronism with one period of the line clock signal 1306.

Among the output signals sent to the data driver 1303 from the liquid crystal driver controller 1309, the line clock signal 1306, the leading line clock signal 1307, and the display-off control signal 1308 are output from the liquid crystal driver controller 1309 to the scanning driver 1302. The scanning polarity signal group 1310 is fed from the scanning driver 1302 to the data driver 1303.

The power supply circuit 1313 produces and supplies, a voltage group 1311 to the scanning driver 1301 and the voltage group 1312 to the data driver 1303. The main part of the display system hereafter called "the display system (main part)" 1317 supplies external power supply voltages VCC 1314, VEE 1315, each being a base of the liquid crystal drive voltage groups 1311, 1312, and a voltage VCON 1316 to adjust the voltage level of the liquid crystal voltage groups, to the power supply circuit 1313.

Next, the operation of each block of the liquid crystal display device 1300 of the present embodiment will be explained.

Figure 14:
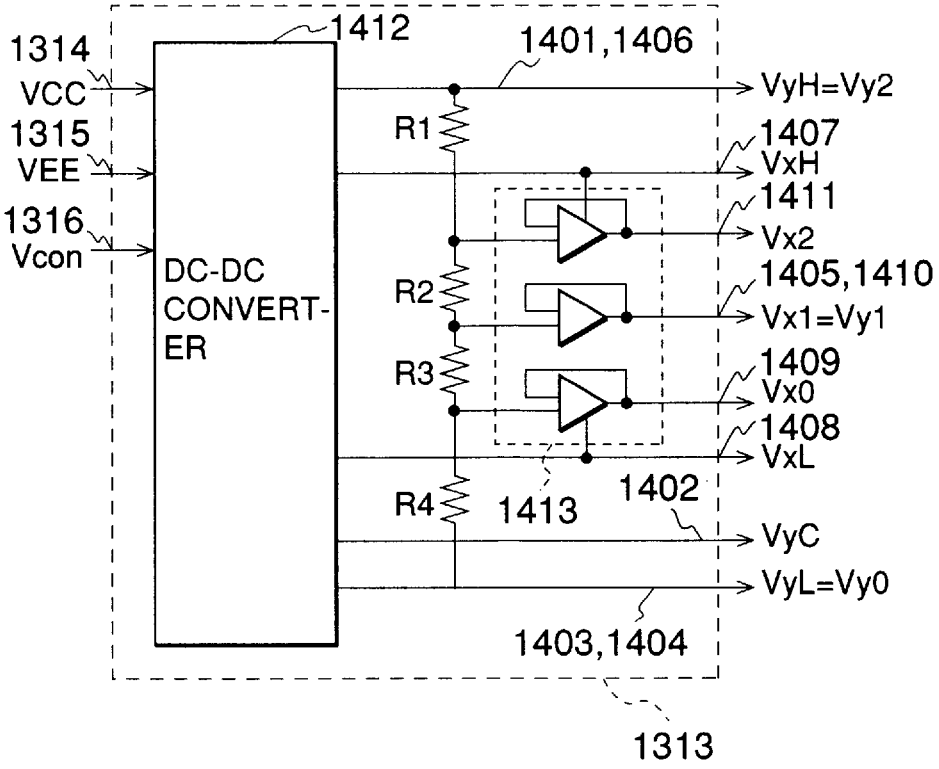
FIG. 14 is a block diagram showing the configuration of the power supply circuit shown in FIG. 13.

First, an example of the power supply circuit 1313 embodying the present invention will be explained by using FIG. 14. FIG. 14 is a structural diagram showing the power supply circuit 1313 in this example.

According to the present embodiment, the power supply circuit 1313 supplies, as the liquid crystal drive voltage group 1311, the scanning driver power supply voltages VyH 1401, VyC 1402 and VyL 1403, and the liquid crystal driver scanning voltages Vy0 (1404), Vy1 (1405) and Vy2 (1406), to the scanning driver 1302.

The power supply circuit 1313 also supplies, as the liquid crystal voltage group 1312, data driver power supply voltages VxH 1407 and VxL 1408 and the liquid crystal driver data voltages Vx0 (1409), Vx1 (1410) and Vx2 (1411), to the data driver 1303.

The power supply circuit 1313 includes a DC/DC converter 1412. The DC/DC converter 1412 produces the scanning driver power supply voltages 1401 to 1403, the liquid crystal driver scanning voltages Vy0 (1404), Vy2 (1406), and the data driver power supply voltages 1407, 1408.

The liquid crystal data voltages 1409 to 1411 and the liquid crystal driver scanning voltage Vy1 (1405) are obtained by dividing the voltage difference between the scanning driver power supply voltages VyH(1401) and VyL (1403) by means of the resistors R1 to R4.

In this case, there is the following relationship between the resistors R1 to R4:

R1=R4

R2=R3

There is the following relationship between the voltages:

VyH=Vy2>Vy1>VyL=Vy0

Vy2−Vy1=Vy1−Vy0

VxH>Vx2>Vx1>Vx0>VxL

Vx2−Vx1=Vx1−Vx0

Vy1=Vx1

Each of the drive voltage levels is given by the above-mentioned formulas (2) and (3).

The data voltages 1409 to 1411 and the scanning voltage Vy1 (1405) for driving the liquid crystal are produced via the voltage follower circuit using operational amplifiers 1413. The operational amplifiers 1413 are powered with the data driver power supply voltages 1407, 1408.

Figure 15:
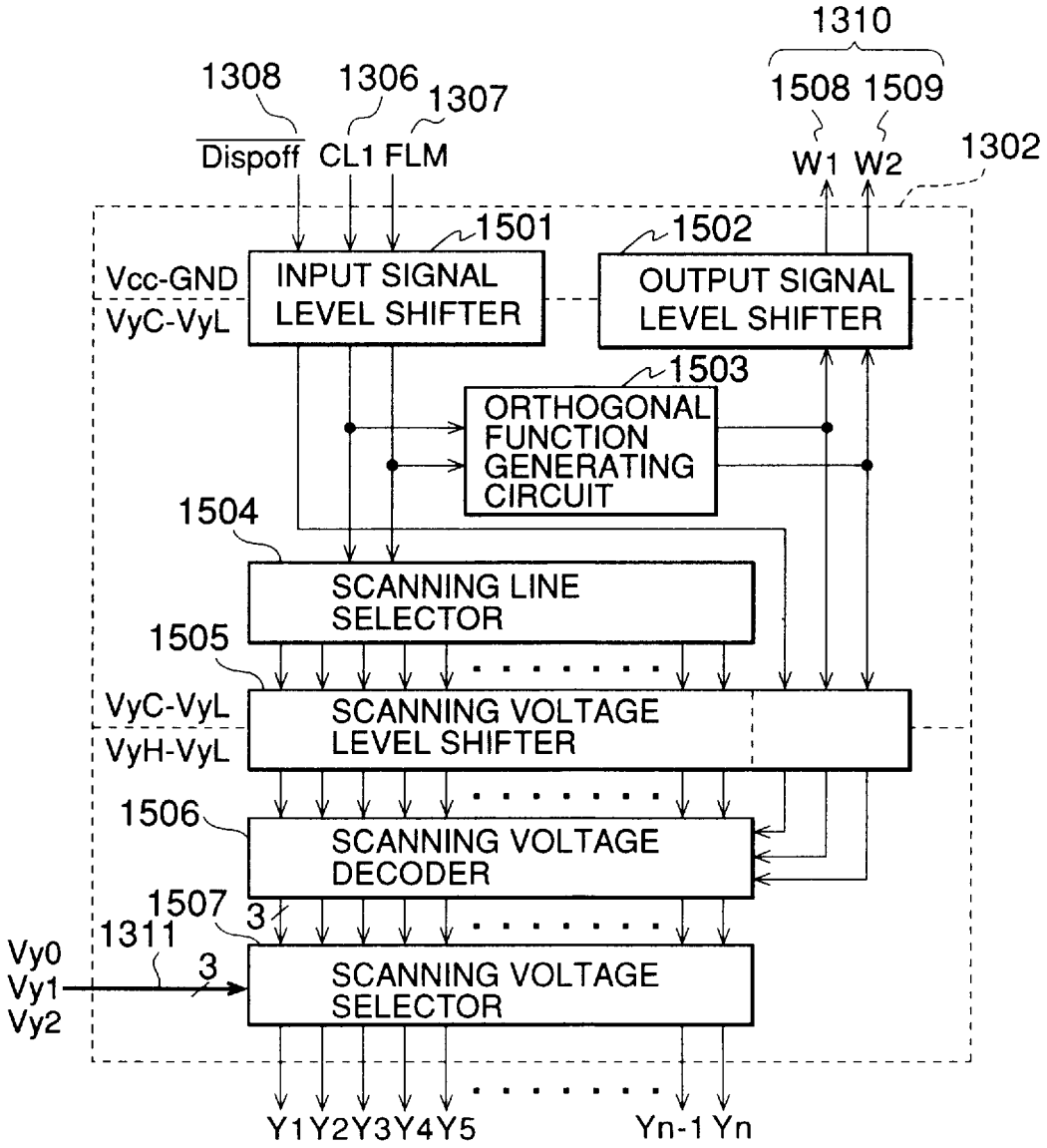
FIG. 15 a block diagram showing the configuration of the scanning driver shown in FIG. 13.
Figures 16, 17:
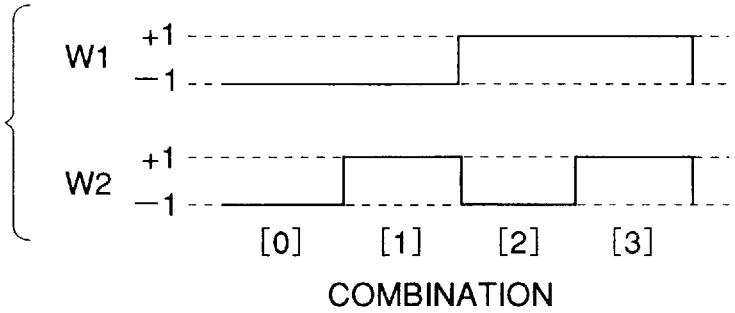
FIG. 16 is a timechart showing an orthogonal function generated in the scanning driver shown in FIG. 13.
FIG. 17 is an explanatory diagram showing a combination of orthogonal functions shown in FIG. 16.
Figure 18:
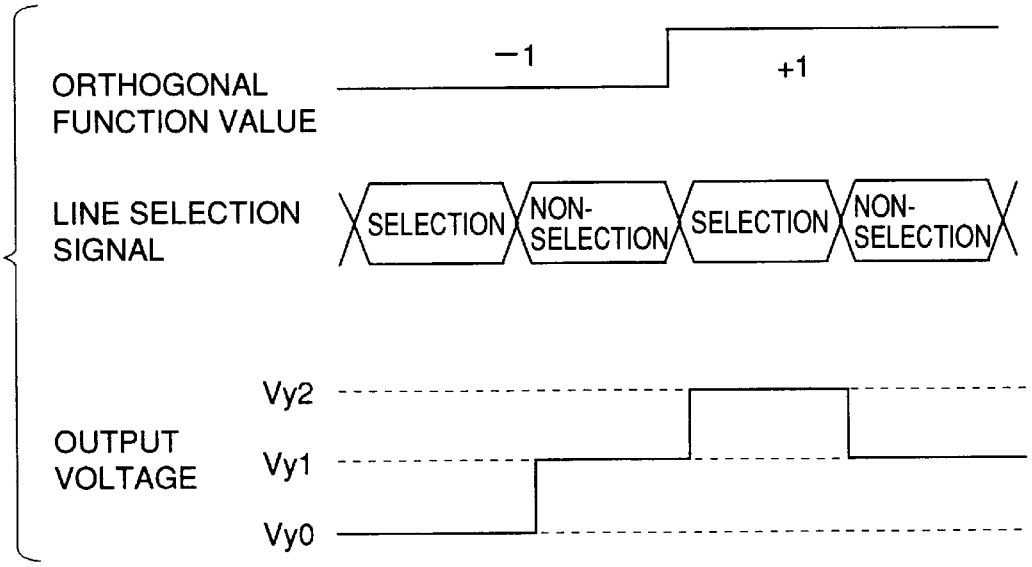
FIG. 18 is a timechart used for explaining the operation of the scanning driver shown in FIG. 13.
Figure 19:
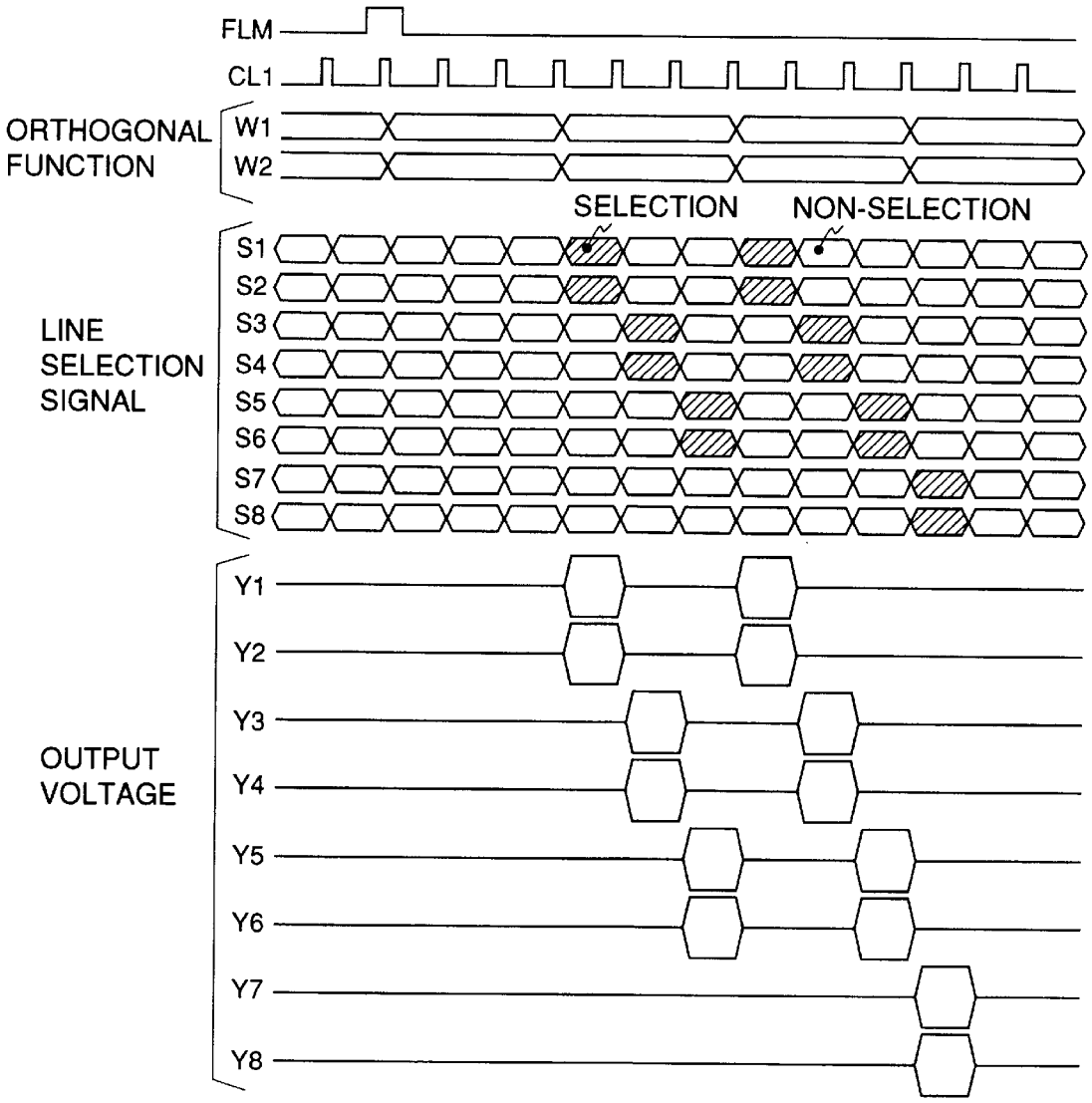
FIG. 19 is a timechart used for explaining the operation of the scanning driver shown in FIG. 13.

Next, an example of the scanning driver 1302 embodying the present invention will be explained below by referring to FIGS. 15 to 19. FIG. 15 is a structural diagram illustrating the scanning driver 1302. FIG. 16 shows the orthogonal function designating the polarity of the output selection voltage from the scanning driver 102. FIG. 17 shows a combinational example of the orthogonal function. FIG. 18 is an explanatory diagram illustrating the operation of the scanning driver 1302. FIG. 19 is a timing chart of input and output signals of the scanning driver 1302.

The scanning driver 1302 according to the present embodiment includes an input signal level shifter 1501, an output signal level shifter 1502, an orthogonal function generating circuit 1503, a scanning line selector 1504, a scanning voltage level shifter 1505, a scanning voltage decoder 1506, a scanning voltage selector 1507, and scanning voltage output terminals Y1 to Yn. The scanning driver 1302 outputs, as the scanning polarity signal group 1310, a 2-bit signal including the orthogonal function W1 signal 1508 and an orthogonal W2 signal 1509.

The input signal level shifter 1501 is a circuit that level-shifts input signal groups in Vcc and GND levels to internal logic drive voltage levels VyC and Vy. The output signal level shifter 1502 is a circuit that level-shifts respectively VyC and VyL level signal groups produced in the internal logic circuits to Vcc and GND level signal groups.

The orthogonal function generating circuit 1503 is a part to generate the orthogonal function designating the polarity of the output selection voltage. The orthogonal function generating circuit 1503 produces the W1 signal 1508 and W2 signal 1509, based on a count value of the leading line clock FLM signal 1307 and a count value of the line clock CL1 signal 1306.

An example of an orthogonal function produced by the orthogonal function generating circuit 1503 will be explained below using FIGS. 16 and 17. FIG. 16 shows a combination of the orthogonal function W1 signal 1508 and the orthogonal function W2 signal 1509. There are four combinations of (W1,W2)=(−1,−1), (−1,+1), (+1,−1) and (+1,+1). FIG. 17 shows that corresponding relationships between the count values and the combinations (combinations [0] to [3] in FIG. 16) when the FLM signal 1307 is counted in the octal scale and the CL1 signal is counted in the scale based on 24.

For example, when the count value of the FLM signal 1307 is "2" and the count value of the CL1 signal 1306 is "1", (W1,W2)=(+1,+1) is output as the orthogonal function. When the count value of the FLM signal 1307 is "7" and the count value of the CL1 signal 1306 is "17", (W1,W2)=(−1,+1) is output as the orthogonal function.

The reason, that the orthogonal function value is switched according to the count value of the FLM signal 1307, is to carry out the alternating operation of the liquid crystal applied voltage and to prevent a flicker when a gray-scale display is made with the frame rate control (FRC) system. The count value of the CL1 signal 1306 is reset to "0" in synchronism with the CL1 signal 1306 in the "high" level period of the FLM signal 1307.

Since the image quality of the display device is varied significantly by depending on the orthogonal function's setting, it is important to set the orthogonal function appropriate to usages of the liquid crystal device. This orthogonal function setting method will be explained later in detail in the fifth to seventh embodiments.

The scanning line selector 1504 is formed of a plurality of circuits corresponding to the number of liquid crystal voltage output terminals. The scanning line selector 1504 outputs line selection signals S1 to Sn designating the selection period of each scanning electrode in response to the FLM signal 1307 and the line clock CL1 signal 1306.

The scanning voltage level shifter 1505 is a circuit which boosts signal's voltage in the VyC and VyL levels, each being the internal logic power supply voltage, to the high-voltage in the VyH and VyL levels for driving the liquid crystal.

The scanning voltage decoder 1506 and the scanning voltage selector 1507 select and output one level of the voltage among 3 level liquid crystal drive scanning voltages, according to a combination of the line selection signal and the orthogonal function. For example, as shown in FIG. 18, providing the orthogonal function (W1 or W2) is "−1", when the selection signal is in a "selection" state, the voltage Vy0 (1404) is selected, and when the selection signal is in a "non-selection" state, the voltage Vy1 (1405) is selected. Providing the orthogonal function is "+1", when the selection signal is in a "selection" state, the voltage Vy2 (1406) is selected, and when the selection signal is in a "non-selection" state, the voltage Vy1 (1405) is selected. When the display-off control DISPOFF signal 1308 is at a "low" level, the voltage Vy1 (1405) is selected regardless of the line selection signal and the orthogonal function value.

As to the operation of the scanning driver 1302 according to the present embodiment described above, an example of the timings of the input and output signals are shown in FIG. 19.

Figure 20:
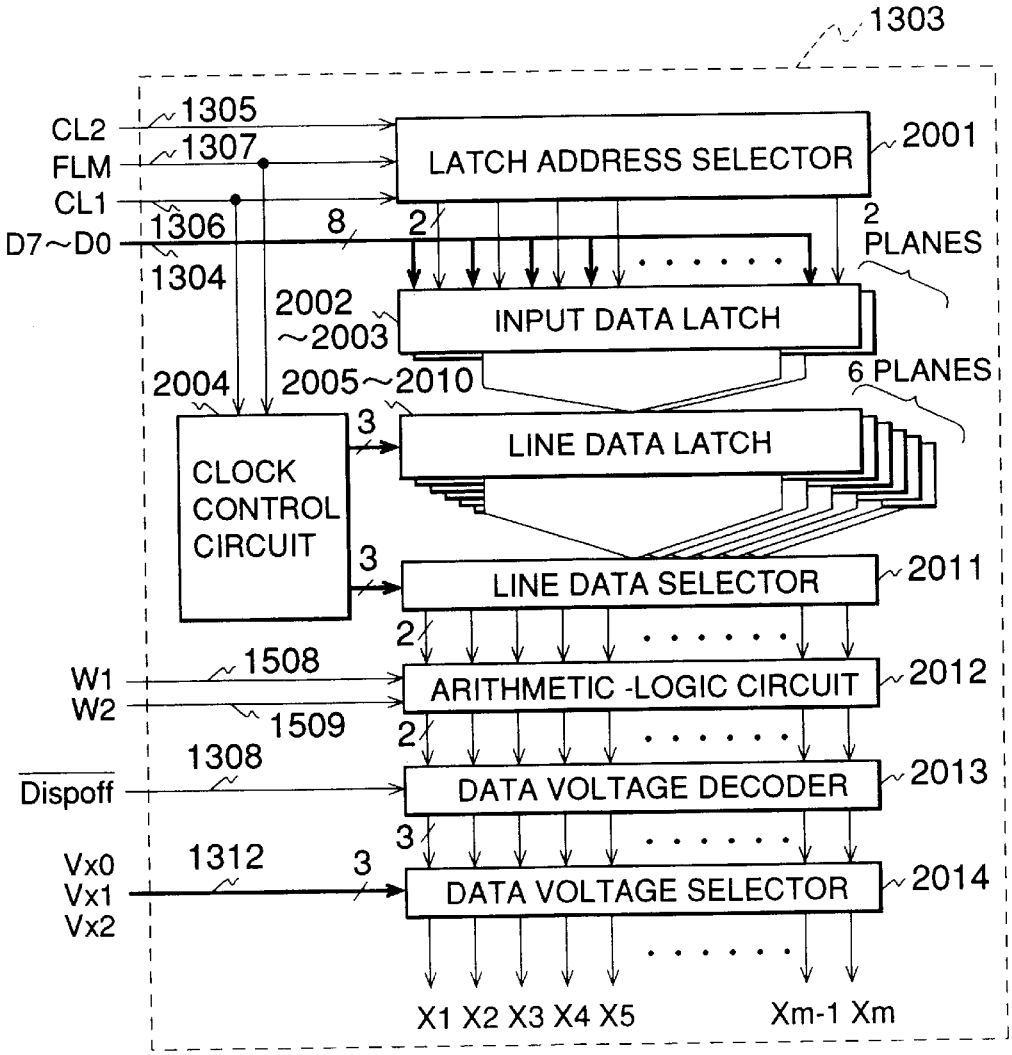
FIG. 20 is a block diagram showing the configuration of the data driver shown in FIG. 13.
Figure 21:
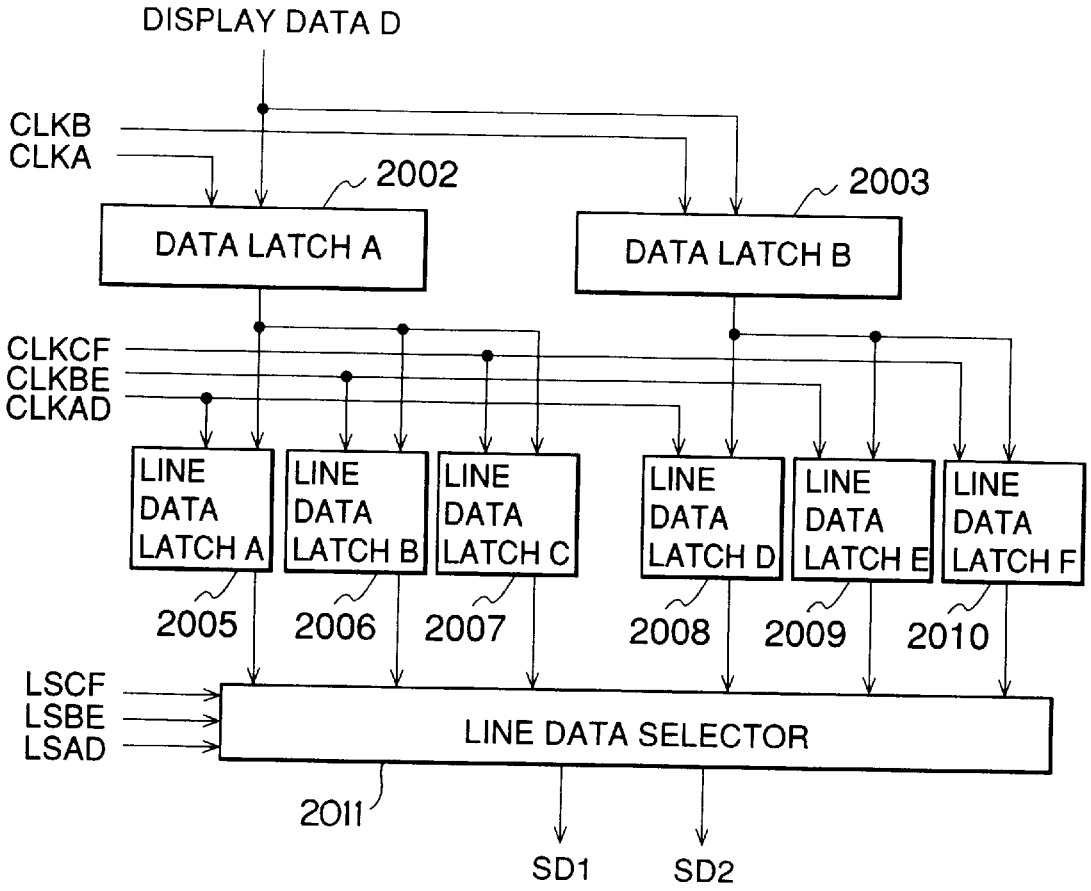
FIG. 21 is a block diagram showing the major configuration corresponding to an output of the data driver shown in FIG. 13.
Figure 22:
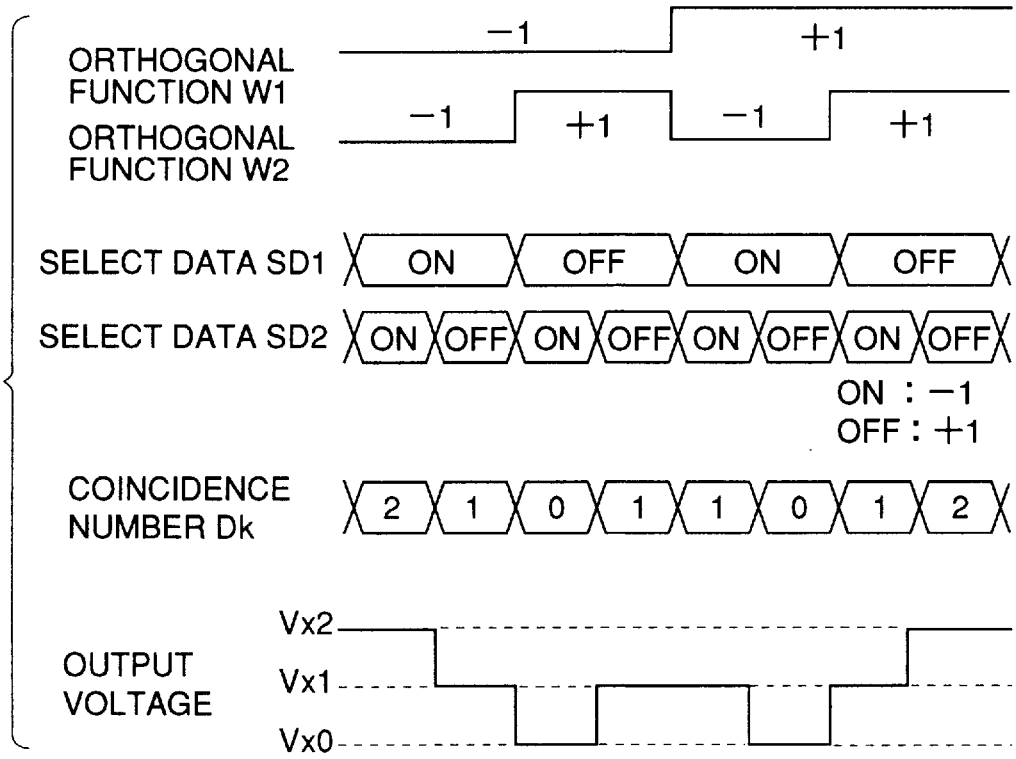
FIG. 22 is a timechart used for explaining the operation of the data driver shown in FIG. 13.
Figure 23:
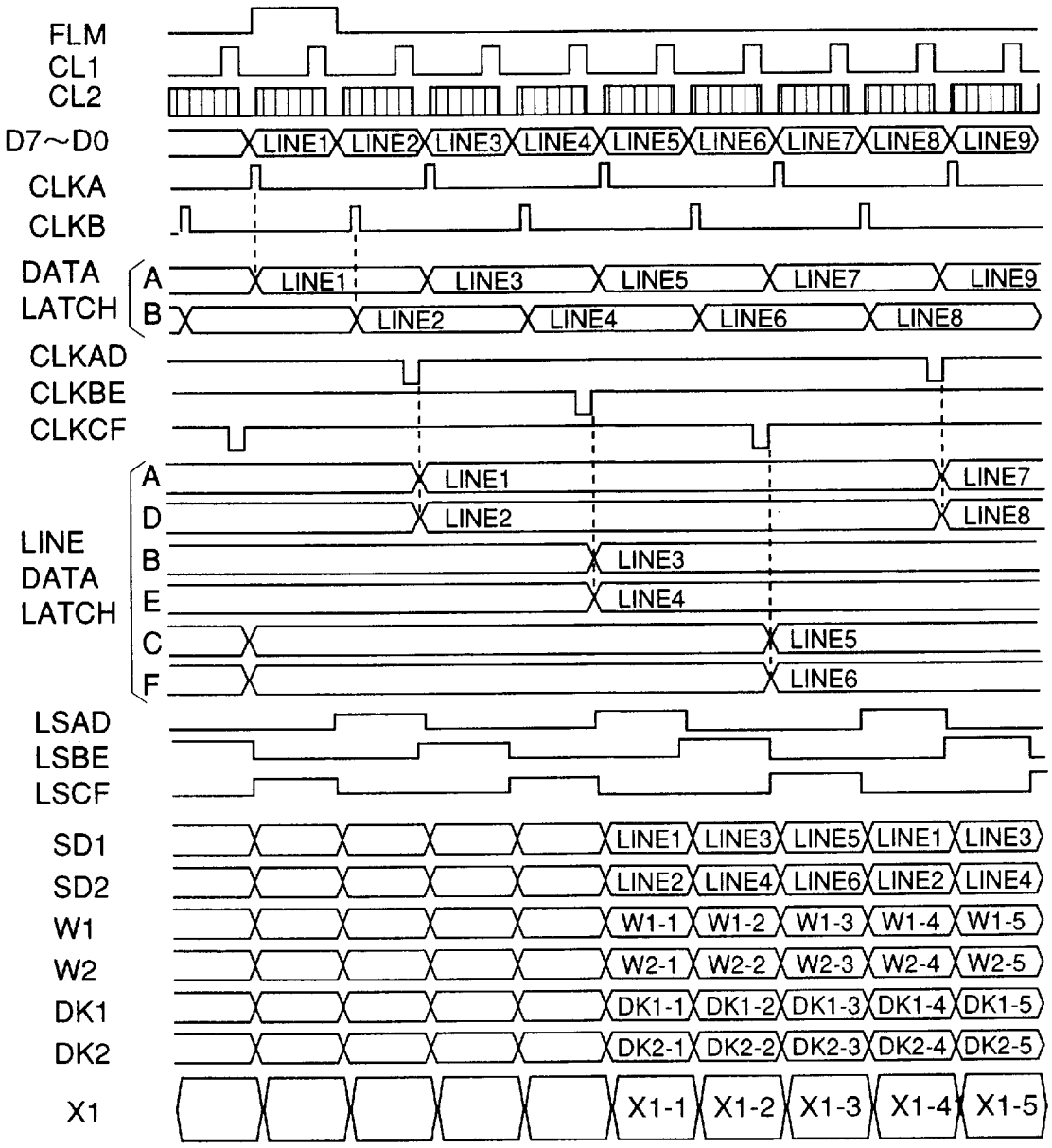
FIG. 23 is a timechart used for explaining the operation of the data driver shown in FIG. 13.

Next, an example of the data driver 1303 embodying the present invention will be explained using FIGS. 20 to 23. FIG. 20 is a structural diagram illustrating the data driver 1303 according to the present embodiment. FIG. 21 is a structural diagram illustrating one output circuit of the data driver 1303 according to the present embodiment. FIG. 22 is an operational explanatory diagram. FIG. 23 is a timing chart of an output and output signal.

The data driver 1303 according to the present embodiment, as shown in FIG. 20, consists of a latch address selector 2001, input data latch circuits A2002 to B2003, a clock control circuit 2004, line data latch circuits A2005 to B2010, a line data selector 2011, an arithmetic-logic circuit 2012, a data voltage decoder 2013, a data voltage selector 2014, and data voltage output terminals X1 to Xm.

Each of the input data latch circuits A2002 and B2003 has a configuration which latches data for 2 lines (2 planes), and each of the line data latch circuits A2005 to F2010 has a configuration which latches data for 6 lines (6 planes).

The latch address selector 2001 is a circuit which produces data capture signals for the input data latch circuits A2002 and B2003. The data capture signals are reset by the line clock CL1 signal 1306, and are produced according to the count value of the data latch clock CL2 signal 1305.

The input data capture signal is formed of the CLKA signal and the CLKB signal, as shown in FIG. 21. The CLKA signal becomes the capture signal of the input data latch circuit A2002, and the CLKB signal becomes the capture signal of the input data latch circuit B2003. The CLKA and CLKB signals are alternately input with one line clock period.

The clock control unit 2004 is a circuit which produces a data capture signal for the line data latch circuits A2005 to F2010. The data capture signal is reset by the leading line clock FLM signal 1307, and is produced according to the count value of the line clock CL1 signal 1306. The line data capture signal is formed of the CLKAD signal, the CLKBE signal and CLKCF signal, as shown in FIG. 21.

CLKAD becomes the capture signal for the line data latch circuits A2005 and D2008. CLKBE becomes the capture signal for the line data latch circuits B2006 and E2009. CLKCF becomes the capture signal for the line data latch circuits C2007 and F2010. The CLKAD signal, CLKBE signal and CLKCF signal are alternately input with a 2-line clock period.

The clock control circuit 2004 further produces selection signals LSAD, LSBE and LSCF for the line data selector 2011. These signals are reset by the leading line clock FLM signal 1307, and are produced according to the count value of the line clock CL1 signal 1306.

The line data selector 2011 selects two items of output data among the output data of the line data latch circuits A2005 to F2010 in response to the select signals LSAD, LSBE and LSCF and then outputs them as the selection data signals SD1 and SD2. When the select signal LSAD is at a "high" level, the data of the line data latch circuit A2005 becomes the SD1 signal and the data of the line data latch circuit D2008 becomes the SD2 signal. When the LSBE signal is at a "high" level, the data of the line data latch circuit B2006 becomes the SD1 signal and the data of the line data latch circuit E2009 becomes the SD2 signal. When the LSCF signal is at a "high" level, the data of the line data latch circuit C2007 becomes the SD1 signal and the data of the line data latch circuit F2010 becomes the SD2 signal.

The arithmetic-logic circuit 2012 consists of a plurality of arithmetic-logic units (operation units) corresponding to a number of voltage output terminals. Each of the arithmetic-logic circuits compares the value of the SD1 signal being the output of the line data selector 2011 with the value of the scanning function W1 signal 1508, and compares the value of the SD2 signal with the value of the scanning function W2 signal; represents a sum of the identity values for each pair in 2 bits; and outputs results of the summation as identity value data DK1 and DK2 corresponding to each bit.

The data voltage decoder 2013 and the data voltage selector 2014 select and output one level of the voltage among three levels of the data voltage for driving the liquid crystal, according to the identity value Dk output from the arithmetic-logic circuit 2012. For example, as shown in FIG. 22, when the identity value is "0", the voltage Vx0 (1409) is selected. When the identity value is "1", the voltage Vx1 (1410) is selected. When the identity value is "2", the voltage Vx2 (1411) is selectively output. When the display-off control DISPOFF signal 1308 is in a "low" level, the voltage Vx1 (1410) is selected regardless of the line selection signal and the value of the orthogonal function.

The timing of the input and output signal of the data driver 1303 according to the present invention as descried above will be explained by referring to FIG. 23.

First, even number lines of the display data (D7 to D0) 1304 are captured by the input data latch circuit A2002 in synchronism with the rise of the CLKA signal, and odd number lines thereof are captured by the input data latch circuit B2003 in synchronism with the rise of the CLKB signal. The, the captured data are captured by the line data latch circuits, in synchronism with the rising of the CLKAD signal, the CLKBE signal and the CLKCF signal. The data of 2 lines are selected from the 6 lines captured by the line data latch circuit in accordance with the select signals LSAD, LSBE and LSCF. Then, the data voltage is output according to the sum of the identity values between the selection data SD1 signal and the orthogonal function W1 signal, and between the selection data SD2 signal and the orthogonal function W2 signal.

In order to display a proper image, it is necessary that data of the first line is always captured by the data latch A at the timing shown in FIG. 23, regardless of the clock counts of the CL1 signal per frame. In order to satisfy the requirement, it requires that the CLKA signal capturing clock is generated and the CLKB signal capturing clock is halted whenever the data of the first line is transferred. In order to realize the above-mentioned configuration, the configuration, for example, may be employed, that counts the number of clock pulses of the CL1 signal, then identifies the first line of each frame using the counted value and the number of clock pulses per frame of the CL1 signal, and satisfies the above-mentioned condition.

As descried above, the liquid crystal display device according to the present embodiment can realize an applied voltage waveform having two selection periods divided, using the liquid crystal driving method (refer to FIG. 1) described before.

Furthermore, in the liquid crystal driving method according to the present embodiment, where the number of scanning electrodes, for example, is 240, the applied voltage of the scanning electrode can be about 35 volts and the applied voltage of the data electrode can be about 5 volts. For that reason, thinning wires for voltage applications or using a low withstand voltage wire become possible, and these promote integrating circuits in smaller size. Hence, the present embodiment enable to provide the scanning driver and the data driver in one-chip or LSI form to drive both of the above-mentioned applied voltage.

In the liquid crystal display device according to the present embodiment, the orthogonal function designating the polarities of the selection signal is produced inside the scanning driver, and operations with the orthogonal function and the display data is carried out inside the data driver. Hence, the liquid crystal display device according to the present embodiment can interface to the liquid crystal controller which realizes the voltage averaging method which is the driving conventional method and used widely, and is a highly versatile and interchangeable with liquid crystal display devices in the prior art.

Furthermore, compared with the driving system employing the voltage averaging method, the 2-line selection driving system embodying the present embodiment can be operated at a low power consumption because of the low drive voltage of the data driver.

In the explanation of the present embodiment, the interval between the divisional selection periods is 2t. However, the present invention should not be limited only to the present embodiment. The interval may be set to 3t or more. In this case, since the change frequency of a data voltage waveform in the vertical line pattern further decreases, it is possible to further reduce the display unevenness. However, as the interval between the divisional selection periods extends, a size of memory needed to hold the line data increases. Hence, it is preferable that the interval is set within a range of it to 5t.

Next, another embodiment of the liquid crystal driving method employing the present invention will be explained as the second embodiment. In the first embodiment, the 2-line selection driving method has been shown as the example. However, the concept of dividing a selection period into plural periods is applicable to a three or more line selection driving method. Hereinafter, an explanation will be made as to the case where the present invention is applied to a four line selection driving method.

Figure 24:
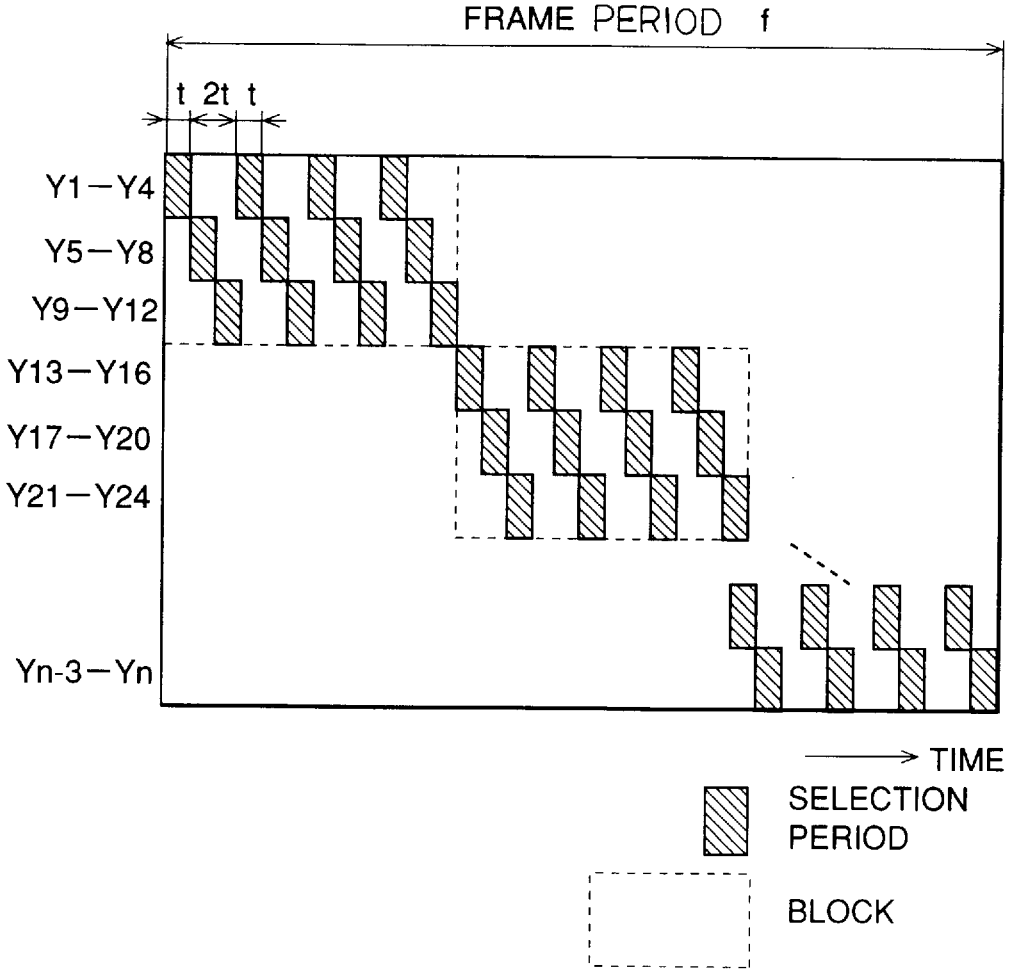
FIG. 24 is a timechart showing an example of a scanning selection period in a liquid crystal driving method according to the second embodiment.
Figure 25:
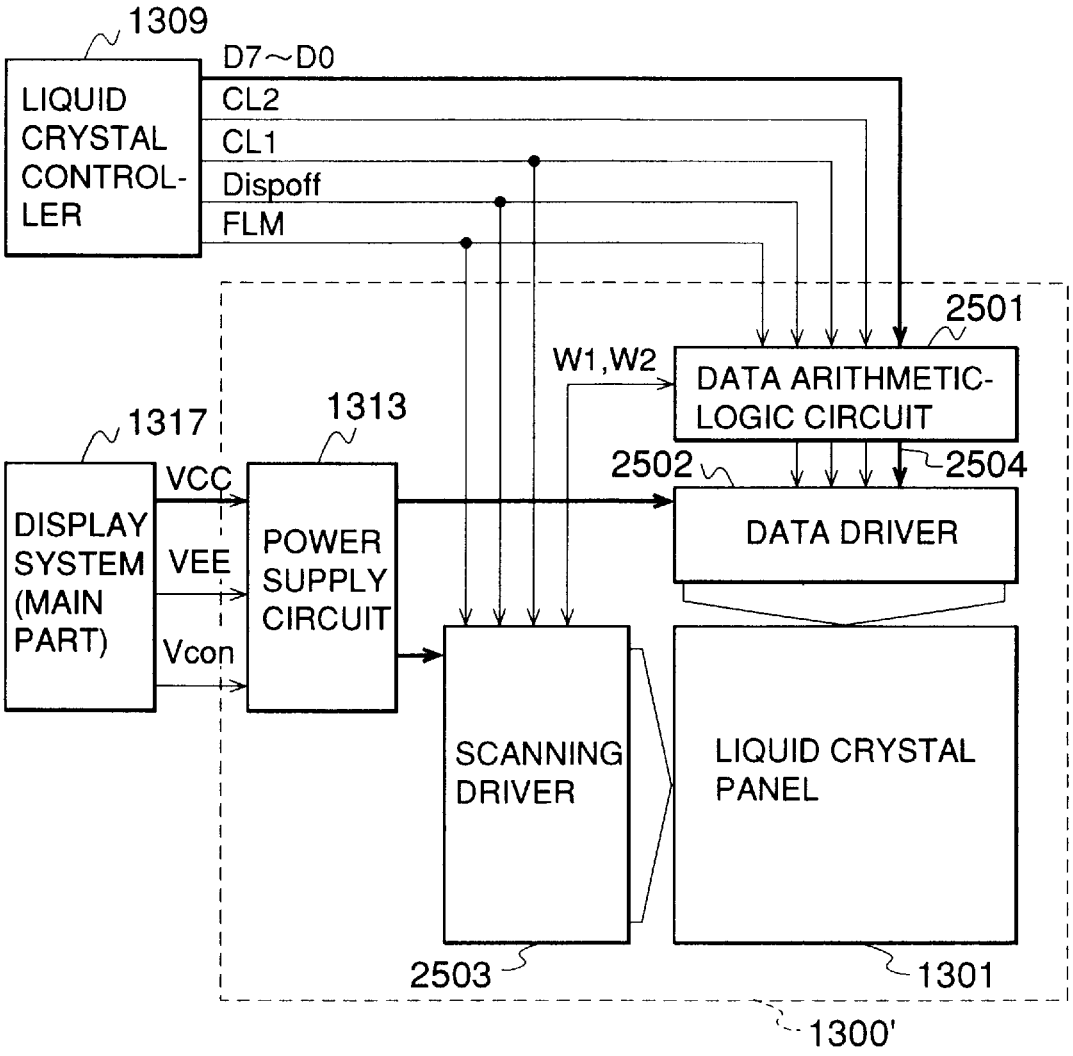
FIG. 25 is a block diagram showing the configuration of the liquid crystal display device according to the third embodiment.
Figure 26:
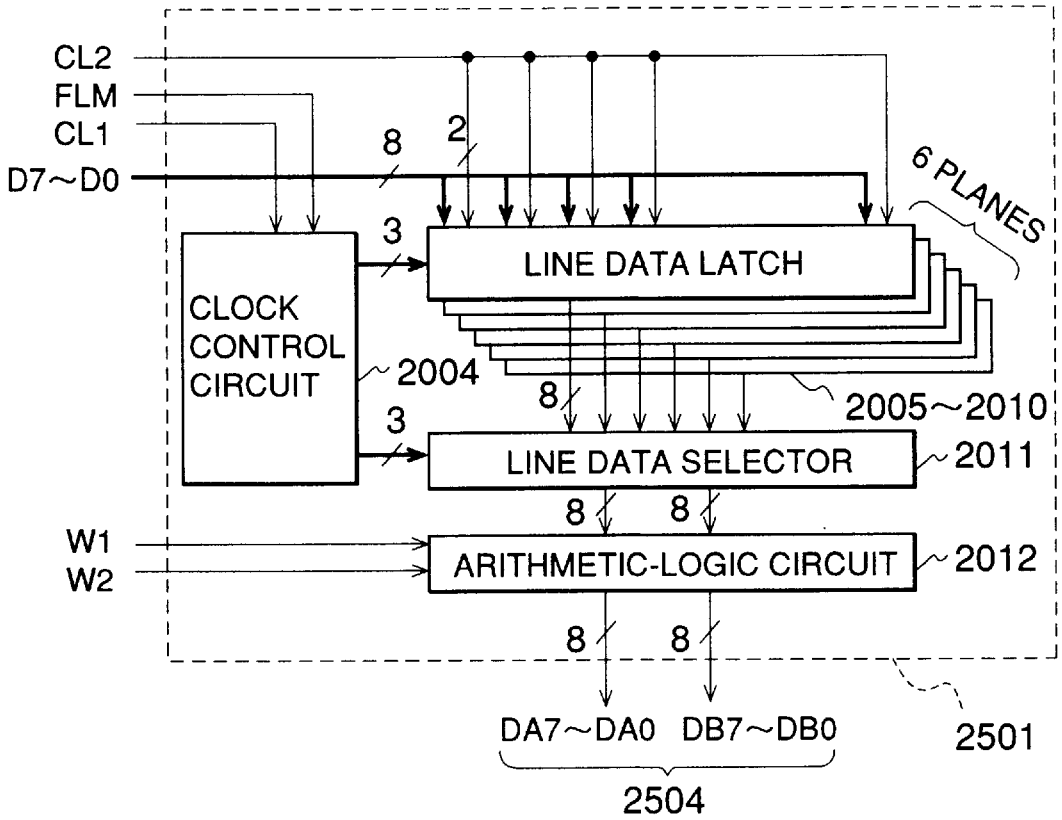
FIG. 26 is a block diagram showing the configuration of the data arithmetic-logic circuit shown in FIG. 25.

FIG. 24 illustrates an example of a scanning period timing in the four line selection driving method according to the present embodiment. Referring to FIG. 24, the shaded portion corresponds to the divisional selection period during which a selection voltage is applied. In the present embodiment, four scanning electrodes are grouped as one set and each set is selected four times for one frame period f. Here, it is assumed that each divisional selection period is t, the interval between two divisional selection periods is 2t, and a value of the period t is calculate by formula (1).

In the present embodiment, as shown in FIG. 24 for example, the waveforms are applied to the scanning electrodes in such a way that, the first divisional selection period is provided to the scanning electrodes Y1 to Y4 being the first scanning electrode group, and before its second divisional selection period, the first divisional selection period is provided to the next scanning electrodes Y5 to Y8 and the further next scanning electrodes Y9 to Y12. Thereafter, after the second divisional selection period has been provided to the scanning electrodes Y1 to Y4, the second divisional selection period is sequentially provided to the scanning electrodes Y5 to Y8 and Y9 to Y12. The selection period applied to the scanning electrodes Y1 to Y12 for one frame period is completed by repeating this operation four times.

When 12 scanning electrodes are grouped as one block, the selection period applied to one block is completed in the period 12t. The same operation is performed for the blocks Y13 to Y24 within the next period 12t. Hereinafter, this operation is repeated sequentially.

In the present embodiment, one kind of combination of orthogonal polarities is selected per block, and that the ratio of positive polarities to negative ones obtained for the fourth selection period of a block and that of the first selection period of the next block are to be the same value. Under this condition, when the vertical line pattern, for example, as shown in FIG. 3, is displayed, the voltage waveform applied to the data electrodes X2 and X3 changes once per 12t for a non-selection period.

Therefore the occurrence of shifting in the effective value of the liquid crystal applied voltage due to a change in the data electrode applied waveform decreases, and thus it is possible to reduce the display unevenness in horizontal and vertical directions.

Like the first embodiment for example, the liquid crystal display device according to the present embodiment which realizes the above-mentioned voltage waveform, may be achieved by having the orthogonal function designating the polarity of the selection voltage to be produced inside the scanning driver, and operation of the orthogonal function and display data to be carried out inside the data driver.

Next, another embodiment of the liquid crystal display device embodying the present invention will be explained as the third embodiment.

In the liquid crystal display device according to the present embodiment, the arithmetic-logic circuit, which had been included in the data driver of the first embodiment is separated to be an independent circuit. The liquid crystal display device of the present embodiment may be appropriate for the liquid crystal driving method which explained in the second embodiment and needs a larger line data holding capacitance as the number of simultaneously selected lines increases.

The liquid crystal display device 1300 according to the present embodiment, as shown in FIG, 25, is similar to the liquid crystal display device 1300 according to the first embodiment, except for the data arithmetic-logic circuit 2501, the data driver 2502, and the scanning driver 2503. The same numerals are assigned to the same elements as those in the first embodiment. And, redundant explanations for the same elements will be omitted.

When the 2-line selection driving voltage waveform in the first embodiment, for example, is realized in the data arithmetic-logic circuit 2501 of the present embodiment, the circuit 2501 includes line data latch circuits 2005 to 2010, line data selector 2011, an arithmetic-logic circuit 2012, and a clock control circuit 2004.

The line data latch circuits 2005 to 2010 store display data of 6 scanning electrode lines (refer to FIG. 1) selected in one block, by a data latch clock signal CL2. Like the first embodiment, the line data selector circuit 2011 selects 2 lines of data from among the display data by on which the selection voltage is applied for one period. The arithmetic-logic circuit 2012 outputs arithmetic data DA7 to DA0 and DB7 to DB0 which are obtained by summation operation of the identity values between the selected data and the orthogonal function.

Figure 27:
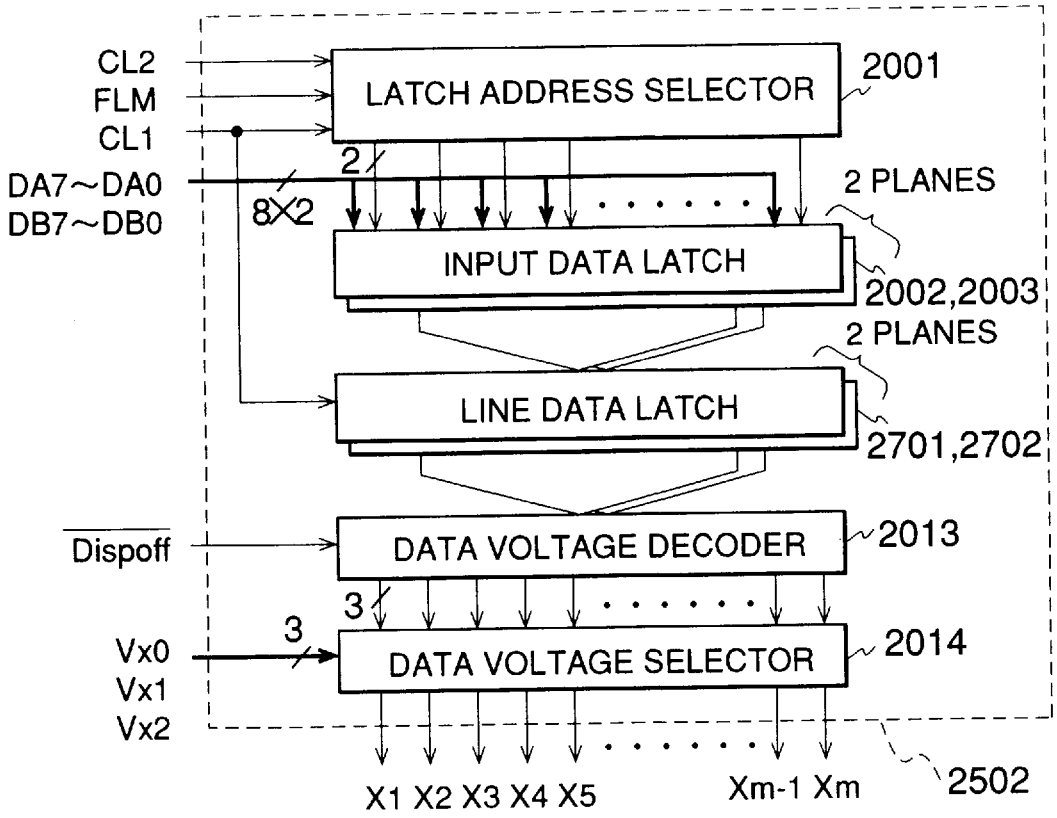
FIG. 27 is a block diagram showing the configuration of the data driver shown in FIG. 25.

The data driver 2502, as shown in FIG. 27, includes a latch address selector 2001, input data latch circuits 2002 and 2003, line data latch circuits 2701 and 2702, a data voltage decoder circuit 2013, and a data voltage selector 2014.

The data driver 2502 captures arithmetic data DA7 to DA0 and DB7 to DB0 output from the data arithmetic-logic circuit 2501 by means of a latch address selector 2001, input data latch circuits 2002 and 2003, and line data latch circuits 2701 and 2702, in response to a data latch clock signal CL2 and then transfers data for one line clock period to the data voltage decoder 2013 in synchronism with the line clock signal CL1. Thereafter, like the data driver 1303 in the first embodiment shown in FIG. 20, the data voltage selector 2014 selects and outputs one voltage level among 3 levels of the liquid crystal drive voltages.

Figure 28:
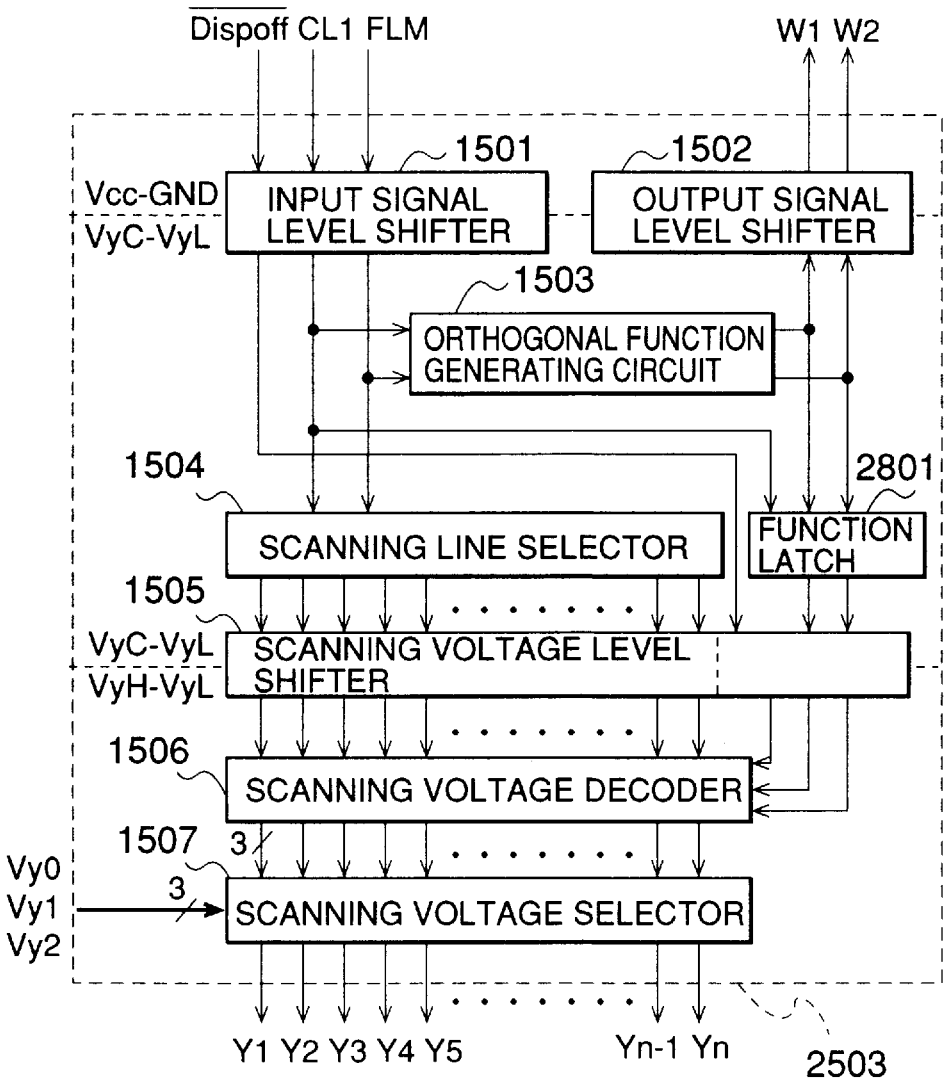
FIG. 28 is a block diagram showing the configuration of the scanning driver shown in FIG. 25.

The scanning driver 2503 has the same configuration the scanning driver 1302 in the first embodiment shown in FIG. 15, except that the latch circuit 2801 is added to adjust the timing of the orthogonal functions W1 and W2, as shown in FIG. 28.

Figure 29:
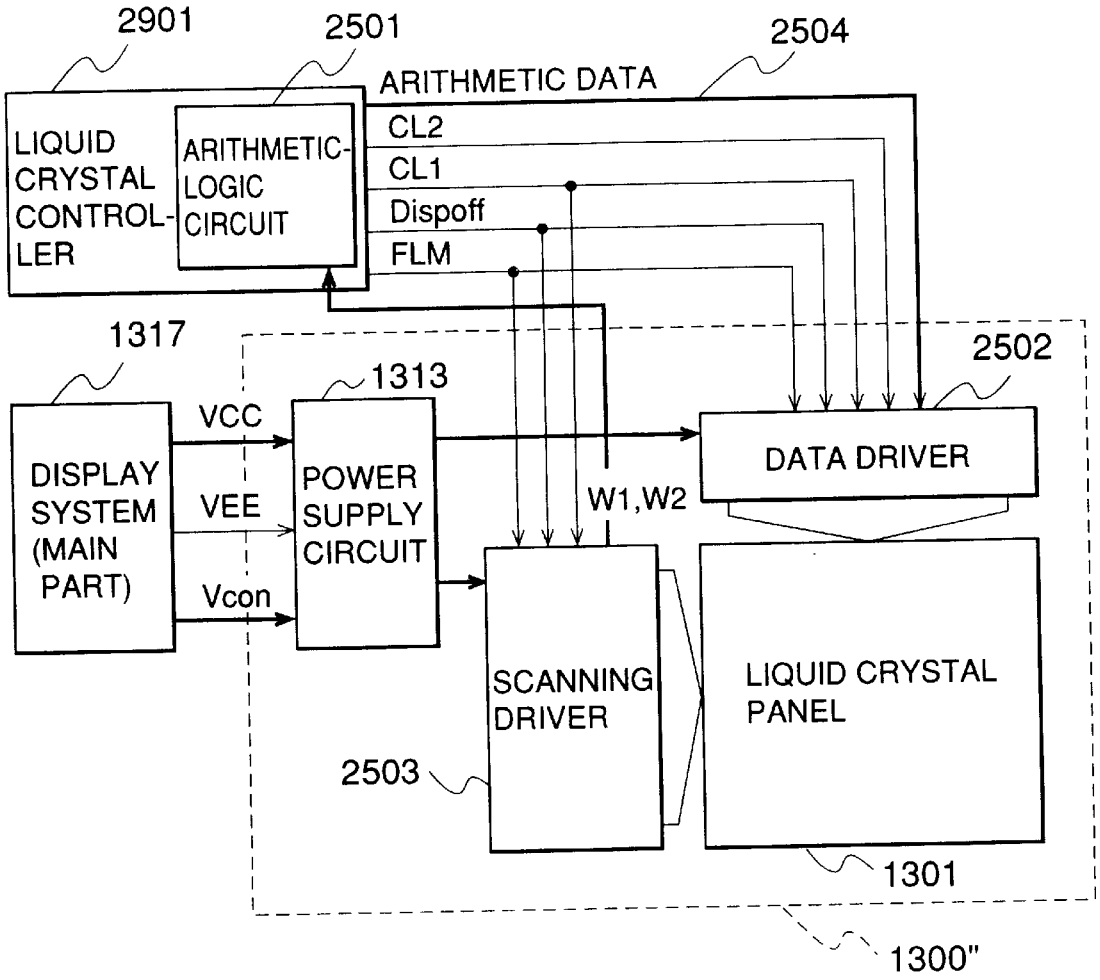
FIG. 29 is a block diagram showing another embodiment of a liquid crystal display device according to the present invention.

In the present embodiment the data arithmetic-logic circuit is disposed inside the liquid crystal display device. However, the present invention should not be limited only to the configuration of the present embodiment. For example, as shown in FIG. 29, the data arithmetic-logic circuit 2501 is disposed inside the liquid crystal controller 2901 and the data driver 2502 receives the arithmetic data 2504 output from the data arithmetic-logic circuit 2501.

In the present embodiment, the independent liquid crystal controller 2901 may be included inside the liquid crystal display device. Moreover, in the present embodiment, the orthogonal function generating device is disposed inside the scanning driver. Of course, the present invention should not be limited only to the configuration. For example, the orthogonal function generating device may be disposed inside the liquid crystal display device, independent from the scanning driver.

In the second and third embodiments, like the first embodiment, the frequency of a change in the data electrode applied waveform is decreased. As a result, the frequency of a shift in the effective value of the liquid crystal applied voltage also decreases. For that reason, the display unevenness which occurs in vertical direction can be reduced. Furthermore, since the scanning electrode applied waveform changes on all the scanning electrodes only the same number of times for one frame period, the amount of dullness in the waveforms due to the change in the scanning electrode applied waveform are equalized among lines, and the display variation which occurs in horizontal direction can be reduced.

Compared with the driving method in the prior art, the above-mentioned driving method can reduce the frequency of a change in the data electrode applied waveform in the vertical line display where display-on data or display-off data are continued. Since the occurrence of shifting in the effective value of the liquid crystal applied voltage due to the change in the data voltage waveform is decreased, the display unevenness can be reduced in the vertical direction. Moreover, since the scanning electrode applied waveform changes on all scanning electrodes only the same number of times for one frame period, the amount of dullness in the waveforms due to the change in the scanning electrode applied waveform are equalized among lines, and the display variation which occurs in horizontal direction can be reduced.

Next, another embodiment of the liquid crystal driving method and liquid crystal displaying device embodying the present invention will be explained as the fourth embodiment. The present embodiment relates to a method and device, which are preferable to removing the display unevenness appeared in horizontal noise streaks when the liquid crystal panel is in an on display state on the whole screen.

Figure 30:
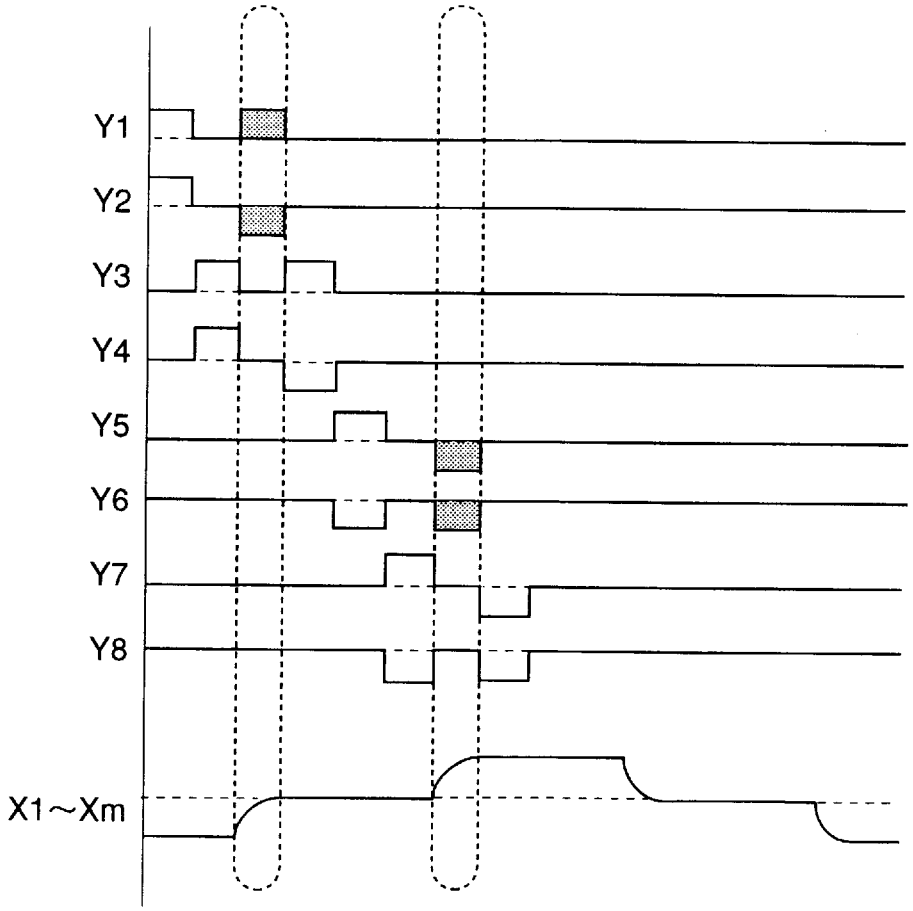
FIG. 30 is a timechart showing an example of a liquid crystal applied voltage according to the fourth embodiment.

Explanation will be given of the liquid crystal driving method in the present embodiment. For example, when the interval between two selection voltages is 1t in the 2-line selection driving method according to the present invention, the scanning waveform and data waveform during the display-on state in the whole screen are shown in FIG. 30. In data waveforms X1 to Xm, a dullness of the waveform occurs at actual voltage change points, that are indicated in areas surrounded with the dotted oval in the figure.

The effective value of the liquid crystal voltage increases or decreases because of an influence of dulled waveform on the scanning electrode group (line) on which the selection voltage is applied at the point where the dullness of data waveform occurred. On the other hand, a voltage effective value becomes close to an ideal value predicted theoretically on the line on which the selection voltage is applied at a point where a dullness of data waveform does not occur, i.e. where there is no voltage change.

That is, as shown in FIG. 30, the scanning electrodes, to which the selection voltage is applied at a point where the dullness of data waveform is occurred, are the scanning electrodes Y1 and Y2 (affecting the second selection voltage), Y5 and Y6 (affecting the second selection voltage), . . . . On the other hand, the scanning electrodes, to which the selection voltage is applied at a point where a data waveform does not change are the scanning electrodes Y3 and Y4, Y7 and Y8. Furthermore, since the timing of occurring a dulled data waveform is at the same point for every frame, the dulled data waveform always affects to the same scanning electrode.

For that reason, the voltage effective value applied to the Y1 and Y2 electrode line and that of the Y3 and Y4 electrode line become different to each other in small amount, and a display variation in the form of horizontal noise streaks occurs.

In the above-described example, the whole screen has been in the display-on state, for example, in white. In an actual liquid crystal display screen, a white or black, or the same color with large area causes the display unevenness with the form of horizontal noise streaks.

In the present embodiment, the method and device each which produce a drive waveform to cancel the horizontal noise streaks.

In order to cancel the display unevenness of the noise streak, one block is formed of plural scanning electrodes, like the first embodiment for example, and the order in which a selection voltage is applied to each scanning electrode group within the block is switched for every block. More specifically, for example, the order of the selection voltage shown in FIG. 30 is changed to the order shown in FIG. 31.

According to such a change in the order, the scanning electrodes, to which the selection voltage is applied at the point where the data waveform is dulled, are the scanning electrodes Y3 and Y4 (affecting the second selection voltage) and Y7 and Y8 (affecting the second selection voltage). On the other hand, the scanning electrodes at the point where the data waveform does not changed are the scanning electrodes Y1 and Y2, Y5 and Y6, . . . . That is, referring to FIG. 31, the line which is affected by the dulled data waveform is replaced with the line shown in FIG. 30.

Figure 31:
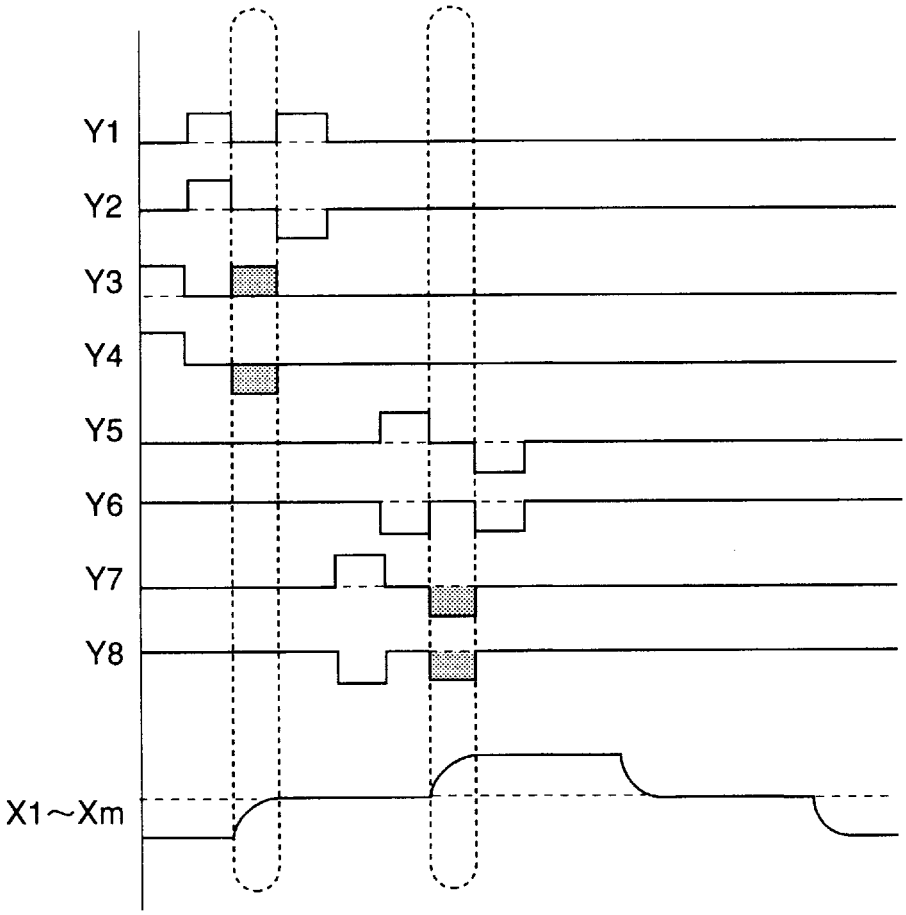
FIG. 31 is a timechart showing an example of a liquid crystal applied voltage according to the fourth embodiment.

Hence, the voltage effective value applied to the electrodes Y1 and Y2 and that of the electrodes Y3 and Y4 can be equalized for two or more sets of frame period by switching the selection voltage waveform every frame as shown in FIGS. 30 and 31.

Figure 32:
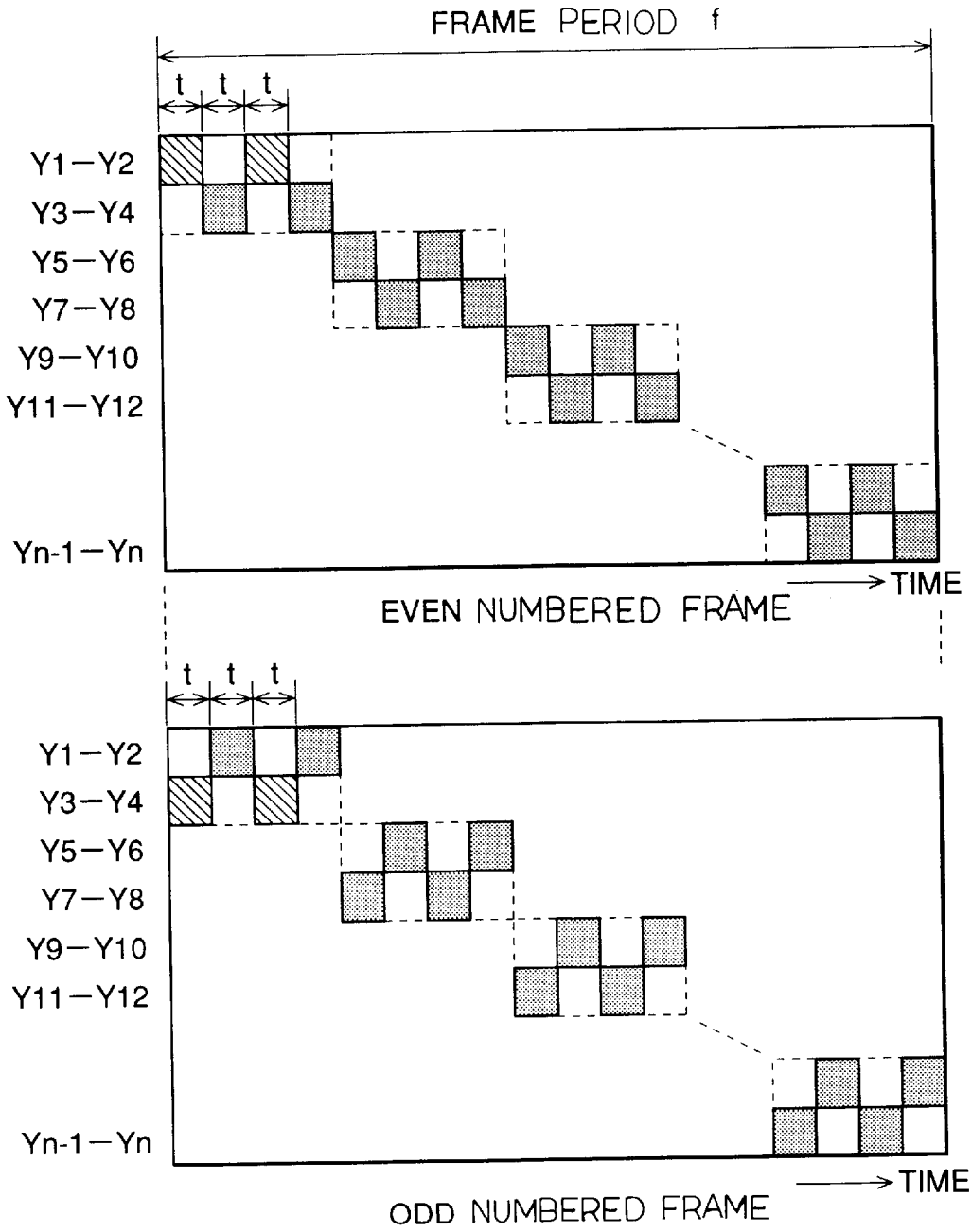
FIG. 32 is a timechart showing an example of a scanning selection period in a liquid crystal driving method according to the fourth embodiment.

In the liquid crystal driving method according to the present embodiment based on the above-mentioned concept, the selection order of the scanning electrode groups is switched in an even frame and odd frame in each block period (shown with dotted lines in the figure), as shown in the timing chart in FIG. 32. The liquid crystal driving method according to the present embodiment is similar to the liquid crystal driving method in the first embodiment, except that the selection order is switched every block.

Figure 33:
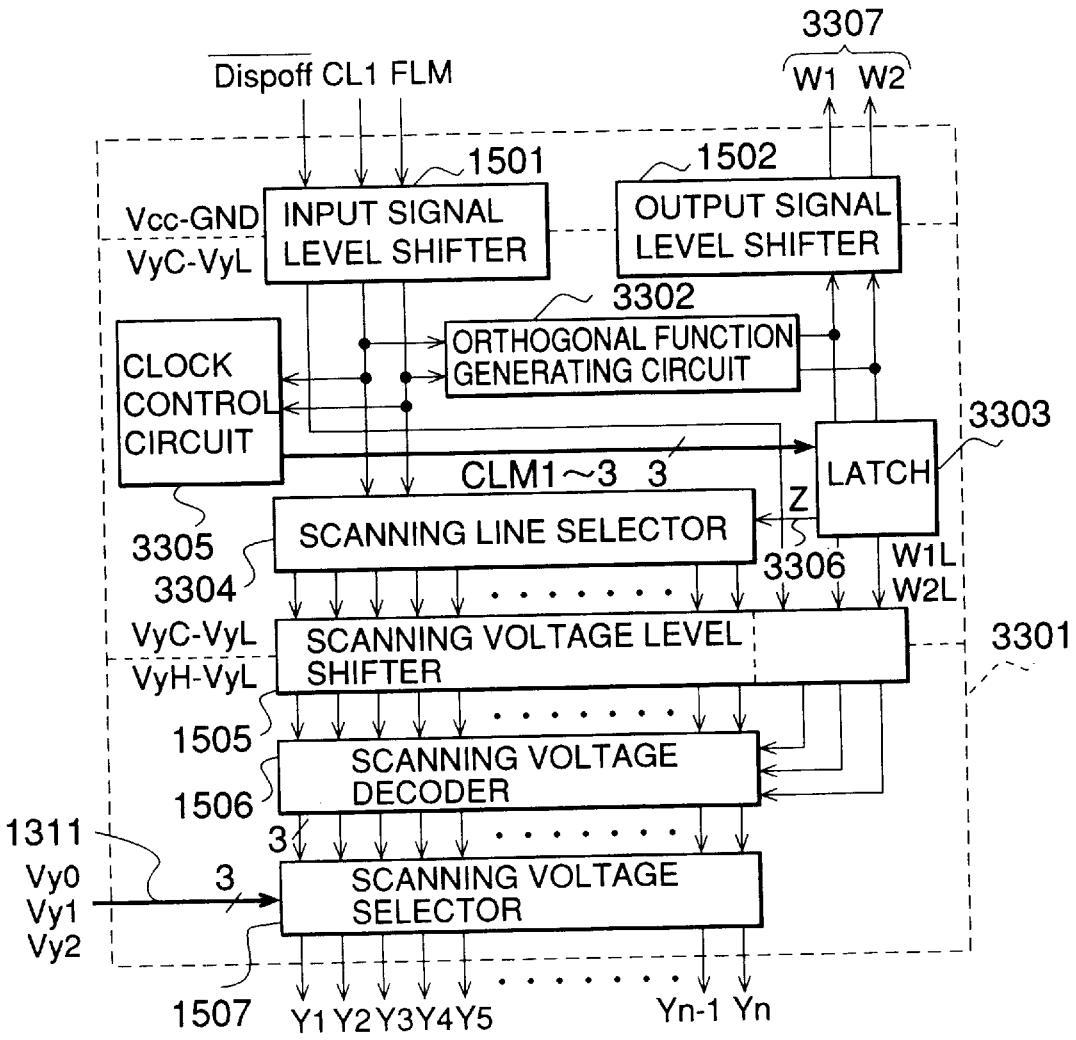
FIG. 33 is a block diagram showing the configuration of the scanning driver in a liquid crystal display device according to the fourth embodiment.
Figure 34:
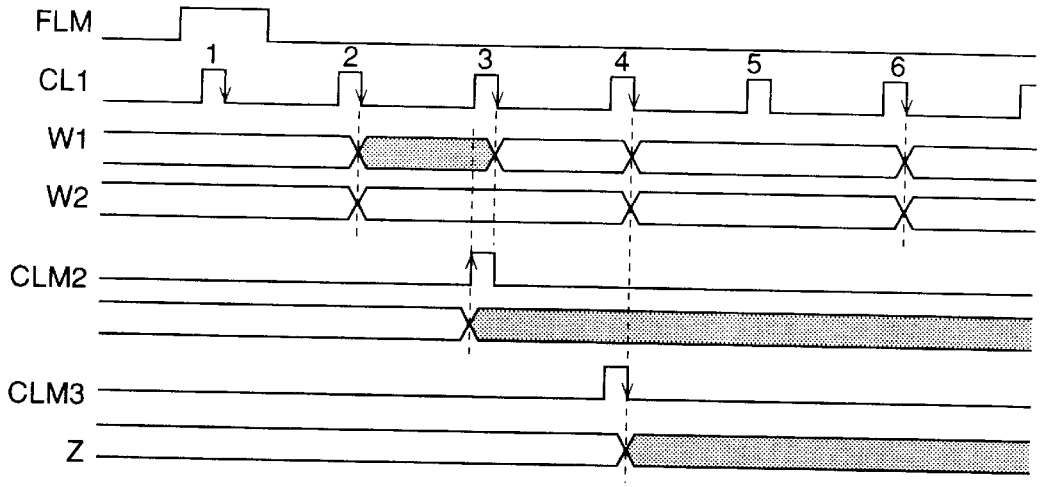
FIG. 34 is a timechart used for explaining the operation of a latch circuit in the scanning driver shown in FIG. 33.
Figure 35:
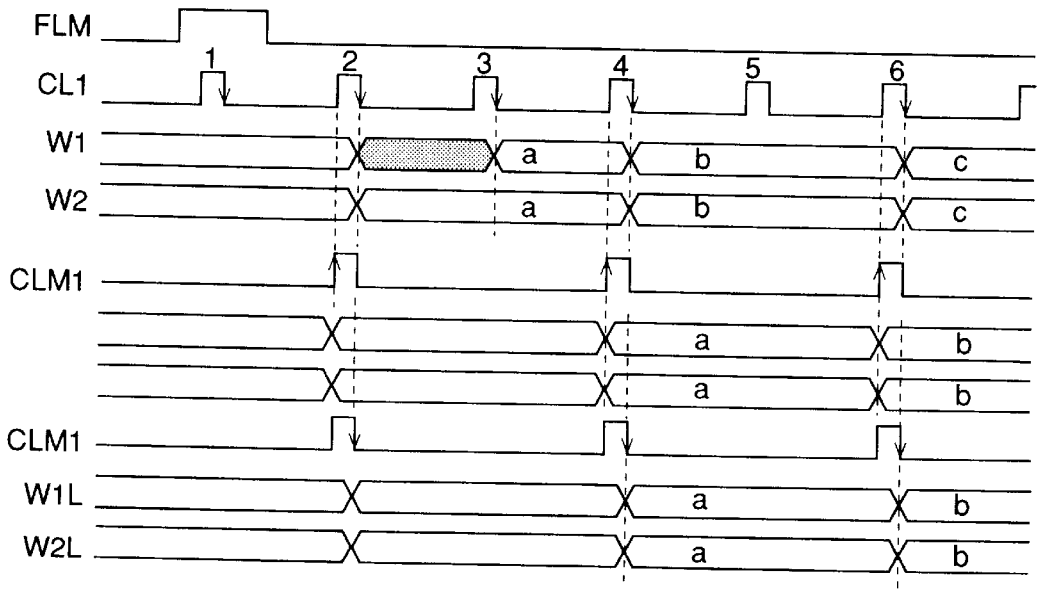
FIG. 35 is a timechart used for explaining the operation of a latch circuit in the scanning driver shown in FIG. 33.
Figure 36:
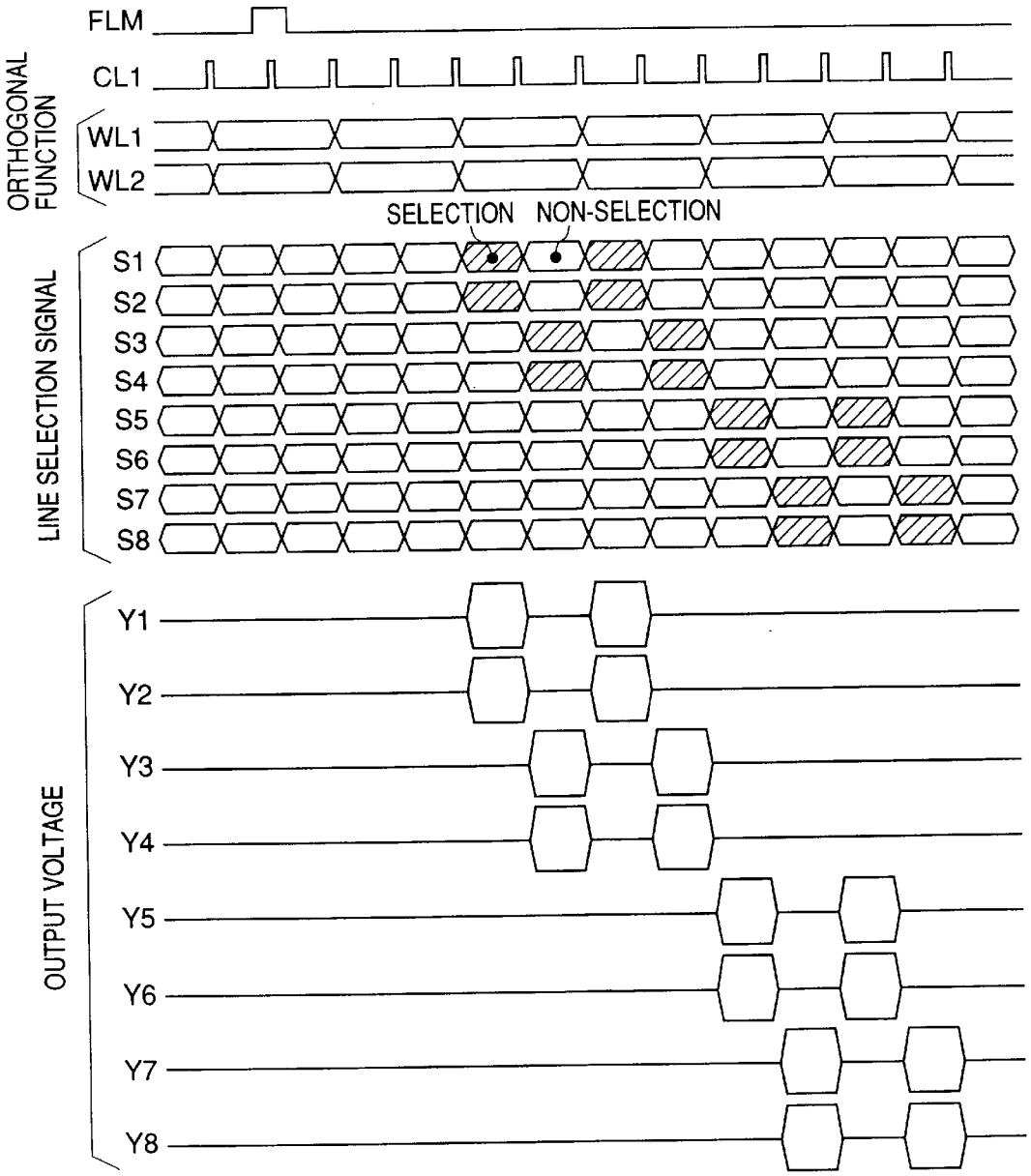
FIG. 36 is a timechart used for explaining the operation of the scanning driver shown in FIG. 33.
Figure 37:
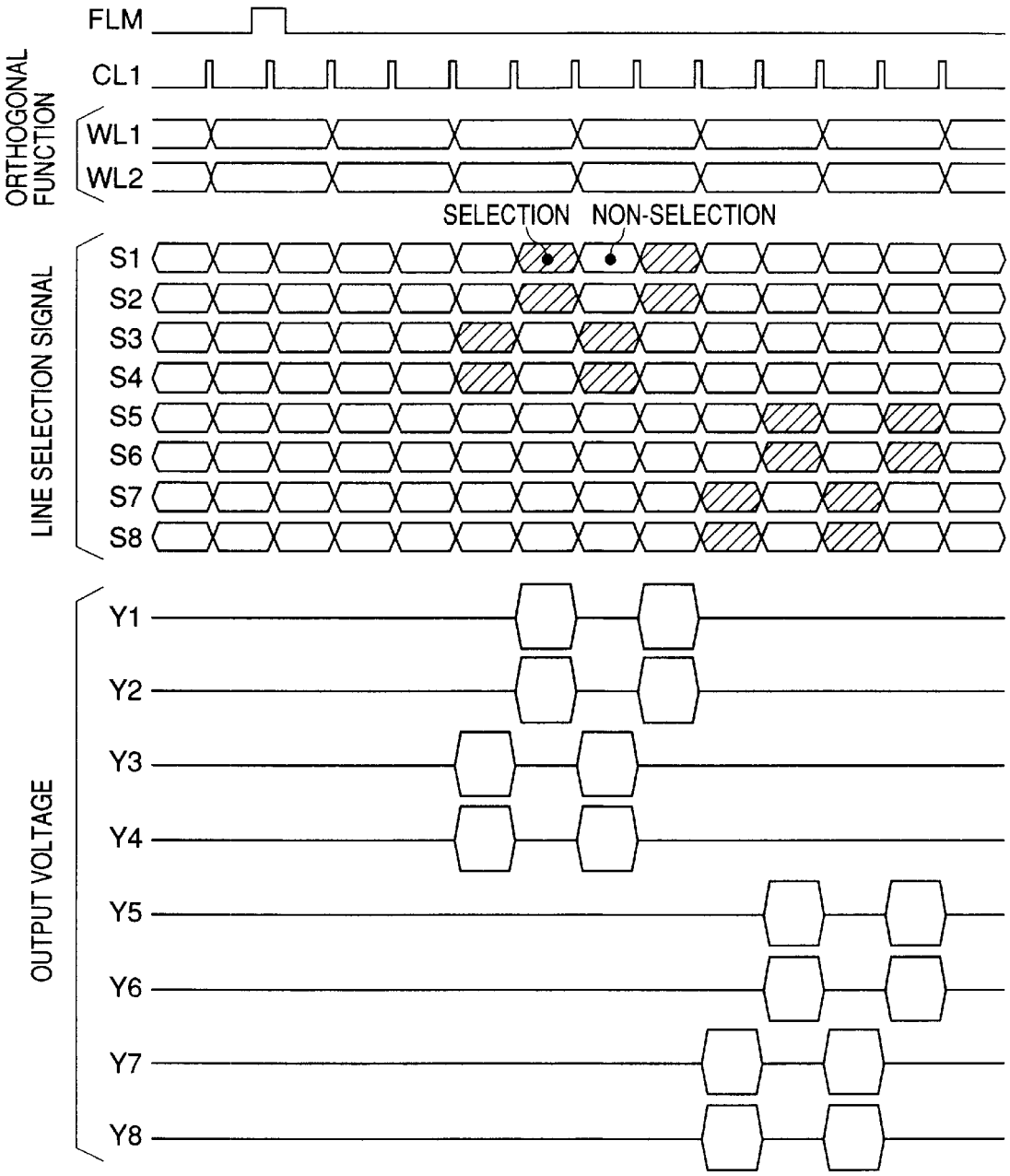
FIG. 37 a timechart used for explaining the operation of the scanning driver shown in FIG. 33.
Figure 38:
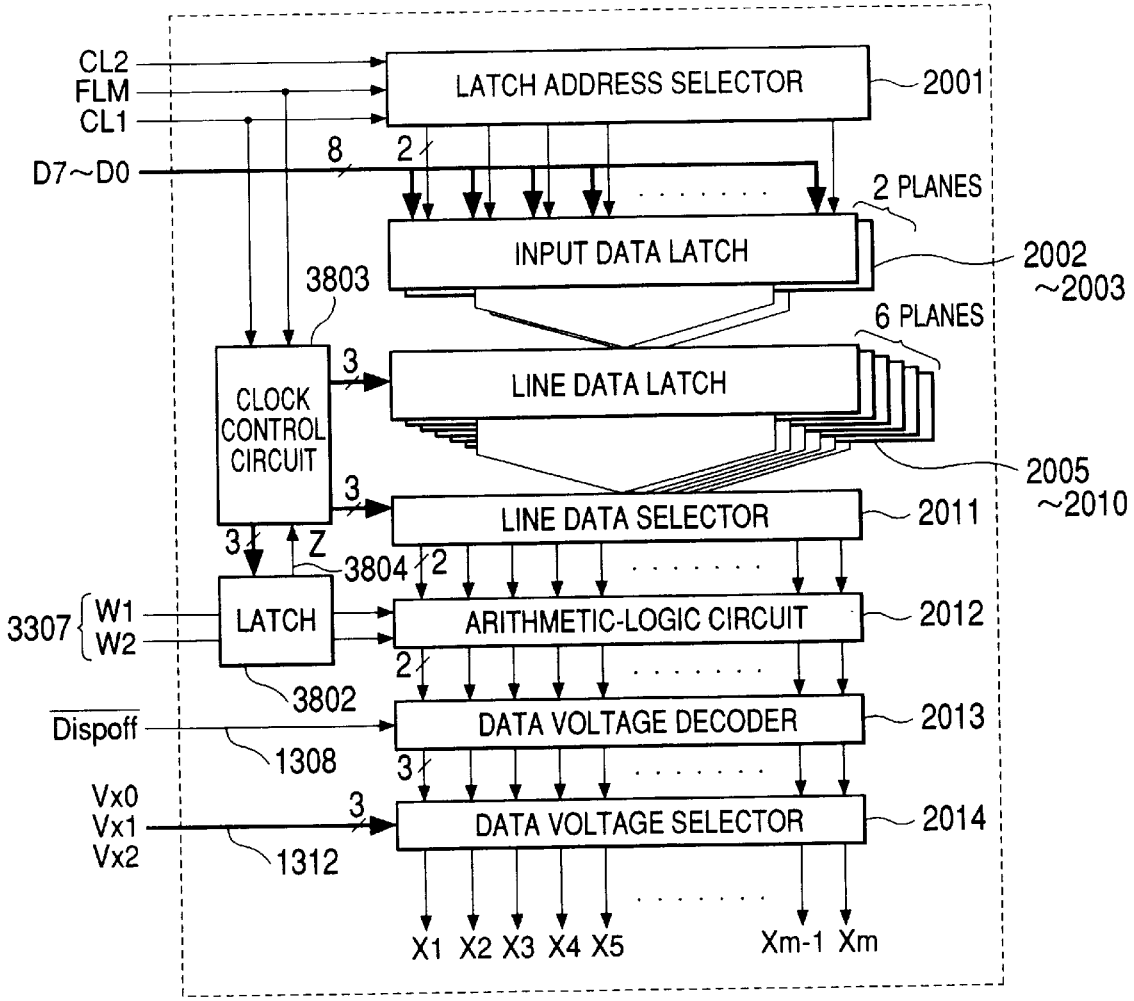
FIG. 38 is a block diagram showing the configuration of a data driver in a liquid crystal driving method according to the fourth embodiment.
Figure 39:
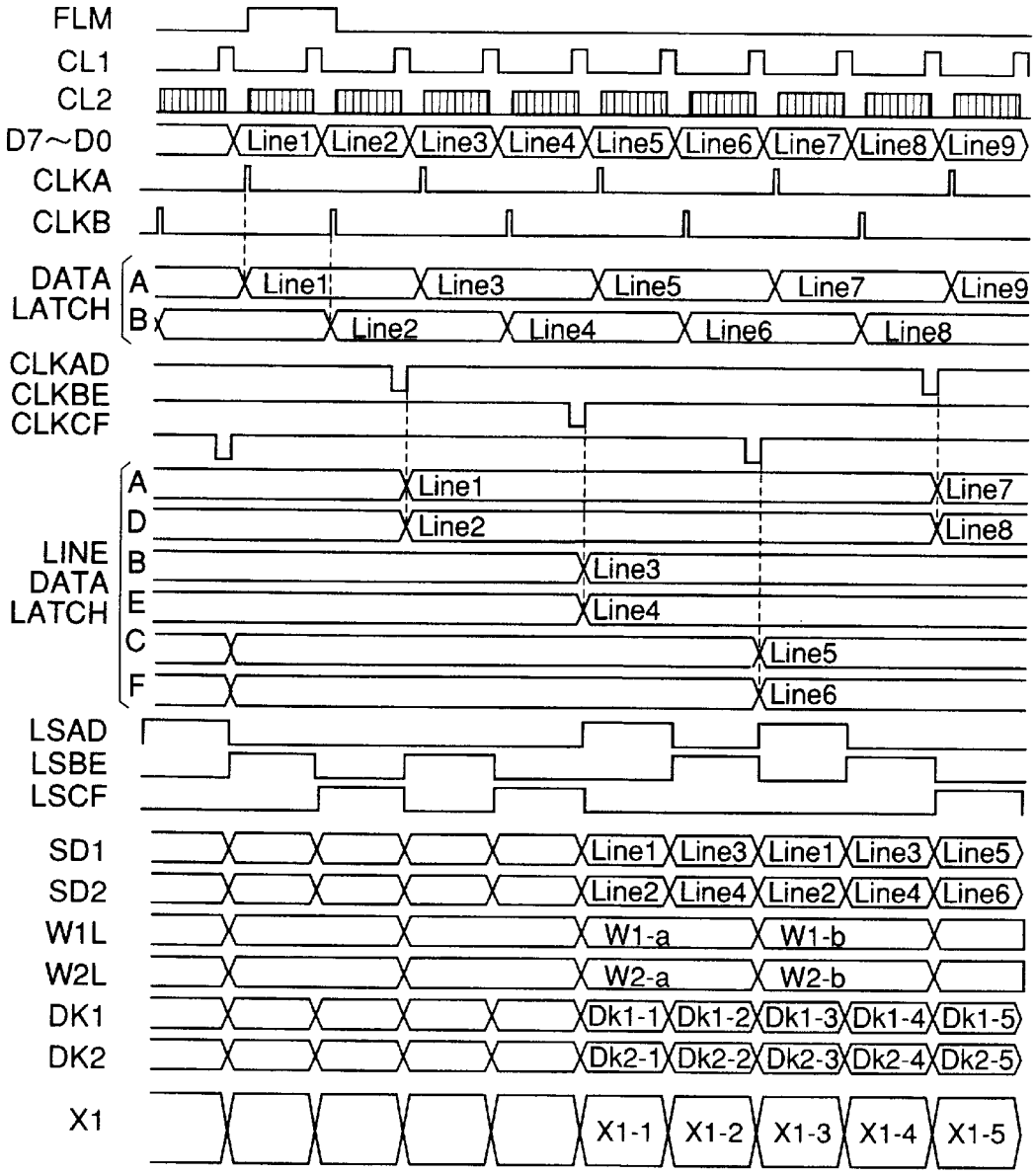
FIG. 39 is a timechart used for explaining the operation of the data driver shown in FIG. 38.
Figure 40:
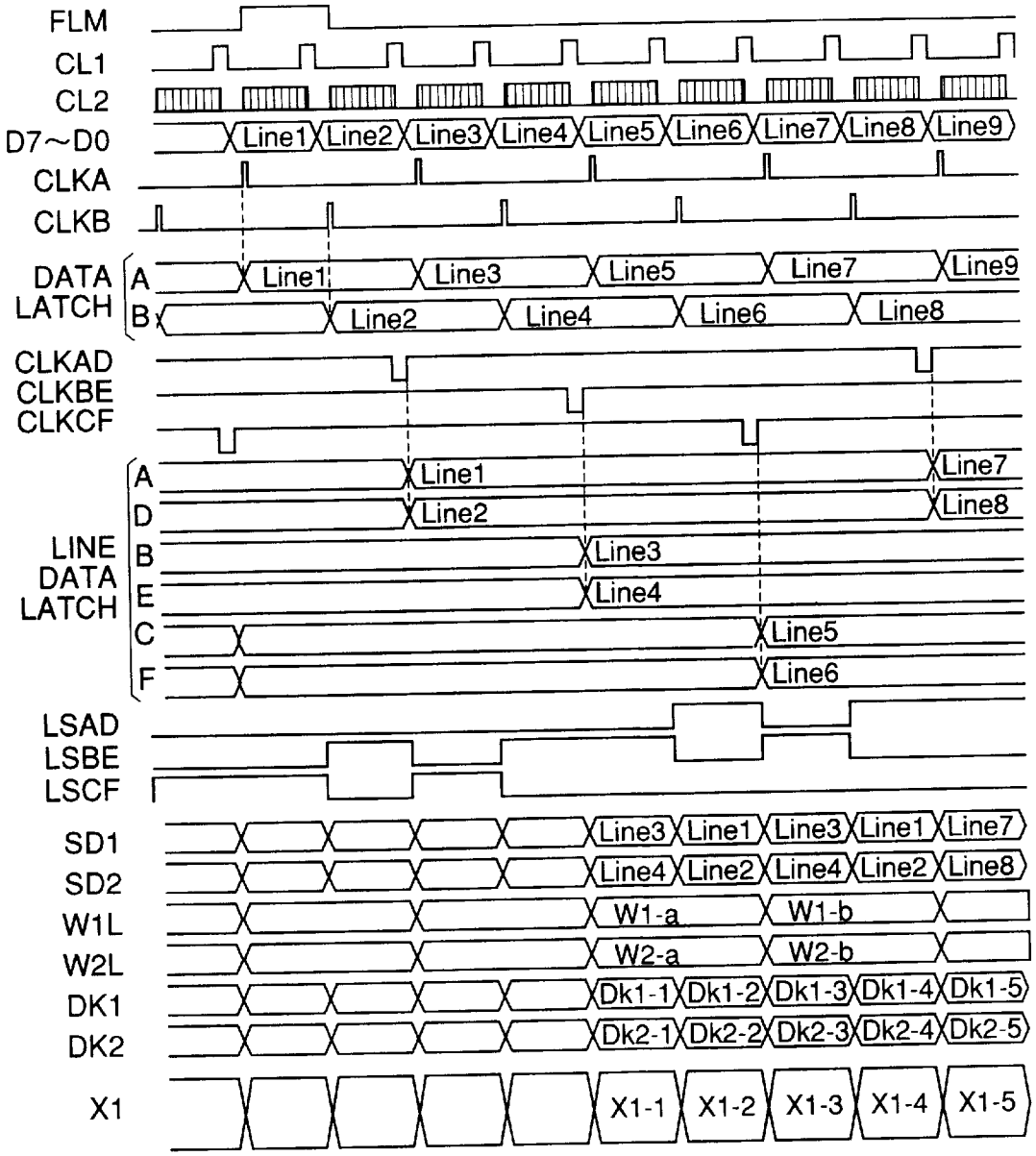
FIG. 40 is a timechart used for explaining the operation of the data driver shown in FIG. 38.

Next, an example of the configuration of the liquid crystal display device realizing the liquid crystal driving method according to the present embodiment will be explained by referring to FIGS. 33 to 40. FIG. 33 is a block diagram illustrating the configuration of the scanning driver 3301 according to the present embodiment. FIGS. 34 and 35 are timing charts each used for explaining the operation of the latch circuit in the scanning driver 3301. FIGS. 36 and 37 are timing charts each used for explaining the operation of the scanning driver 3301. FIG. 38 is a block diagram illustrating the configuration of the data driver 3301 related to the present embodiment. FIGS. 39 and 40 are timing charts each used for explaining the operation of the data driver 3801.

The liquid crystal display device according to the present embodiment basically has a configuration similar to that in the first embodiment (refer to FIG. 13), except for the configuration of each of the scanning driver and the data driver.

The scanning driver 3301 according to the present embodiment, as shown in FIG. 33, includes an orthogonal function generating circuit 3302, a latch circuit 3303, a scanning line selector 3304, and a clock control circuit 3305. Other constituent elements included in the scanning driver 3301 are the same as those in the first embodiment. The same numerals are attached to the same configuration elements as in the scanning driver 1302, redundant explanations are omitted.

As shown in the timing chart in FIG. 34, when a CL1 signal which is at a "high" level period during a "high" level of the FLM signal, is set as the first in the CL1 signal, the orthogonal function generating circuit 3302 inserts a selection line switching signal into the orthogonal function W1 signal, for example, in a time-sharing format, within the interval between the first and third CL1 signals, as shown with the meshed portion in the figure. The selection line switching signal is a signal acting as a reference for switching a selection voltage waveform, shown in FIGS. 30 and 31. In this embodiment, the "high" level period and the "low" level period are switched every one frame.

The latch circuit 3303 sequentially latches the above-mentioned signal at the rise of the CLM2 signal which becomes a "high" level with the same timing as the third CL1 signal once per frame, and at the fall of the CLM3 signal which becomes "high" level with the same timing as the fourth CL1 signal once per frame, and then sends it to the scanning line selector 3304 as Z signal 3306.

The scanning line selector 3304 operates in the same way as the scanning line selector 1504 in the scanning driver 1302 in the first embodiment, and further switches the order of the "selection state" of the line selection signals S1 to Sn depending a state of the Z signal 3306 which may be in a "low" level state or a "high" level state.

On the other hand, as shown in the timing chart of FIG. 35, the orthogonal functions W1 and W2 are sequentially latched at the rising and falling of the CLM1 signal which becomes a "high" level with the same timing as the even numbered CL1 signal, and then are sent to the scanning voltage level shifter 1505 respectively as a W1L signal and W2 L signal.

In summary of the above-mentioned operations, when the Z signal 3306 is at a "low" level, the selection voltage of each scanning electrode is output at the timing shown in FIG. 36. When the Z signal 3306 is at a "high" level, the selection voltage of each scanning electrode is output at the timing shown in FIG. 37. The clock control circuit 3305 produces the CLM1 signal, the CLM2 signal and the CLM3 signal.

Next, the data driver 3801 in the present embodiment will be explained with reference to FIGS. 38 to 40. The data driver 3801 in the present embodiment has a function to switch the selection order in the line data selector with the line selection order switching operation of the scanning driver 3301 mentioned in the above.

The data driver 3801 of the present embodiment, as shown in FIG. 38, includes a latch circuit 3802 and a clock control circuit 3803. Another configuration elements included in the data driver 3801 are the same as that of the data driver 1303 in the first embodiment. The same numerals are assigned to the same constituent elements as in the first embodiment, redundant explanations are omitted.

The latch circuit 3802 operates similarly to the latch circuit 3303 in the scanning driver 3301 according to the first embodiment. For example, the latch circuit 3802 receives orthogonal function signals W1 and W2 from the scanning driver 3301; generates Z signal 3804 and W1L, W2 L signals at the timing shown in FIGS. 34 and 35; and then transfers the Z signal to the clock control circuits 3803 and the W1L and W2 L signals to the arithmetic-logic circuit 2012.

Like the clock control circuit 3305 in the scanning driver 3301, the clock control circuit 3803 creates the CLM1 signal, the CLM2 signal, and the CLM3 signal, and receives the Z signal 3804. When the Z signal 3804 is at a "low" level and at a "high" level, the "high" level period of each of the LSAD signal, LSBE signal, and LSCF signal, each being the select signal of the line data selector, is switched.

More specifically, when the Z signal 3804 is at a "low" level, the "high" level periods of the LSAD signal, LSBE signal, and LSCF signal are provided at the timing shown in FIG. 39. When the Z signal 3804 is at a "high" level, the "high" level periods of the LSAD signal, LSBE signal, and LSCF signal are provided at the timing shown in FIG. 40.

In the above-mentioned configuration, even if the order of the selection voltage application to the scanning electrode by the scanning driver is switched every frame, the display can be properly made because the output of the data driver is changed corresponding to the switching operation.

As described above, according to the liquid crystal driving method and liquid crystal device according to the present embodiment, the horizontal noise streaks which appear on the liquid crystal display screen, for example, when the whole screen is in the display-on state, can be prevented.

The present embodiment corresponds to the example where the interval between two selection voltages is 1t and the 2-line selection driving method is employed. However, the method according to the present embodiment is applicable to another case. For example, with the interval between two selection voltages being 2t, the order of the selection voltage applied periods in a block including 6 scanning electrodes may be sequentially switched every three frames. With the interval of 3t or more, the order of the selection voltage may be switched every several frames. However, compared with the data driver in the first embodiment, when the intervals between two selection voltages are the same in both embodiments, the interval should not be widened because the number of planes for the line data latch increases in the present embodiment.

In the present embodiment, the horizontal noise streaks which appear on the liquid crystal display screen are prevented by switching the order in the application of the selection voltage. However, the present invention should not be limited only to the above-mentioned method. In other words, all it is necessary to do is to avoid the dulled waveforms affecting only to the same scanning electrodes. For example, the method may be employed which shifts a data waveform change timing every frame by adjusting combination of the orthogonal functions or the duty ratio of the each frame.

The present embodiment employs a method of time-sharing to insert the signal, which defines the order of the selection voltage, into the orthogonal function W1 produced in the scanning driver. However, the present invention should not be limited only to the present embodiment. In short, the configuration may be used, in which the line that the selection voltage is applied by means of the scanning driver is correspond appropriately to the display data line selected by means of the data driver.

In the embodiment of the present invention as described above, suitable combinations of the orthogonal function have been shown for reducing the display unevenness. In the liquid crystal driving method according to the present invention, both the voltage level of the scanning selection voltage and of the data voltage are decided based on the orthogonal function value. For that reason, image quality items other than the display unevenness depends also greatly on the orthogonal function. Hence, in order to realize the driving system according to the present invention, an important point is to set the orthogonal function with which the best comprehensive display quality is provided. The following section discuss an embodiment which relates to the orthogonal function setting method preferable to the liquid crystal driving method according to the present invention.

It is well-known that the after-image like the burning, or any other phenomena relating to image degradation, occurs when the liquid crystal applied voltage has a residual dc component, and thus the service life of the liquid crystal cell is significantly decreased. In order to prevent this problem, a polarity reversing operation (AC operation) is needed for reversing the polarity of the voltage applied to the liquid crystal for a certain period of time. This AC operation must be carried out during both in the applied voltages for the selection period and the non-selection period. As to the polarity reversing period, it is desirable to reverse the voltage for the selection period every one frame, and for the non-selection period at least once within one frame. When the polarity reversing period is more than the above-mentioned value, for example, the voltage in the non-selection period is in the same polarity over the whole one frame, the so-called flicker effect appears, and thus causes degradation in the image quality.

The liquid crystal driving method employing a polarity reversing method for a liquid crystal applied voltage will be explained as the fifth embodiment according to the present invention in which the flicker, which occurs in the case where the same kind of data are displayed on the whole screen (here, referred to as the on-display in the whole screen) and which is liable to produce the above-mentioned flicker, can be reduced or prevented.

In the present embodiment, the orthogonal function is set so as to (1) reverse the polarity of the selection voltage every one frame, and (2) reverse the voltage applied to each dot in the non-selection period at least once within one frame period, so that the numbers of positive (+) and negative (−) polarities of the data voltage with respect to the non-selection voltage within a frame period are nearly equalized.

First, the method of reversing the polarity of the selection voltage every one frame, as described as the item (1) in the above, will be explained.

As described in the first embodiment, in the selection voltage's polarity condition in the combination, it is assumed that the positive polarity of the selection voltage with respect to the non-selection voltage is represented as +1 and the negative polarity is represented as −1, and an odd numbered scanning electrode is represented as YA and an even numbered scanning electrode is represented as YB. In this case, there are four combinations ([0] to [3] in FIG. 10).

Next, let consider conditions where combinations of [1] to [3] are in the orthogonal state. There are eight combinations among the first selection voltage and the second selection voltage, as follows:

$$[\text{First, Second}] = ([0],[1]),([0],[2]),([1],[3]),([2],[3]),([1],[0]),([2],[0]),([3],[1]),([3],[3])$$

Here, of the eight combinations, combinations of the case where the polarity of the selection voltage is reversed are as follows:

([0],[1]) and ([3],[2]),
([1],[3]) and ([2],[0]),
([1],[0]) and ([2],[3]),
([3],[1]) and ([0],[2])

Hence, in order to reverse the polarity of the selection voltage every one frame, it is desirable to set the orthogonal function so as to the above-mentioned combination with the reversed polarities are affined in two consecutive frame periods.

Figure 41:
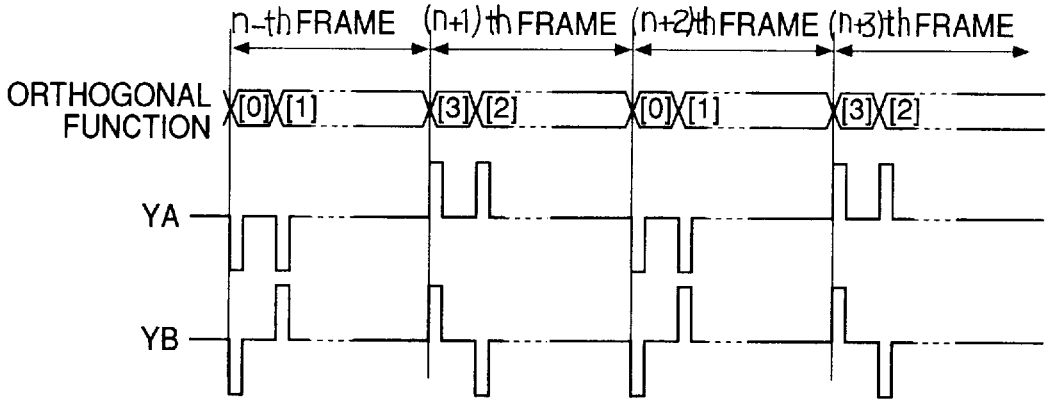
FIG. 41 is a timechart showing an example of the waveform of a liquid crystal applied voltage at which image degradation appears.

According to the above-mentioned concept, the dc component related to the selection voltage is cleared because the same number of the selection voltages with positive and negative polarity are applied in two periods of the frame period. However, as shown in FIG. 41, when the combination of, for example ([0],[1]) and ([3],[2]) are always provided to two scanning electrodes (YA and YB) selected simultaneously, the selection voltage on the YA electrode always has the same polarity twice in one frame while the selection voltage on the YB electrode always has the opposite polarity. In this case, since the frequency characteristics of the selection voltages applied to the electrodes YA and YB are different, the liquid crystal transmittance related to each of the YA and YB lines changes, and may cause a possible horizontal noise streaks.

In order to prevent such noise streaks, the frequency characteristics of the selection voltages applied to two scanning electrodes are equalized by combining four frames as follows:

([0],[1]), ([3],[2]), ([1],[3]) and ([2],[0]), or
([1],[0]), ([2],[3]), ([3],[1]) and ([0],[2])

Figure 42:
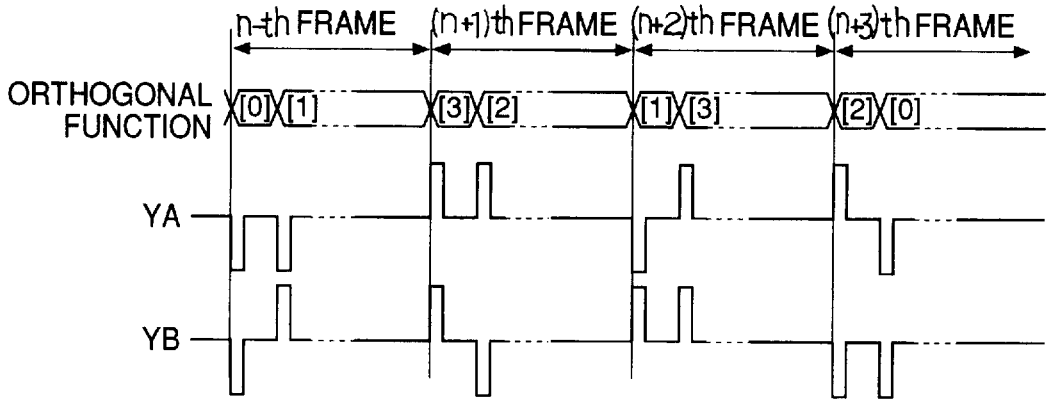
FIG. 42 is a timechart showing the waveform of a liquid crystal applied voltage related to the fifth embodiment.

The selection voltage waveforms in this case are shown in FIG. 42.

Next, the method, of setting an orthogonal function to nearly equalize the numbers of positive and negative polarity of the data voltage with respect to the non-selection voltage within one frame period as described in the above-mentioned item (2), will be explained.

As described in the first embodiment as the basic concept of the present invention, the orthogonal function in the scanning electrode block corresponds to only one kind of the combination among 8 kinds of combinations explained in the above. The orthogonal function which may be set in the next block is specified in the combinations shown in FIG. 11. In order to satisfy the polarity reversing condition while satisfying the basic rule the scanning electrode block is combined with the next block so as to achieve the polarity reversing in the data electrode applied voltage. An example of this combination is shown in FIG. 43.

According to this concept, when the same data are displayed on the whole screen, the same number or nearly the same number of the voltages with positive and negative polarity are applied to the data electrode in one frame period, and the dc component due to the non-selection voltage does not remain.

The case where the number of both polarities disagreed, one frame period is to be consisted of the display interval for which the display process is performed and the retrace line interval for which a vertical synchronous process and the like are performed. In this case, the difference between the numbers of positive and negative polarity in the data voltages output during the retrace line interval corresponds to the above-mentioned discrepancy between the numbers of positive and negative polarity of the data voltage with respect to the non-selection voltage within the one frame period.

Strictly speaking, a retrace line interval for the horizontal synchronization is also included in the display interval. However, the selection voltage is usually applied even during the horizontal period. For that reason, it may be possible to regard the horizontal retrace line interval to be included as a part of period to scan the scanning electrodes.

Figure 45:
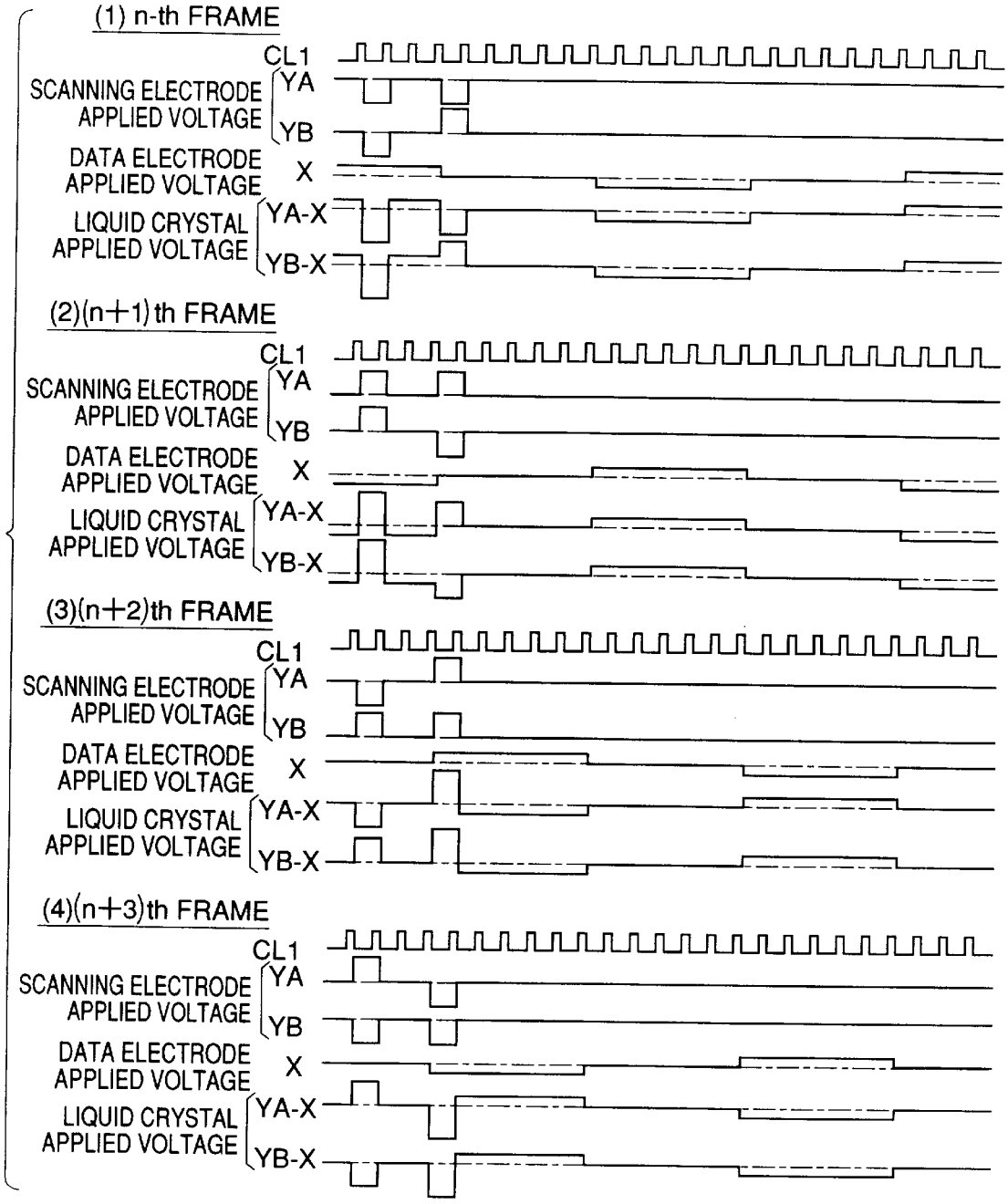
FIG. 45 is a timechart showing waveforms of a liquid crystal applied voltage in each of n-th to (n+3)th frames related to the fifth embodiment.

FIG. 44 shows an example of set values of the orthogonal function described above. Referring to FIG. 44, the orthogonal function is set as one unit formed of the four frame periods and 24 horizontal periods. FIG. 45 shows the waveform of the liquid crystal applied voltage when the same data are displayed on the whole screen using the set values shown in FIG. 44.

That is, as shown in FIG. 45, since the same number of the positive and negative polarity of the selection voltages are applied in 2 frame periods and nearly equal number of the positive and negative polarity of the nonselection voltage are applied in one frame period, the polarity reversing operation can be ideally realized.

Moreover, since the selection voltage applied to any scanning electrodes exhibits the same frequency characteristics in a four frame period, the horizontal noise streak phenomenon does not occur due to the difference of the frequency characteristics.

In order to realize the orthogonal function shown in FIG. 44 using the liquid crystal display device according to the present invention, the W1 signal 1508 and W2 signal 1509, for example, are produced based on the count value of the leading line clock FLM signal 1307 and the count value of the line clock CL1 signal 1306, as it's done in the orthogonal function generating circuit 1503 of the first embodiment.

Next, other image degradation phenomena regarding the liquid crystal driving method according to the present invention, and the sixth embodiment using the orthogonal function suitable for reducing or preventing the image degradation phenomena will be explained.

Figure 46:
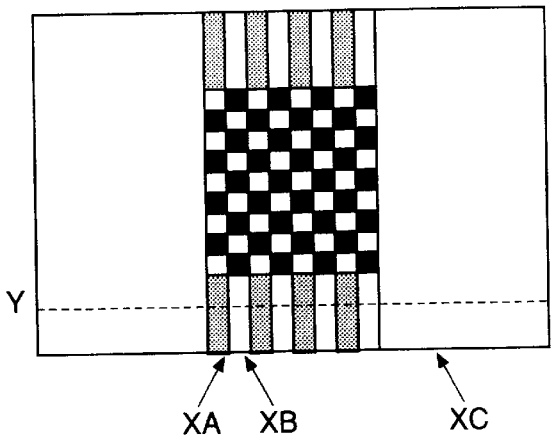
FIG. 46 is an explanatory diagram showing an example of a display pattern when a display unevenness occurs.

When a checker-board pattern is displayed with every one dot using the driving method where the orthogonal function (FIG. 44) in the fifth embodiment is used, a display unevenness may be seen above and below of the pattern, as shown in FIG. 46, so that a bright image in each column varies to each other and results in somewhat like vertical line pattern. The present embodiment employs the orthogonal function which can prevent this phenomena.

Figure 47:
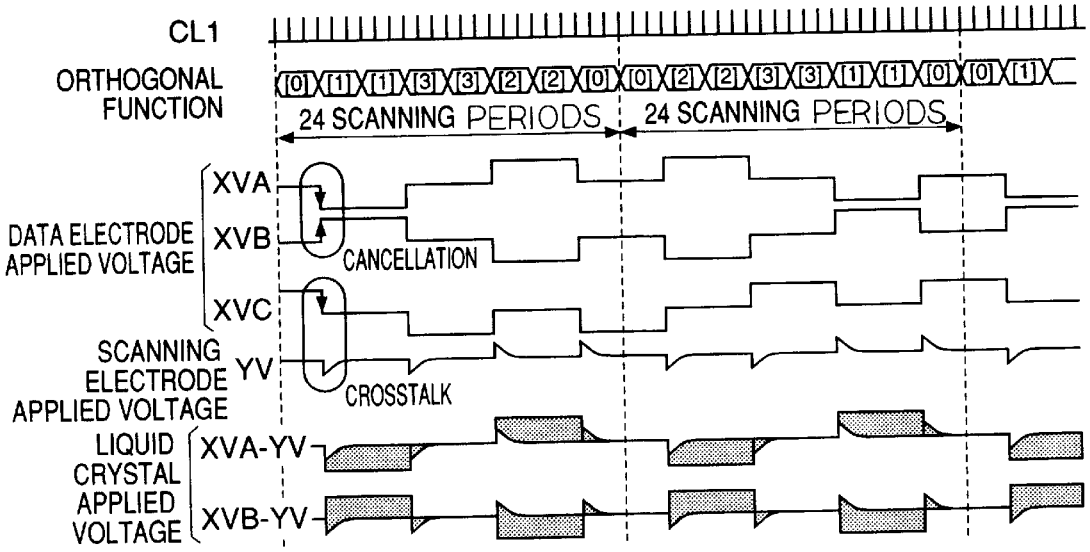
FIG. 47 is a timechart showing the waveform of a liquid crystal applied voltage when the pattern shown in FIG. 46 is displayed.

First, the reason why a checker-board pattern causes the display unevenness in the vertical line pattern in the upper and the lower display portion of the pattern will be explained by referring to FIG. 47. FIG. 47 shows the waveforms of voltages applied to each electrode when the checker-board pattern is displayed. XVA and XVB are the data electrode applied voltage waveforms corresponding to the checker-board pattern. XVC is the data electrode applied voltage waveform corresponding to the background portion. YV is an arbitrary scanning electrode applied voltage waveform. As shown in FIG. 47, in the checkerboard pattern display, the data voltages corresponding to the display portion in neighboring rows change with respect to each other in the opposite direction. Hence, crosstalk of the scanning electrode voltage due to the change in the data electrode voltage may be mostly prevented because of the cancellation between the neighboring rows.

However, since all the voltage changes of the whole background portion with the same data value are in the same direction, crosstalk occurs to the scanning electrode voltage, thus causing voltage distortion. The scanning electrode voltage distortion due to the background portion varies the effective voltage values of all the data electrode voltages perpendicularly intersected.

In comparison with changes (the hatching portion the liquid crystal applied voltage waveform shown in FIG. 47) in effective voltage values in the XA row and XB row within the checker-board pattern, the case where a voltage effective value increases with respect to an ideal effective value and the case where a voltage effective value decreases with respect to the ideal effective value are repeated in the XA row. The case, where a voltage effective value increases, continues in the XB row. For that reason, since a difference in light transmittance occurs, a display unevenness looks like vertical noise streaks.

In order to remove the noise streaks, the output phases in the XA column and XB column are reversed at constant intervals when the output phase of the background XC column does not vary, or the output phase of the XC column is reversed at constant intervals when the output phase of XA column and XB column do not vary.

That is, the orthogonal function is set in such a manner that the data electrode applied voltage waveform at the portion where display data for each dot varies frequently switches its phase at a constant interval while the phase of the data electrode applied voltage waveform for the background portion with the same display data does not vary, or the phase of the data electrode applied voltage waveform at the portion where display data for each dot varies frequently does not vary while the phase of the data electrode applied voltage waveform for the background portion vary at a constant interval.

Figures 48, 49:
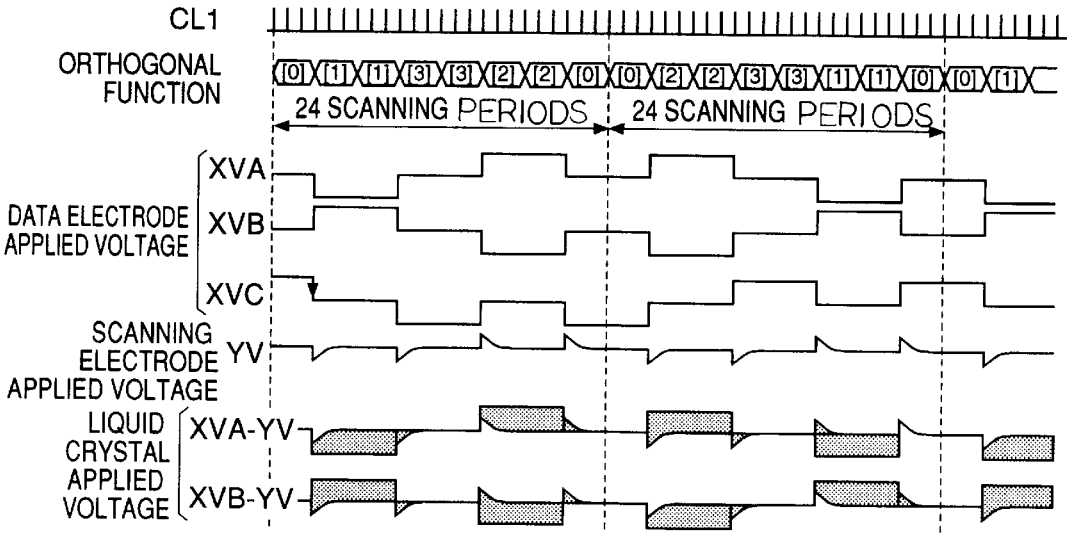
FIG. 48 is a diagram showing the orthogonal function related to the sixth embodiment.
FIG. 49 is a timechart showing the waveform of a liquid crystal applied voltage related to the sixth embodiment.

The orthogonal function of the present embodiment set according to this concept is shown in FIG. 48. Compared with the orthogonal function in the fifth embodiment, the orthogonal function expands the complete duration of a horizontal period to 48 horizontal periods. FIG. 49 shows the waveform of a voltage applied to each electrode when the checker-board pattern is displayed using this orthogonal function.

As can be understood from FIG. 49, the output phase of each of the XA row and the XB row is reversed at 24 horizontal periods intervals. As a result, an increase or decrease in a voltage effective value due to crosstalk in each of the XA and XB columns is equalized in 48 horizontal period.

Moreover, like the fifth embodiment, in the orthogonal function of the present embodiment, since the selection voltages having positive and negative polarity being the same in number are applied in 2 frame period, and positive and negative polarity being nearly the same in number are applied in one frame period, the polarity reversion can be realized ideally. And the frequency characteristic of the selection voltage is equalized to any scanning electrodes in a four frame period so that the horizontal noise streaks phenomena caused by the difference in the frequency characteristic does not occur.

Next, explanation will be made as to the seventh embodiment according to the present invention in which an orthogonal function is preferably set when the frame rate control system (hereinafter, referred to as an FRC system) being a typical gray-scale display technique for of the passive matrix liquid crystal display device which is disclosed in "the Liquid Crystal Device Handbook", Nikkan Kogyo Shinbun Co., pp404–405, is applied to the liquid crystal driving method of the present invention.

The FRC system is a method which obtains a gray-scale display by changing the ratio of on states to off states displayed with a unit formed of several frames. For example, when one unit is formed of four frames, five gray-scale displays can be obtained as follows:

[on to off ratio]=[0:4], [1:3], [2:2], [3:1], [4:0]

The present embodiment prevents an image deterioration considered when the gray-scale according to the FRC system is displayed in the liquid crystal driving method according to the present invention.

Figure 50:
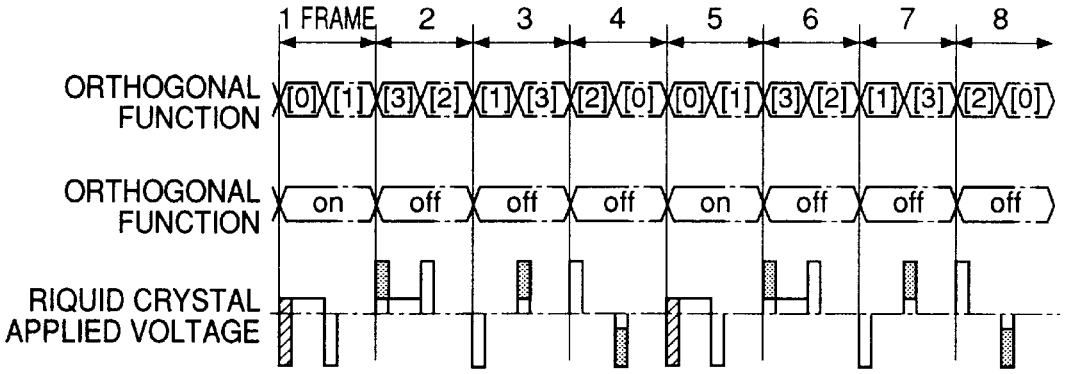
FIG. 50 is a timechart showing the waveform of a liquid crystal applied voltage in the case where a possible image degradation phenomenon occurs.

In the orthogonal function according to the fifth and sixth embodiments, four frames are set as one unit. However, many commercially available liquid crystal controllers employ the FRC system in which 4, 8, or 16 frames are set as one unit. In this case, where the FRC system, for example, in which four frames is set as one unit and [on to off ratio]=[1:3] is considered, the polarity of the selection voltage becomes always negative in the display-on frame as shown in FIG. 50.

Since the effective value (displayed with shaded hatching in the figure) of the selection voltage at a display-on time is larger than the voltage effective value at a display-off time, a negative polarity dc component is applied to a liquid crystal. For that reason, an image deterioration phenomenon may occur, like the burning, and the serviceable life of a liquid crystal cell may be shortened.

Figure 51:
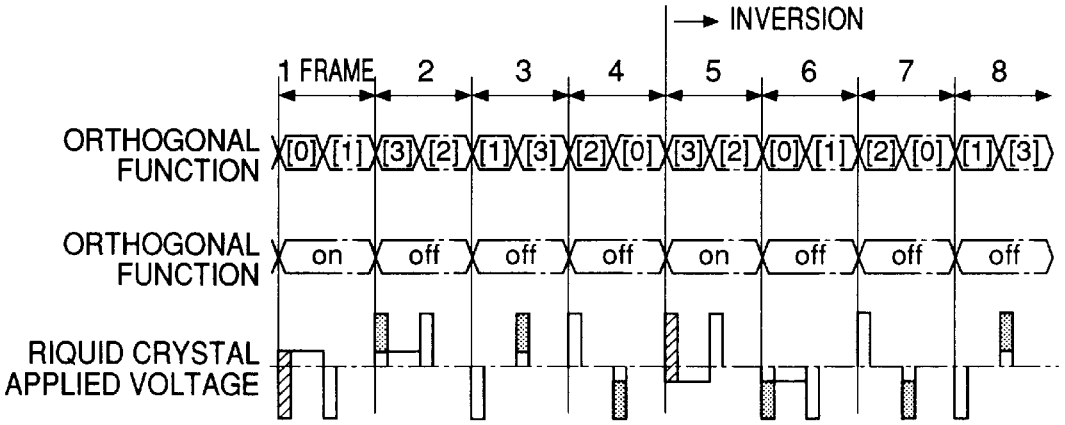
FIG. 51 is a timechart showing the waveform of a liquid crystal applied voltage related to the seventh embodiment.

In order to solve that problem, the orthogonal function according to the present embodiment requires the following conditions: an orthogonal function has as one unit period a period of twice a unit frame period to realize the gray-scale in accordance with the FRC system, and the polarity of an orthogonal function is reversed every unit frame of the FRC system. For example, in the case of the FRC system, when the orthogonal function is set according to the above-mentioned concept, the dc component which has occurred in the first four frames shown in FIG. 51 can be canceled in the next 4-frame period.

In order to realize the above-mentioned operation, the present embodiment uses the orthogonal function having, for example, set values shown in FIG. 52. In the present embodiment, the orthogonal function has 32 frames as one unit. The reason for this is that it is considered that the FRC system of many commercially available liquid crystal controllers employs 16 frame period as one unit. Moreover, by considering the FRC system in which a 4-frame period or 8-frame period is set as one unit, the orthogonal function is set in such a manner that the polarity thereof is switched even in the 8- or 16-frame period as well as when the polarity is changed in a 16 frame period.

Figure 53:
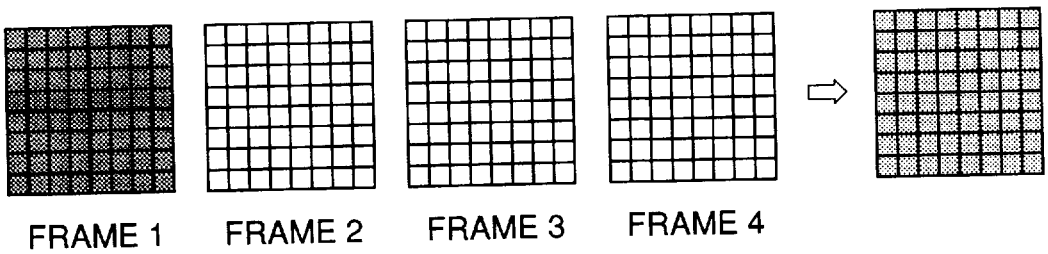
FIG. 53 is an explanatory diagram showing an example of a prior art FRC displaying system.
Figure 54:
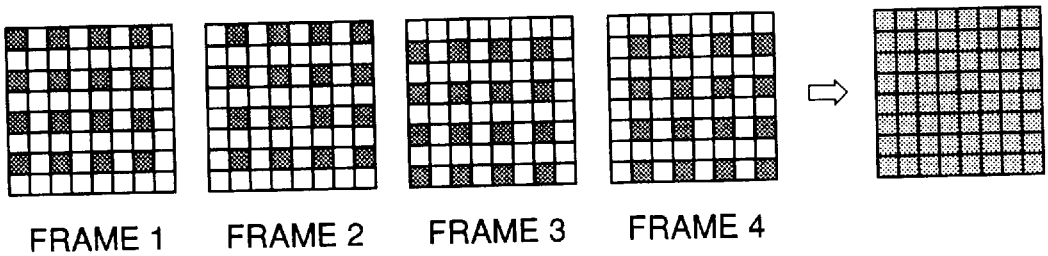
FIG. 54 is an explanatory diagram showing an example of a prior art FRC displaying system.

When the half tone of [1:3] is displayed in the FRC system, on/off displaying simultaneously the whole display as shown in FIG. 53 causes flickering. For that reason, the display method in which the half-tone display portion as shown in FIG. 54 is displayed in a display pattern and the phase of the gray-scale pattern is varied every frame, is generally used. The gray-scale pattern is generally used a certain number of lines as one unit.

The number of lines forming the gray-scale pattern and the number of lines (deciding the orthogonal function changing period) forming the scanning block in the driving system according to the present invention mutually have a close relationship to the image quality.

For example, when the above-mentioned line numbers agree with each other, or the number of gray-scale pattern forming lines is a multiple of the number of lines in the scanning block, the vertical flickering phenomenon like rain-falling is liable to be produced. This is caused by displaying a gray-scale pattern display so that an imbalance occurs between the number of positive polarity and the number of negative polarity of the data voltage applied in one frame period with respect to the nonselection voltage, and a dc current component is temporarily applied if the imbalance is large.

In order to confirm this flickering phenomenon, the liquid crystal controller made by Chips & Technology Co., Ltd. was used to perform the FRC display (gray-scale pattern forming line number: 32) using the orthogonal function (FIG. 52) in the present embodiment. As a result, in a gray-scale display pattern, the flickering phenomenon was confirmed by the driving method in the case where the scanning block includes 4 lines but was not confirmed by the driving method in the case where the scanning block includes 6 lines.

Figure 55:
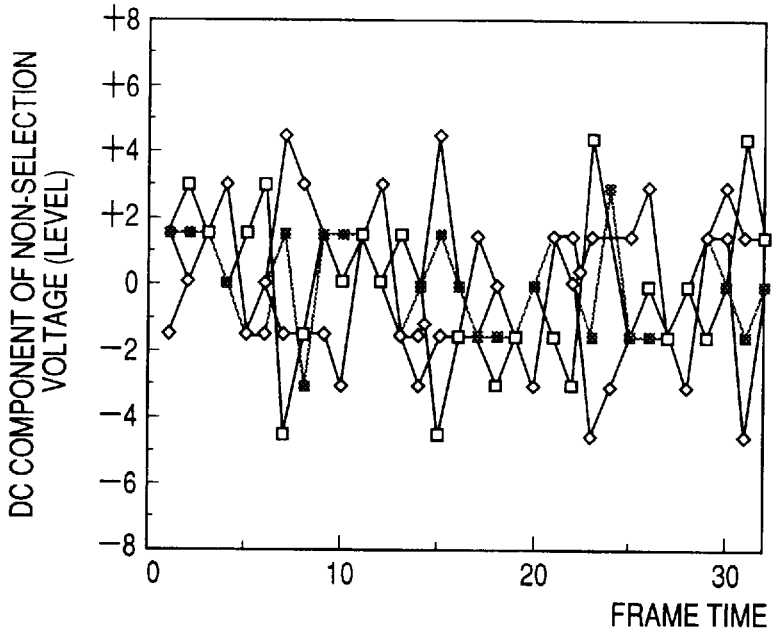
FIG. 55 is a graph showing the characteristic of a liquid crystal voltage in the FRC system suitable for the four line scanning block driving operation according to the seventh embodiment.
Figure 56:
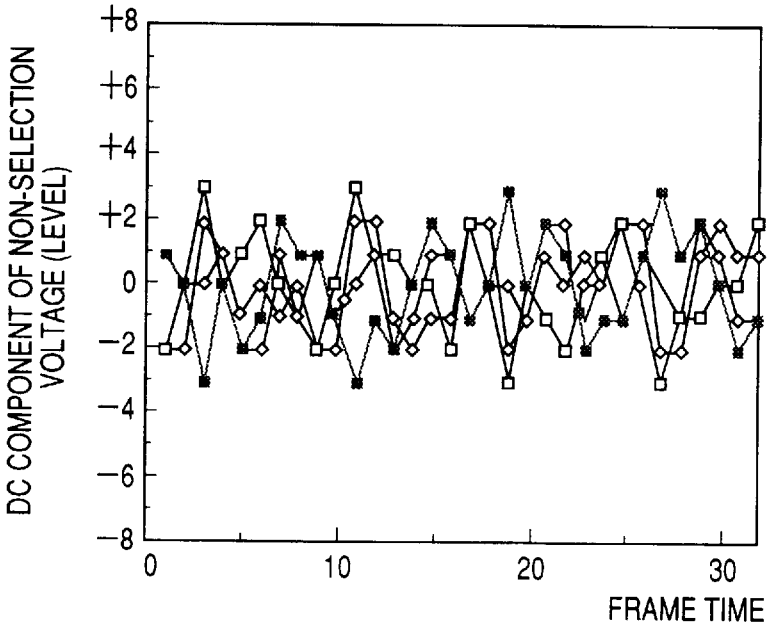
FIG. 56 is a graph showing the characteristics of a liquid crystal voltage in the FRC system suitable for the six line scanning block driving operation according to the seventh embodiment.

FIGS. 55 (4-line scanning block driving) and 56 (6-line scanning block driving) are graphs which each plot the degree of an imbalance between the number of positive polarities and the number of negative polarities of the non-selection voltage in the gray-scale pattern including the above-mentioned difference. In the two graphs, the horizontal axis represents a frame time and the vertical axis represents imbalance, that is, a dc component level for one frame period. Each graph plots the level of a dc component detected for four vertical lines arbitrarily-selected.

Referring to FIG. 55, it is understood that the level of the dc component per one frame period is high in the 4-line driving operation of the scanning block but is suppressed low in the 6-line driving operation of the scanning block. As described above, it was confirmed that when the number of gray-scale pattern forming lines is a multiple of the number of scanning block lines, the imbalance between the number of positive polarities and the number of negative polarities is increased, and when it is not, the imbalance is suppressed.

As described above, in order to suppress the flickering phenomenon when the gray-scale display according to the FRC system is performed according to the driving system in the present invention, it is necessary that the gray-scale pattern forming line number is set to a number which is not a multiple nor a factor of the scanning block line number.

Since the number of gray-scale pattern forming lines according to the FRC system is usually 2 to the power of the number, (2,4,8,16. . . ), the number of scanning block lines are selected to be 6, 10, 12, or the like.

As described above, the use of the orthogonal function described in the fifth to seventh embodiment allows the image degradation phenomenon which sometimes occurs in the liquid crystal panel display to be reduced or prevented, whereby the displaying operation can be performed in a higher image quality.

The liquid crystal display device explained in the above embodiments uses a single orthogonal function preset. However, the configuration may be prepared, in which a memory that previously stores plural orthogonal functions may be prepared, and means provided that reads out one orthogonal function from the memory in response to an instruction which selects an orthogonal function accepted externally.

As described above, according to the present invention, the liquid crystal driving method and the liquid crystal driving device employing the same method can be provided, which can each prevent or decrease an occurrence of possible image deterioration in the plural line selection driving system.

Next, the eighth to eleventh embodiments of the liquid crystal display device which each achieves the second object of the present invention will be explained below.

Figure 57:
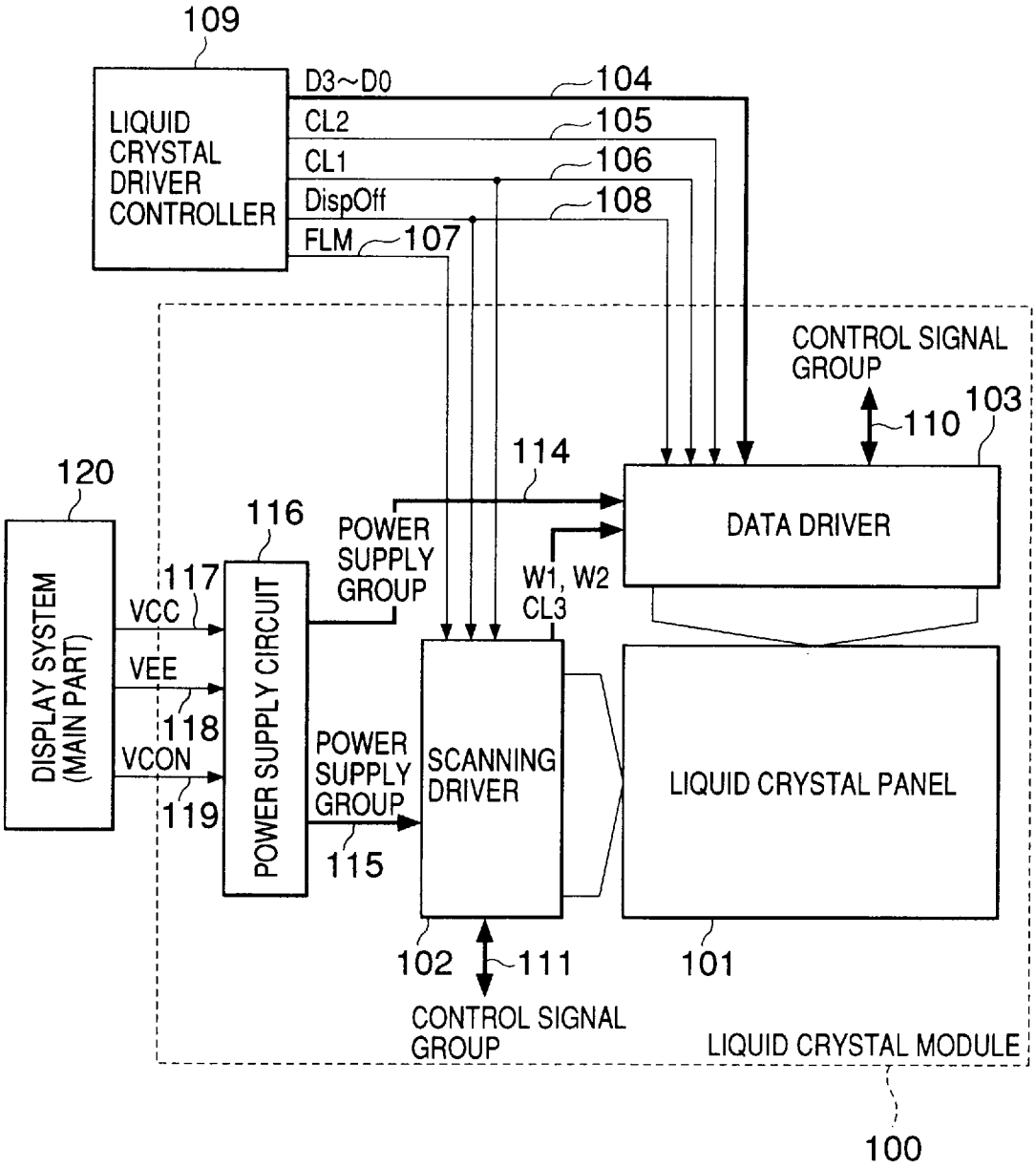
FIG. 57 is a structural diagram showing the whole configuration of a liquid crystal display device according to the eighth embodiment to achieve of the second object of the present invention.

FIG. 57 is a block diagram showing the configuration of the liquid crystal display device according to the eighth embodiment of the present invention. According to the present invention, the liquid crystal display device consists of a liquid crystal module 100 including a liquid crystal panel (horizontal dots j×vertical dots i) 101, a scanning driver 102, a data driver 103, and a power supply circuit 116 for creating liquid crystal drive voltage groups 114, 115; a liquid crystal driver controller 109 for controlling display data and synchronous signal groups 104 to 108; and a display system (main part) 120.

The display data 104 from the liquid crystal driver controller 109 is formed of 8-bit parallel data D7 to D0. The data latch clock CL2105 is in synchronous with the display data 104. The line clock CL1106 transmits data for one line during one clock period. One period of the leading line clock FLM 107 corresponds to one frame period. When the display-off control signal DispOff 108 is at a "low" level, the display of the liquid crystal panel 101 is halted. The control signal group 110 controls the operation of the data driver 103. The control signal group 111 controls the operation of the scanning driver 102. The power supply group 114 is a drive voltage source for the scanning driver 102. The power supply voltage group 115 is a drive voltage source for the data driver 103. External power supply voltages VCC 117 and VEE(GND) 118 being a base of the liquid crystal drive voltage groups 114 and 115 are supplied to the power supply circuit 116. Moreover, a voltage Vcon 119 which adjusts the voltage levels of the liquid crystal drive voltage group is supplied to the power supply circuit 116. In the present embodiment, the voltages 117, 118 and 119 are supplied from the display system (main part) 120.

The operation of each block in the liquid crystal display device shown in FIG. 57 will be explained below by referring to FIGS. 58 to 65. First, the selection line number m which can satisfy the requirement in the withstand voltage of the scanning driver 102 must be selected according to the scanning electrode number N. In this case, it is important that the withstand voltage of the data driver 103 is set to less than the maximum output voltage of the device manufactured by the standard process which features a low manufacturing cost. In this specification, it is explained that the maximum output voltage is 5 (V) (a rated voltage of 5±10% (V)), which is a signal voltage for circuits manufactured in the standard logic process which has been generally and widely used as a conventional logic process.

Figure 58A:
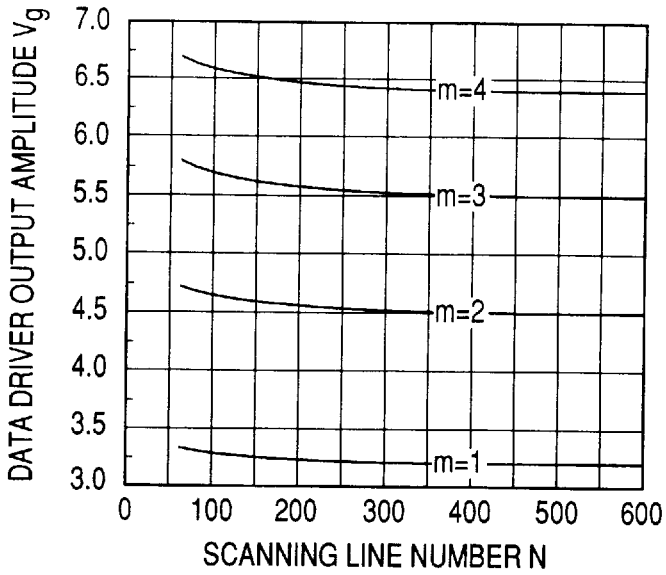
FIG. 58A is a diagram showing an output swing value of each of a data driver and a scanning driver.
Figure 58B:
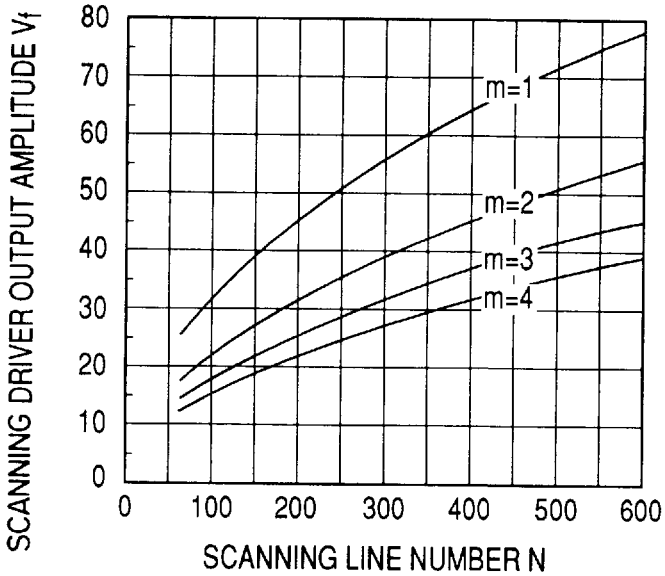
FIG. 58B is a diagram showing an output swing value of each of a data driver and a scanning driver

As described using FIG. 58, with the limit of the withstand voltage of the scanning driver being 50 (V) and the simultaneous selection line number m being 2, the scanning line number N of up to 500 can be realized. Moreover, with the simultaneous selection line number m being less than 2, the output amplitude of the data driver is less than 5 (V) for circuits which can be manufactured using the low withstand voltage process.

In consideration of the above-mentioned matter, the liquid crystal display device according to the present invention is driven with the simultaneous selection scanning line number m being 1 or 2, according to the resolution of the liquid crystal panel. In order to realize the above-mentioned operation in the liquid crystal display device according to the present invention, all the data drivers, internal logic circuits and liquid crystal driver circuits are driven at a low voltage between VCC (5(V)) and GND (0 (V)). On the other hand, since the scanning driver drives the data driver at a low voltage between VCC (5(V)) and GND (0(V)), the liquid crystal drive circuit is driven at a high voltage of 50 (V) between VyH and VyL, with the intermediate voltage Vy1 (2.5(V)) between VCC to GND being a non-selection voltage, and two potentials VyH and VyL with respect to the non-selection voltage of ±25 (V) being the positive potential and a negative potential, that is, a positive scanning selection voltage VyH (=Vy2=27.5(V)) and a negative scanning selection voltage VyL (=Vy0=−22.5(V)).

It is desirable that the reference potential of the low withstand voltage logic portion in the scanning driver is the same as the reference potential of a high withstand voltage liquid crystal drive circuit. In the relationship with the drive voltage of the data driver, it is necessary that the reference potential is the drive voltage VyH which is in positive side of the high-withstand voltage portion or the drive voltage VyL in the negative side. For that reason, since the scanning driver drive signal supplied from the liquid crystal controller is generally a signal with a voltage between VCC and GND, means is used that standardizes levels to the reference potential inside the driver, and drives the internal logic at a low voltage (withstand voltage of 5 volts) having the VyH or VyL acting as the reference.

Figure 59A:
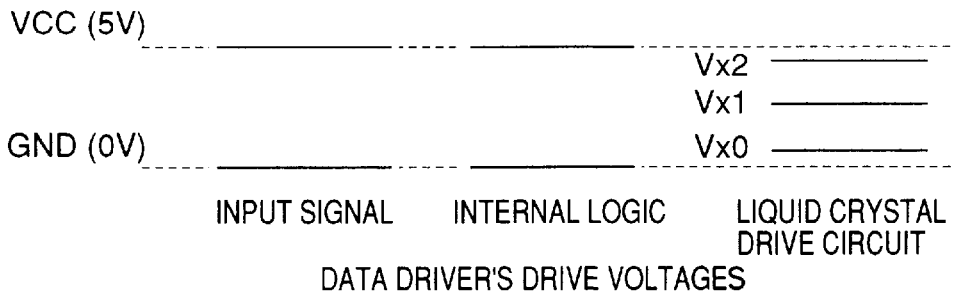
FIG. 59A is a diagram showing a drive voltage of each of a data driver and a scanning driver.
Figure 59B:
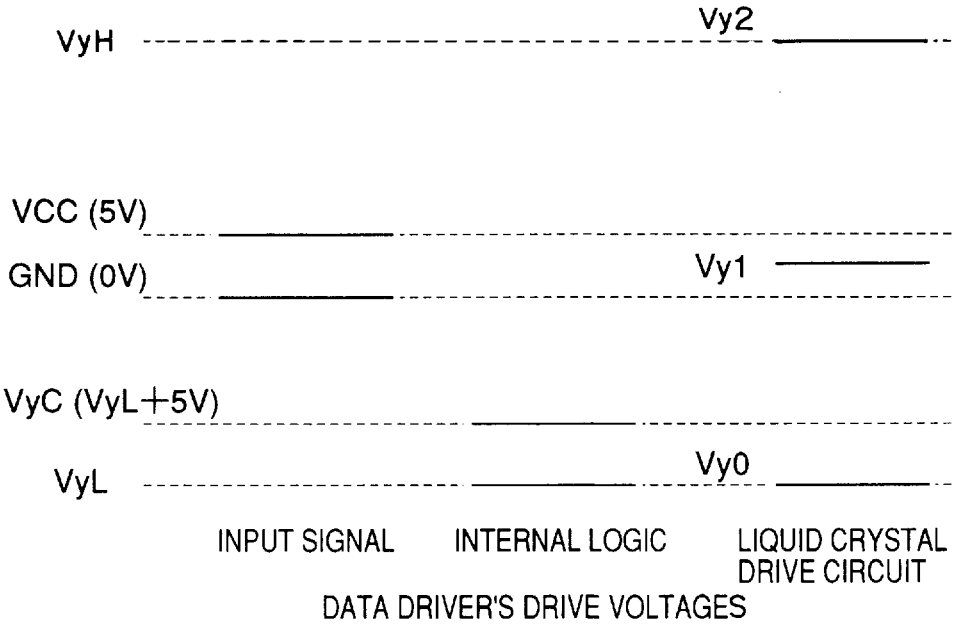
FIG. 59B is a diagram showing the output swing value of each of a data driver and a scanning driver

The drive voltage level of each of the data driver and the scanning driver, described above, is shown in FIGS. 59A and 59B. FIG. 59A illustrates the drive voltage of a data driver. FIG. 59B illustrates the drive voltage of a scanning driver. The input signal having two modes, VCC (5 V) and GND (0 V), is input to the data driver. The internal logic of the data driver operates in two modes of VCC (5(V)) and GND (0(V)). A voltage ranging Vx2 to Vx0, which has the intermediate potential Vx1 (2.5 (V)) between VCC(5(V)) and GND (0(V)), is supplied to the liquid crystal drive circuit. The internal logic circuits in the scanning driver are driven at the voltage (5(V)) between the internal logic reference voltage VyC and the negative side high-withstand voltage portion drive voltage VyL by setting the reference potential of the scanning driver to the negative high-withstand voltage portion drive voltage VyL.

In the data driver, since it is assumed that the drive voltage effective value, as shown in FIG. 58, is 2.3 volts in the liquid crystal display-off state, the liquid crystal driver circuit can be driven at less than 5 volts. However, it should not be limited that the drive voltage effective value in the liquid crystal display-off state is 2.3 volts. This voltage value may vary in consideration of the temperature characteristic of the liquid crystal. The liquid crystal drive voltage may exceed 5 volts or more. The power supply voltage VCC of 5 volts or more supplied to the driver may cause a latch-up. Hence it is necessary to set the potential between VCC and GND to be (5+α) volts for driving the data driver. VCC is 5 (V) ±10% when the low withstand voltage process equivalent to the process applied to the conventional liquid crystal driver is used. Hence, if α is 10% and the liquid crystal drive voltage is set within the VCC, the data driver can be properly operated even under temperature variations. As described above, the DC/DC converter produces VCC (referred to as VxH) at a level of (5+α) (V) (5 V+10%) from an external power supply voltage VCC of 5 volts.

Figure 60:
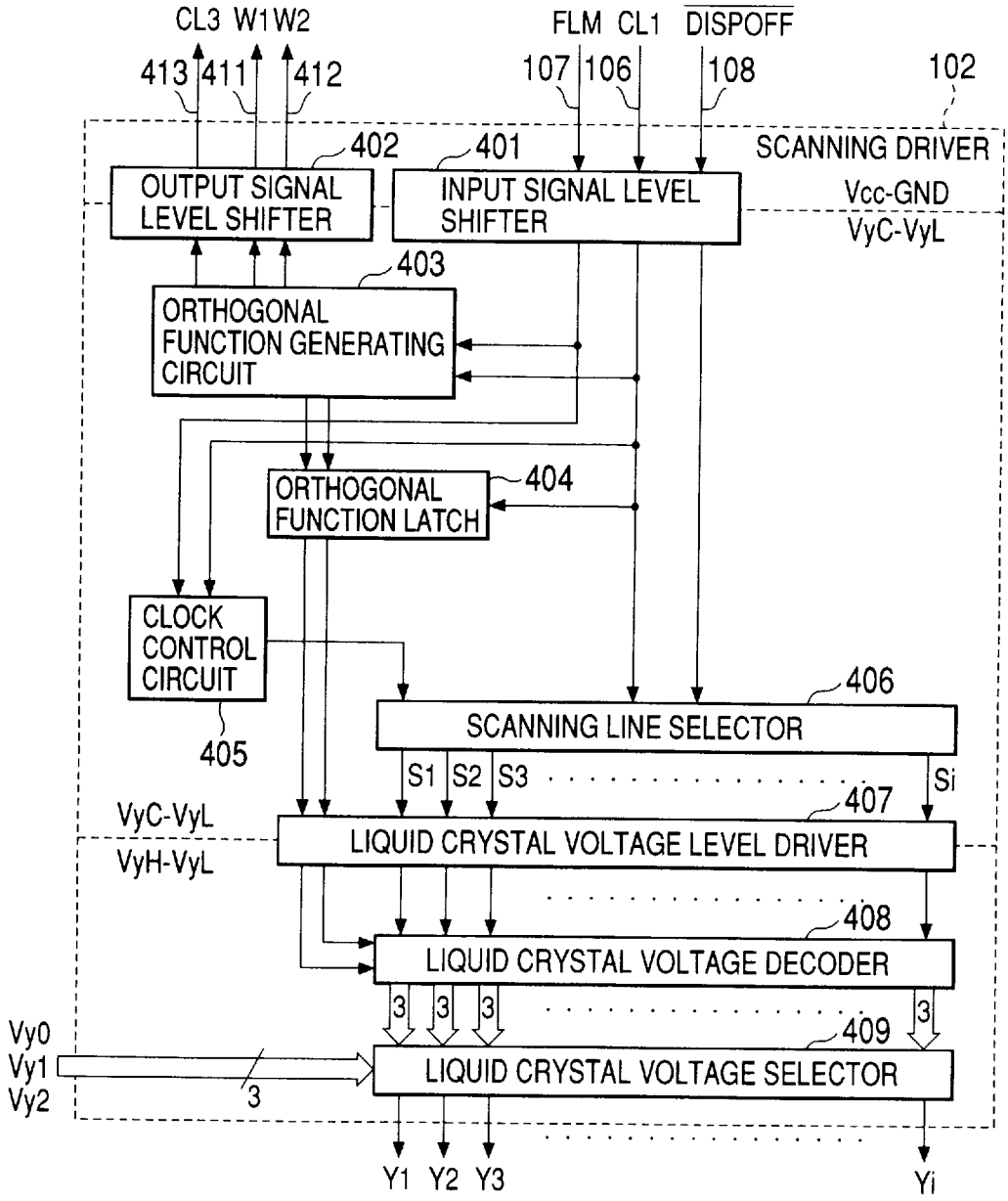
FIG. 60 is a structural diagram showing the scanning driver shown in FIG. 57.
Figure 61:
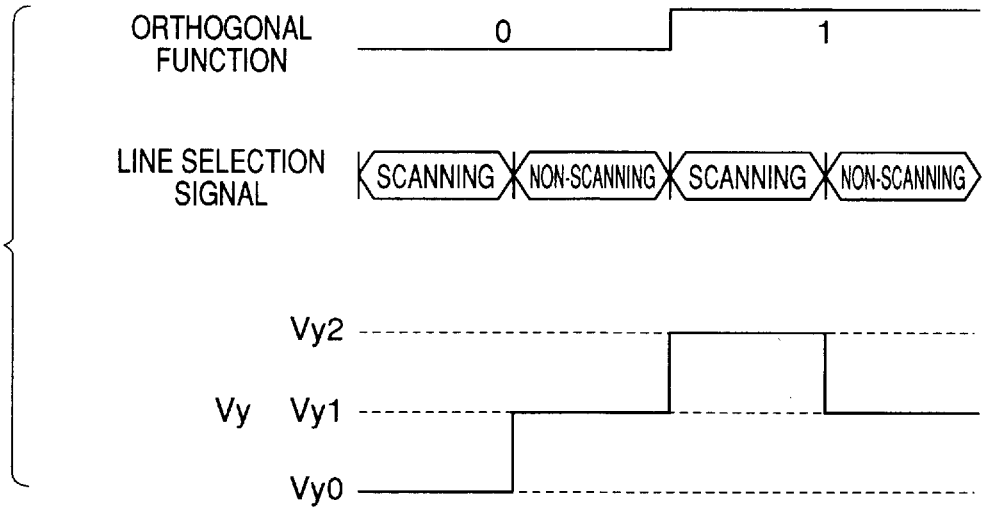
FIG. 61 is an operational timechart showing the scanning driver shown in FIG. 57.

Next, a concrete configuration of the scanning driver 102 in the liquid crystal display device according to the present invention will be explained as an example below by referring to FIGS. 60 and 61. FIG. 60 is a structural diagram illustrating the scanning driver 102 in the liquid crystal display device related to the present invention. FIG. 61 is an explanatory diagram illustrating the operation of the scanning driver 102. The scanning driver 102, as shown in FIG. 60, includes an input signal level shifter 401, an output signal level shifter 402, an orthogonal function generating circuit 403, an orthogonal function latch circuit 404, a clock control circuit 405, a scanning line selector 406, a liquid crystal voltage level shifter 407, a liquid crystal voltage decoder 408, a liquid crystal voltage selector 409, and liquid crystal voltage output terminals Y1 to Yi. The output signal level shifter 402 outputs a 2-bit orthogonal function W1 signal 411, an orthogonal function W2 signal 412, and a line transfer clock CL3 signal 413.

The input signal level shifter 401 is a circuit which level-shifts an input signal group 106 to 108 to a level between VyC and VyL, being the internal logic drive voltage. The output signal level shifter 402 is a circuit which level-shifts a signal group in the level between VyC and VyL created by the internal logic circuit to a signal group in a level between VCC and GND. The internal logic circuits disposed after the input signal level shifter 401 operate on a low voltage at a level between VyC and VyL.

The orthogonal function generating circuit 403 is a portion which produces the orthogonal function. The orthogonal function generating circuit 403 produces the W1 signal 411, the W2 signal 412, and the scanning line transfer clock CL3 signal 413, based on the count value of the first line marker FLM signal 107 and the count value of the CL1 signal 106.

The clock control circuit 405 delays the FLM signal 107 by two scanning periods and then transfers the scanning reference data to the scanning line selector 406.

The scanning line selector 406 includes at least a number of shift circuits corresponding to the number of the liquid crystal voltage output terminals. The scanning line selector 406 shifts the scanning reference data transferred from the clock control circuit 405 according to the line clock CL1 signal 106 and then outputs line selection signals S1 to Si. When the display-off control signal DispOff 108 is at a "low" level, the shifting operation of the shift circuit is ceased and becomes the reset state.

The liquid crystal voltage level shifter 407 is a circuit which boots a signal in the internal logic power supply voltage level (VyC to VyL) to a voltage in the liquid crystal drive high-voltage level (VyH to VyL=Vf). Circuits disposed after this level shifter operate on a voltage at a high-voltage level (VyH to VyL).

The liquid crystal voltage decoder 408 and the liquid crystal voltage selector 409 selectively output one level voltage among three level liquid crystal drive scanning voltages, according to a combination of the orthogonal function and the line selection signal. For example, when the orthogonal function is "0", as shown in FIG. 61, the negative selection voltage Vy0 is selected if the line selection signal is in the scanning state, or the Vy1 voltage is selected if the line selection signal is in the non-scanning state. When the orthogonal function is "1", the positive selection voltage Vy2 is selected if the line selection signal is in the scanning state. If the line selection signal is in the non-scanning state, the non-selection signal Vy1 is selected, regardless of the state of the orthogonal function.

When the display-off control signal DispOff signal 108 is at a "low" state, all the line selection signals are in the non-selection state, so the non-selection voltage Vy1 is output.

Figure 62:
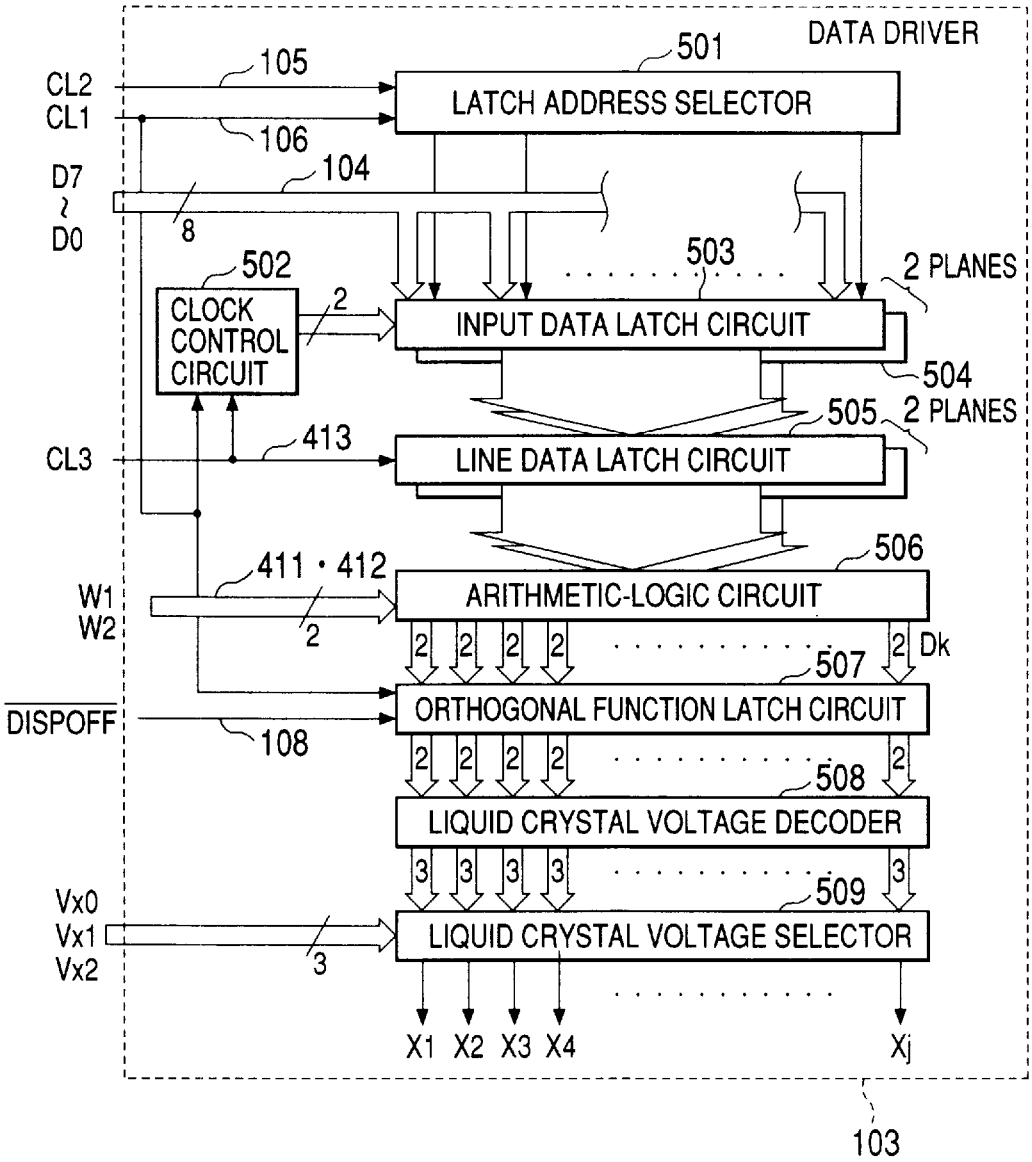
FIG. 62 is a structural diagram showing the data driver shown in FIG. 57.
Figure 63:
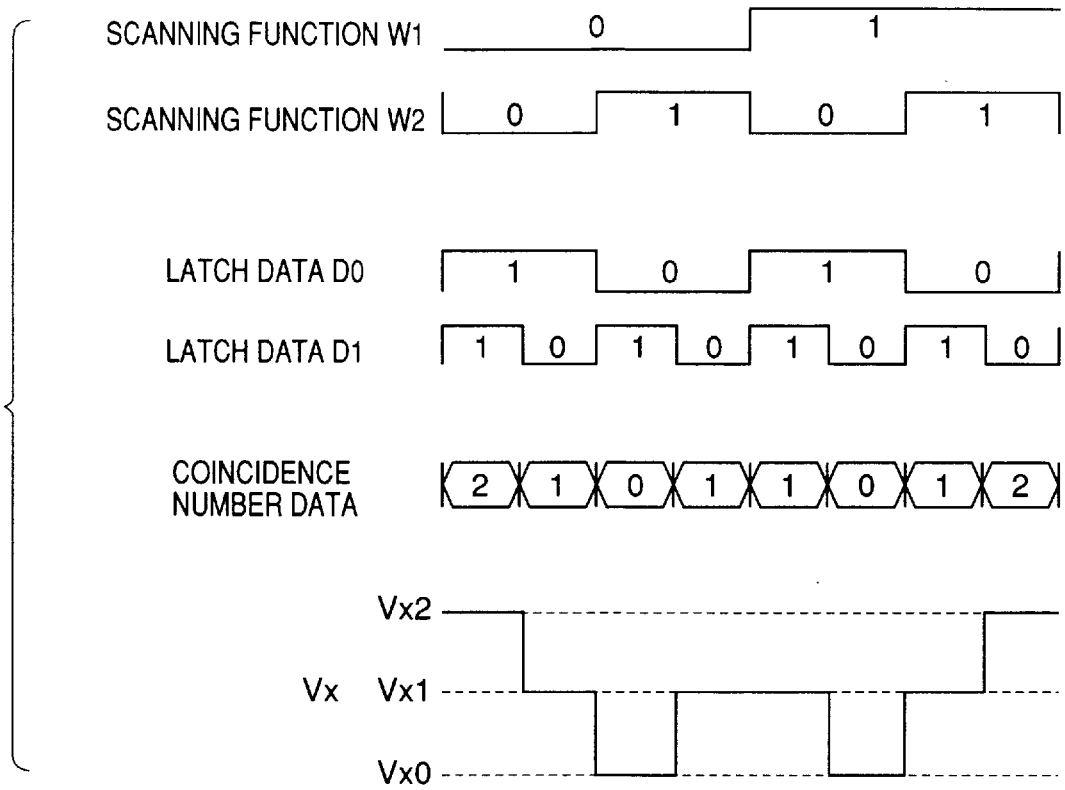
FIG. 63 is an operational timechart showing the data driver shown in FIG. 57.

Next, a concrete configuration of the data driver 103 in the liquid crystal display device according to the present invention will be explained below as an example by referring to FIGS. 62 and 63. FIG. 62 is a structural diagram showing the data driver 103 in the liquid crystal display device according to the present invention. FIG. 63 is an explanatory diagram showing the operation of the data driver 103.

As shown in FIG. 62, the data driver 103 consists of a latch address selector 501, a clock control circuit 502, an input data latch circuit A503, an input data latch circuit B205, a line data latch circuit 505, an arithmetic-logic circuit 506, an orthogonal function latch circuit 507, a liquid crystal voltage decoder 508, a liquid crystal voltage selector 509, and liquid crystal voltage output terminals X1 to Xj. The data driver 103 operates on a low voltage (about 5 volts) between the low-voltage side drive voltage Vx0 and the high-voltage side drive voltage Vx2.

The latch address selector 501 is a circuit which produces data capture signals for the input data latch circuits 503 and 504 formed of 2 planes. The latch address selector 501 is reset by the line clock CL1 signal 106 and produces the data capture signals according to the count value of the data latch clock CL2 signal 105.

The clock control unit 502 is a circuit which produces a plane select signal designating one of two planes of input data latch circuits 503 and 504. The plane select signal is produced using the line clock CL1 signal 106 and the scanning line transfer clock CL3 signal 413 so as to select one of the input data latch circuit A503 and the input data latch circuit B504 alternately every one scanning period.

The input data latch circuits 503 and 504 are formed of two planes with at least a plurality of latch circuits corresponding to the number of voltage output terminals. A plane selected by means of a signal from the clock control unit 502 captures 8-bit parallel data by means of a signal from the latch address selector 501.

The line data latch circuit 505 is formed of at least a number of latch circuits corresponding to the number of voltage output terminals. The line data latch circuit 505 latches data output from the input data latch circuits 503 and 504 using the scanning line transfer clock CL3 signal 413, and then transfers the output to the arithmetic-logic circuit 506.

The arithmetic-logic circuit 506 includes at least a number of arithmetic-logic circuits corresponding to the number of voltage output terminals. In the arithmetic-logic circuit, a coincidence circuit compares two output values from the line data latch circuit 505 formed of two planes, and compares both the scanning function W1 signal 411 and the scanning function W2 signal 412, and then outputs the detected coincidence number as two-bit identity value data Dk. That is, when the latch data D0 and D1 of the line data latch circuits 505 are both "0" or "1" and both the scanning functions W1 and W2 are "on" or "off", the identity value data Dk is "2". When the latch data D0 and D1 are both "0" or "1" and the scanning function W1 is "on" and the scanning data W2 is "off", or when the latch data D0 is "0" and the latch data D1 is "1", or vice versa, and both the scanning functions W1 and W2 are "on" or "off", the identity value data Dk is "1". When the latch data D0 does not agree with D1 and the scanning function W1 does not agree with W2, the identity value data is "0".

The orthogonal function latch circuit 507 latches the identity value Dk in response to the line clock latch CL1 signal 106 to establish the output synchronization. When the display-off control signal DispOff 108 is at a "low" level, the identity value is forced to be "1" in decimal notation.

The liquid crystal voltage decoder 508 and the liquid crystal voltage selector 509 selectively output one level among 3 levels of the liquid crystal drive data voltages in accordance with the identity value data Dk output from the arithmetic-logic circuit 506. For example, when the coincidence number is "0" in decimal notation, as shown in FIG. 63, the low-voltage side drive voltage Vx0 is selected, and when the identity value is "1" in decimal notation, the non-selection voltage Vx1 is selected. When the identity value is "2", the high-voltage side drive voltage Vx2 is selectively output.

Figure 64:
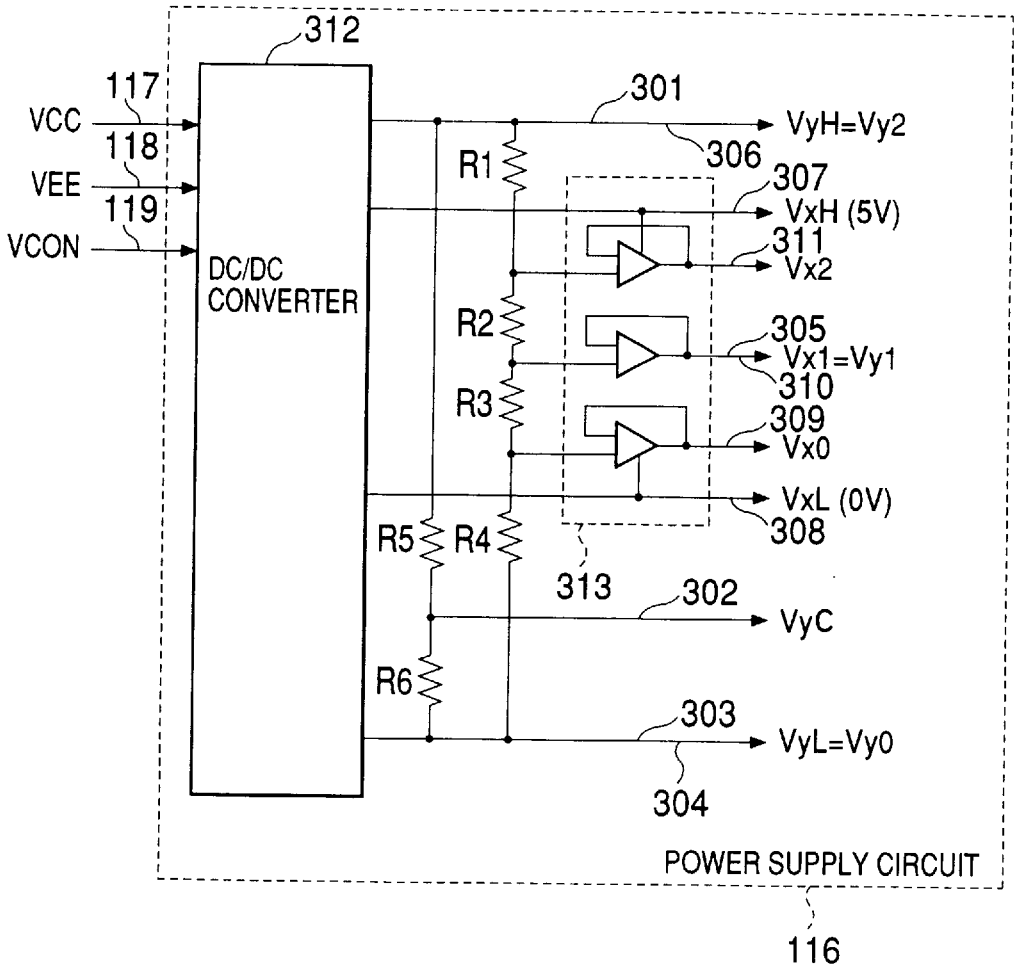
FIG. 64 is a structural diagram showing the power supply circuit shown in FIG. 57.

Next, an example of the power supply circuit 116 in the liquid crystal display device according to an embodiment of the present invention will be explained below by referring to FIG. 64. FIG. 64 is a structural diagram of the power supply circuit 116 and shows the case where the difference between the high-voltage side liquid crystal drive data voltage Vx2 and the low-voltage side liquid crystal drive data voltage Vx0 is less than 5 volts. The power supply circuit 116 is formed of a DC/DC converter 312 driven at VCC (5 volts), voltage dividing resistors R1 to R6, and operational amplifiers 313.

The power supply circuit 116 produces three level voltages VyH 301, VyC 302 and VyL 303 for power sources used to drive the scanning driver, and liquid crystal drive scanning voltages Vy 0304, Vy 1305, and Vy 2306 which will be selected by the liquid crystal voltage selector 409. These voltages are supplied to the scanning driver 102. Moreover, the power supply circuit 116 produces voltages VxH 307 and VxL 308 as power sources to drive the data driver, and liquid crystal drive data voltages Vx0309, Vx1310, and Vx2311 which will be selected by the liquid crystal voltage selector 509. These voltages are supplied to the data driver 103.

These voltages are produced by means of the DC/DC converter 312 driven at VCC (5 volts), the voltage dividing resistors R1 to R6, and the operational amplifiers 313.

The DC/DC converter 312 directly produces the VyH voltage 301 and VyL 303 each used for the scanning driver power source, the scanning voltage Vy0 voltage 304 and Vy2 voltage each used for the liquid crystal driving, and the VxH voltage 307 and VxL voltage 308 each used as the scanning voltage for the data driver power supply. The VyH voltage 301 (=Vy2 voltage 306) and the VyL voltage 303 (=Vy0 voltage 304) may be varied by means of the adjusting voltage Vcon 119. The VxH voltage 307 is a fixed voltage of 5 volts. The VxL voltage 308 is a fixed voltage of 0 volts. The liquid crystal drive data voltage Vx0 voltage 309, Vx1 voltage 310, Vx2 voltage 311, and the liquid crystal drive scanning voltage Vy1 voltage 305 are produced by dividing the voltage difference between the VyH voltage 301 and the VyL voltage 303 of the scanning driver power supply by means of the resistors R1 to R4. The scanning driver power supply voltage VyC voltage 302 is produced by dividing the voltage difference between the VyH voltage 301 and the VyL voltage 303 of the scanning driver power supply by means of the resistors R5 to R6.

The resistors R1 to R4 have the relationship expressed by the following formulas (8) and (9). The relationship between the above-mentioned voltages is expressed by the following formulas (10) and (16).

$$R1=R4 \tag{8}$$

$$R2=R3 \tag{9}$$

$$VyH=Vy2>Vy1>VyL=Vy0 \tag{10}$$

$$Vy2-Vy1=Vy1-Vy0 \tag{11}$$

$$VxH>Vx2>Vx1>Vx0>VxL \tag{12}$$

$$Vx2-Vx1=Vx1-Vx0 \tag{13}$$

$$Vy1=Vx1 \tag{14}$$

$$VxH-VxL=5\{V] \tag{15}$$

$$VyC-VyL=5(V)\pm10\% \tag{16}$$

In order to operate the internal logic circuits normally within the scanning driver, it is necessary to always maintain the relationship of (VyC−VyL=5(V)±10%). In order to realize that condition, it is necessary to consider the resistance ratio of the resistors R5 and R6 and the adjustment width of each of VyH and VyL by the adjusting voltage Vcon 119. The potential difference between the Vx2 voltage 311 and the Vx0 voltage 309, which is the output amplitude Vg of the data driver, is expressed by the formula (6). The potential difference between the Vy2 voltage 308 and the Vy0 voltage 306, which is the output amplitude VF of the scanning driver, is expressed by the formula (7). The liquid crystal drive data voltages 309 to 311 and the liquid crystal drive scanning voltage Vy1 voltage 305 are made by performing an impedance conversion via a voltage follower circuit using operational amplifiers 313. The operational amplifier 313 is powered by means of the driver power supply voltage VxH voltage 307 and the VxY voltage 308.

As described above, in the liquid crystal display device according to the present invention, the data driver can be operated with a drive voltage of 5 volts or less, thus being driven with lower power consumption, compared with the prior art voltage averaging method.

Next, the case where the difference between the liquid crystal drive data voltages Vx2 and Vx0 for the data driver exceeds 5 volts will be explained below as the ninth embodiment of the liquid crystal display device according to the present invention. In this case, it is predicted that a liquid crystal drive data voltage higher than the data driver drive voltage causes a latch-up within the driver so that a desired liquid crystal drive data voltage cannot be output because of its abnormal operation. In the ninth embodiment, the data driver is driven at the drive voltage of (5+α (V)), not 5 (V), where α is set to as large as 10%, being an allowable range of the rating of the logic power supply for the conventional data driver. The configuration of liquid crystal display device according to the ninth embodiment is identical to the configuration shown in FIG. 57, except for the power supply circuit.

Figure 65:
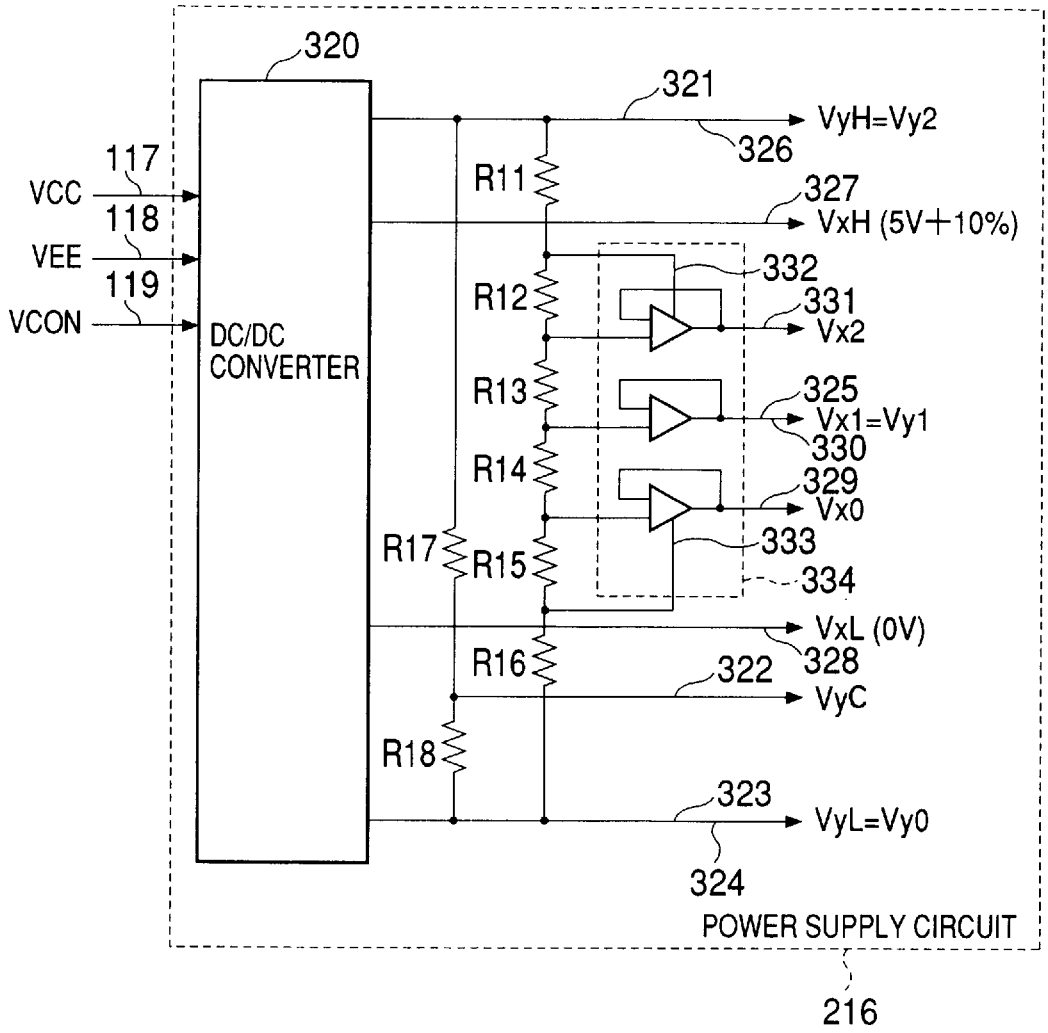
FIG. 65 is a structural diagram showing the power supply circuit for a liquid crystal display device according to the ninth embodiment to achieve the second object of the present invention.

Hereinafter, the configuration of the power supply circuit 216 according to the ninth embodiment will be explained below by referring to FIG. 65. FIG. 65 is a structural diagram of the power supply circuit 216. In this embodiment, the power supply circuit 216 produces the VyH voltage 321, VyC voltage 322, and VyL voltage 323 used for the scanning driver power supply supplied to the scanning driver, and the Vy0 voltage 324, Vy1 voltage 325, and Vy2 voltage 326 used for scanning the liquid crystal driver. The power supply circuit 216 produces the VxH voltage 327 and the VxL voltage 328 for the data driver power supply supplied to the data driver, and the Vx0 voltage 329, the Vx1 voltage 330, and the Vx2 voltage 331 used for the liquid crystal driving data. The VDH voltage 332 and the VDL voltage 333 for a power supply which drives the operational amplifiers 334 are obtained by means of the voltage dividing resistors R12 and R15. These voltages are produced by a DC/DC converter 320 which operates from VCC (5 volts), voltage driving resistors R11 to R16 and R17 to R18, and an operational amplifier 334. The DC/DC converter 320 directly produces the VyH voltage 321 and VyL voltage 323 for the scanning driver power supply, the scanning voltage Vy0 voltage 324 and Vy2 voltage 326 for the liquid crystal driving, and the VxH voltage 327 and VxL voltage 328 for the data driver power supply. The VyH voltage 321 (=Vy2 voltage 326) and the VyL voltage 323 (=Vy0 voltage 324) can be varied using the adjusting voltage Vcon 119. The VxH voltage 327 is a fixed voltage of (5 (V)+10%). The VxL voltage 328 is a fixed voltage of 0 (V). The liquid crystal drive data voltages 329 to 331 and the liquid crystal drive scanning Vy1 voltage 325, and the operational amplifier drive voltage VDH voltage 332 and VDL voltage 333, are produced by dividing the voltage difference between the scanning driver power supply VyH voltage 321 and the Vy1 voltage 323 by means of the resistors R12 to R16. The scanning driver power supply voltage VyC voltage 322 is produced by dividing the voltage difference between the scanning driver power supply VyH voltage 321 and the VyL voltage 323 by means of the resistors R17 and R18.

The resistors R11 to R16 have the relationship expressed by the following formulas (17) to (19). The above-mentioned voltages have the relationship expressed by the following formulas (20) to (27).

$$R11=R16 \tag{17}$$

$$R12=15 \tag{18}$$

$$R13=14 \tag{19}$$

$$VyH=Vy2>Vy1>VyL=Vy0 \tag{20}$$

$$Vy2-Vy1=Vy1-Vy0 \tag{21}$$

$$VDH>Vx2>Vx1>Vx0>VDL \tag{22}$$

$$VxH>Vx2>Vx1>Vx0>VxL \tag{23}$$

$$Vx2-Vx1=Vx1-Vx0 \tag{24}$$

$$Vy1=Vx1 \tag{25}$$

$$VxH-VxL=5(V)+10\% \tag{26}$$

$$VyC-VyL=5(V)\pm10\% \tag{27}$$

In order to operate the internal logic circuits normally within the scanning driver, it is necessary to always maintain the relationship of (VyC−VyL=5(V)±10%). In order to realize that relationship, it is necessary to consider the resistance ratio of R17 and R18 as well as the adjustment width of VyH and VyL by using the Vcon 119. The liquid crystal drive data voltages 329 to 331 and the liquid crystal drive scanning voltage Vy1 voltage 325 are obtained by performing an impedance conversion via the voltage follower using operational amplifiers 334. The operational amplifier 334 is powered by a power supply including the VDH voltage 332 and the VDL voltage 333. The operational amplifier's power supply can provide an output voltage having a stable active region because the relationship of VDH>Vx2>Vx1>Vx0>VDL is always maintained to the input thereto.

Figure 66:
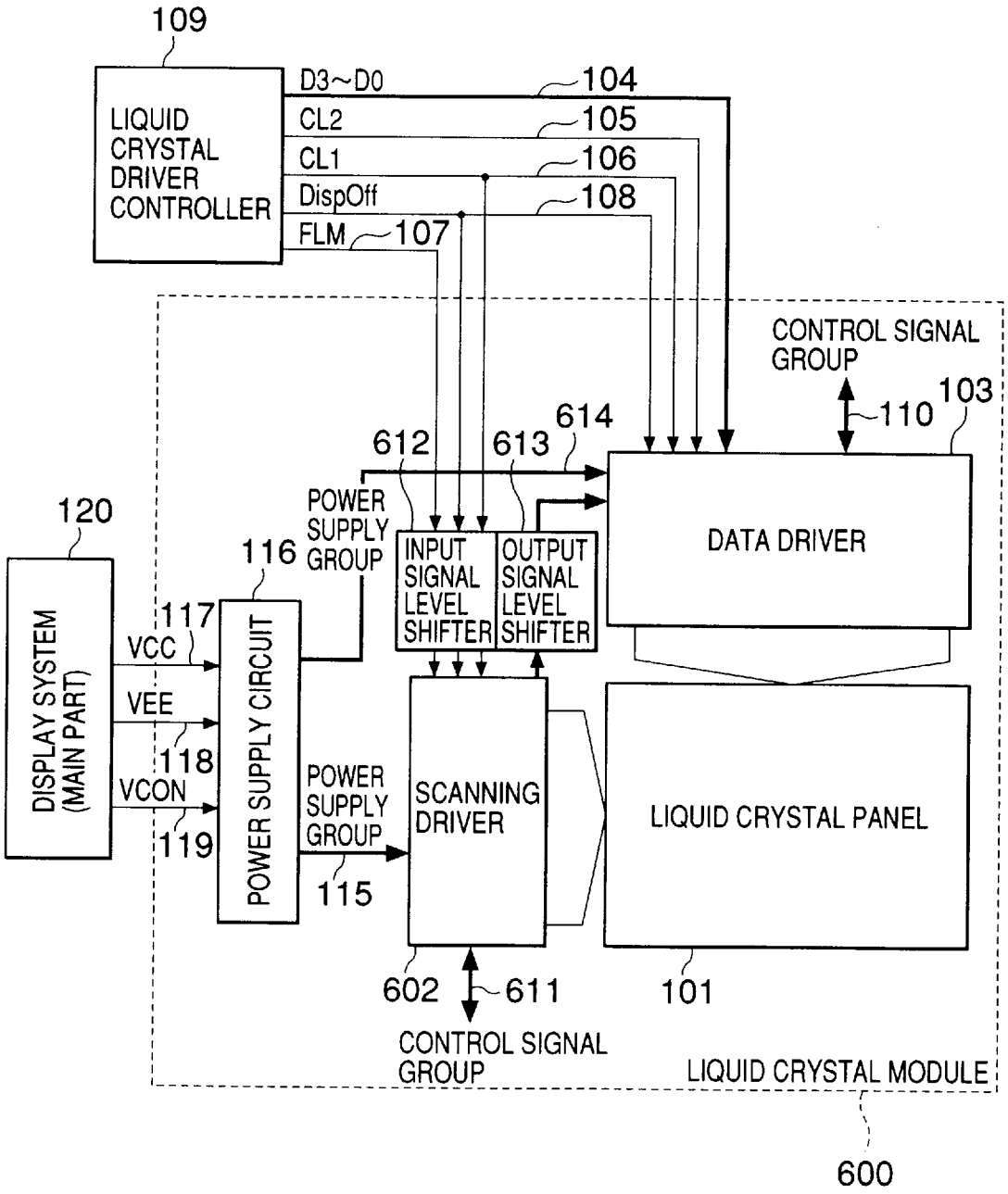
FIG. 66 is a structural diagram showing the overall configuration of a liquid crystal display device according to the tenth embodiment to achieve the second object of the present invention.
Figure 67:
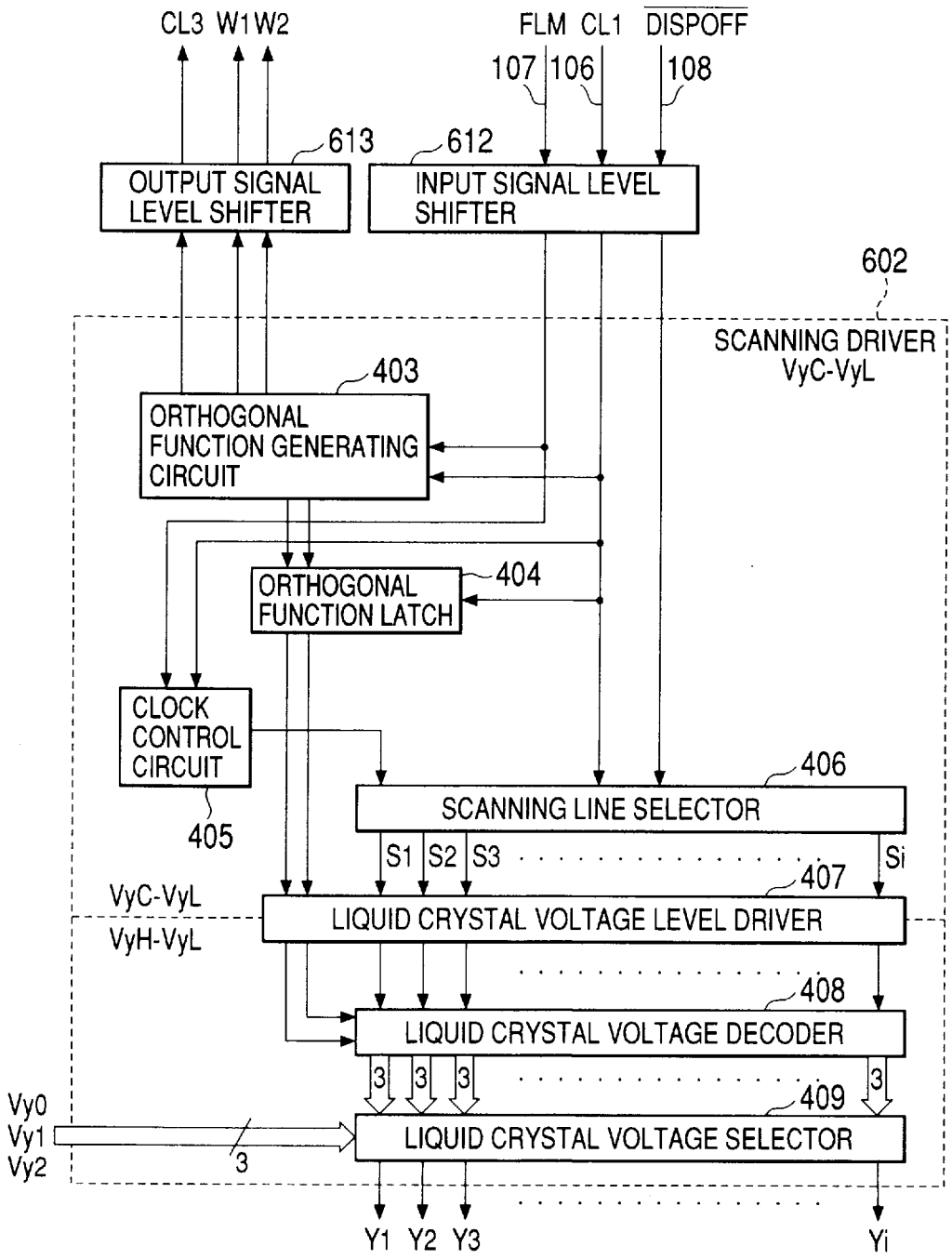
FIG. 67 is a block diagram showing the input signal level shifter, the output signal level shifter and the scanning driver shown in FIG. 66.

Next, the liquid crystal display device according to the tenth embodiment of the present invention will be explained below by referring to FIGS. 66 and 67. The liquid crystal display device according to the tenth embodiment is characterized by arranging the input signal level shifter 612 and the output signal level shifter 613, which are connected externally to the scanning driver 602, in the liquid crystal module 600. FIG. 66 is a block diagram showing the configuration of the liquid crystal display device according to the tenth embodiment of the present invention. In the figure, the scanning driver 602, the input signal level shifter 612, and the output signal level shifter 613 which are included in the liquid crystal module 600 differ in configuration, compared with the configuration in the eighth embodiment. Constituent elements assigned with the same numerals, except for the above-mentioned elements, have the same configuration. The duplicate explanation of the same constituent elements will be omitted here.

The scanning driver 602, the input signal level shifter 612, and the output signal level shifter 613, according to the present embodiment, will be explained below by referring to FIG. 67. FIG. 67 illustrates the structural diagram of those constituent elements. The scanning driver 602 differs from the scanning driver 102 in the eighth embodiment in that the input signal level shifter 612 and the output signal level shifter 613 are arranged externally to the scanning driver 602. The scanning driver 602 operates similarly to the scanning driver 102. The input signal level shifter 612 level-shifts the input signal group in the VCC level and the input signal group in the GND level to the VyC and VyL levels, being the logic drive voltages of the scanning driver 602, and then drives the scanning driver 602 in response to the level-shifted input signal group. On the other hand, the output signal level shifter 613 is a circuit which level-shifts the signal level group in the VyC level and the signal level group in the VyL level output from the scanning driver 602 to the signal group in the VCC level and the signal group in the GND level.

Figure 68:
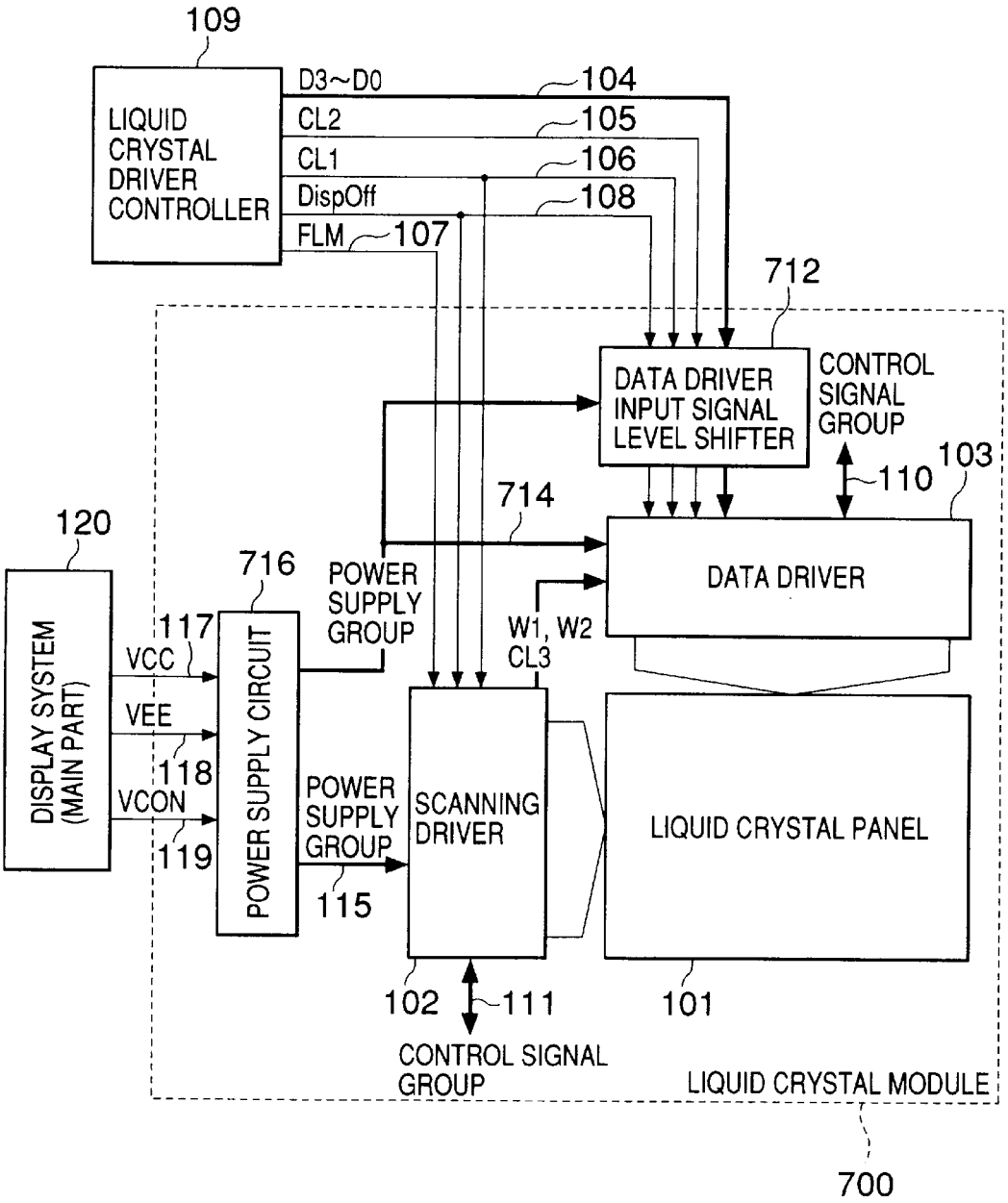
FIG. 68 is a diagram showing the overall configuration of a liquid crystal display device according to the eleventh embodiment to achieve the second object of the present invention.
Figure 69:
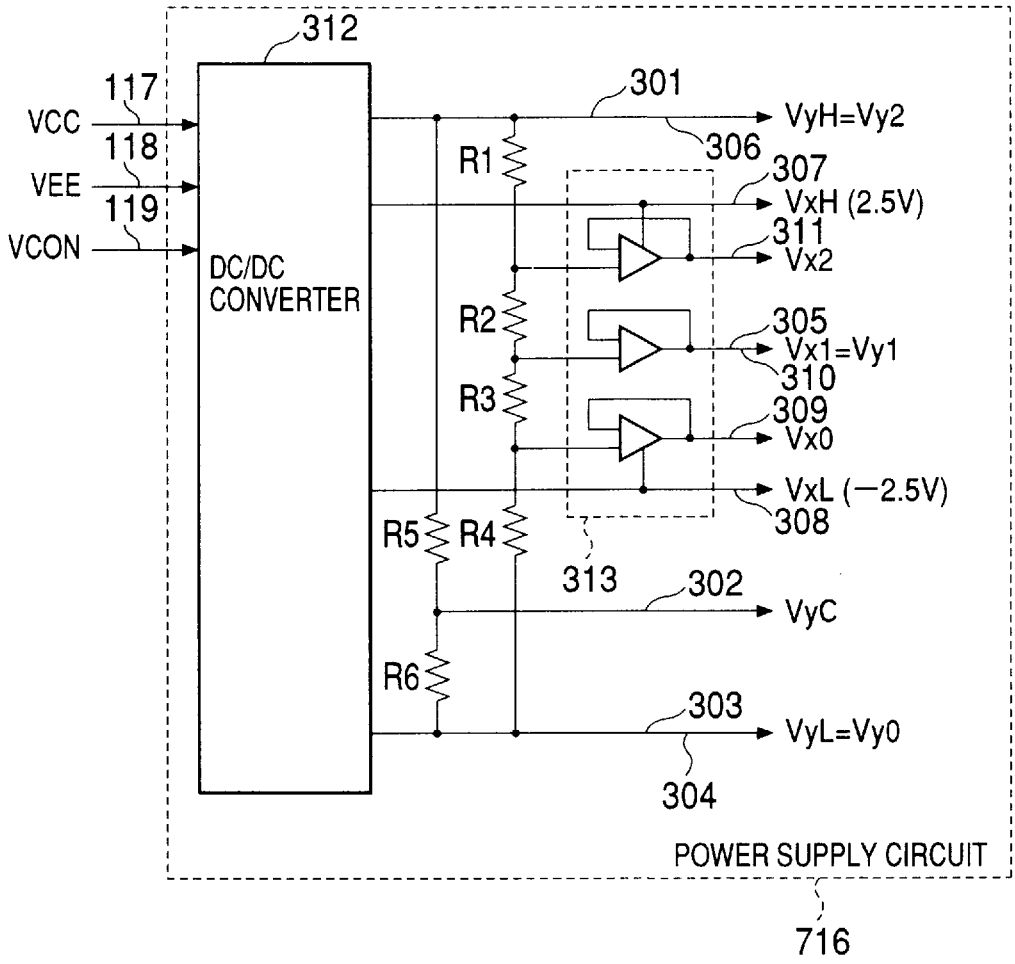
FIG. 69 is a structural diagram showing the power supply circuit shown in FIG. 68.

Next, the liquid crystal display device according to the eleventh embodiment of the present invention will be explained below using FIGS. 68 and 69. In the liquid crystal display device in the first embodiment shown in FIG. 11, the liquid crystal drive data voltage Vx1 is set to 0 (V), and ±2.5 (V) with respect to the Vx1 are used as the drive voltages VxH voltage and the VxL voltage for the data driver. FIG. 68 is a block diagram showing the configuration of the liquid crystal display device according to the eleventh embodiment of the present invention. In the figure, compared with the eighth embodiment, the liquid crystal display device has the same configuration, except for the data driver input signal level shifter 712 and the power supply circuit 716. The duplicate explanation of the common elements will be omitted here.

The data driver input signal level shifter 712 according to the present embodiment level-shifts the data driver input signal group in the VCC level and the data driver input signal group in the GND level to the signal in the VxH (+2.5

(V)) level and the signal in the VxL (−2.5 (V)) level. The data driver drives in accordance with the level-shifted signal. The internal elements operate on drive voltages of VxH and VxL within the data driver.

Next, the power supply circuit 716 will be explained below by referring to FIG. 69. FIG. 69 is a structural diagram of the power supply circuit 716 and shows the case where the difference between the liquid crystal drive data voltages Vx2 and Vx0 is less than 5 (V). In the figure, each of the VyH voltage 301, the VyC voltage 302 and the VyL voltage 303 for the scanning driver power supply, as well as the scanning voltages Vy0 voltage 304, the Vy1 voltage 305 and the Vy2 voltage 306 for the liquid crystal driving, are supplied to the scanning driver 102. The VxH voltage 307 and the VxL voltage 308 for the data driver power supply are supplied to the data driver input signal level shifter 712 and the data driver 103. The data voltages Vx0 voltage 309, Vx0 voltage 310, and Vx2 voltage 311 for the liquid crystal driving, are supplied to the data driver 103.

Those voltages are produced by means of a DC/DC converter 312 driven from VCC (5 V), resistors R1 to R6, and operational amplifiers 313. The DC/DC converter 312 directly produces the VyH voltage 301 and the VyL voltage 303 for the scanning driver power supply, the scanning voltages Vy0 voltage 306 and the Vy2 voltage 308 for the liquid crystal driving, and the Vx voltage 307 and the VxL voltage 308 for the data driver power supply. The VyH voltage 301 (=Vy2 voltage 306) and the VyL voltage 302 (=Vy0 voltage 304) can be varied by means of the adjusting voltage Vcon 109. The VxH voltage 307 is a fixed voltage of 2.5 (V). The VxL voltage 308 is a fixed voltage of −2.5 (V). The liquid crystal drive data voltage Vx1 310 and the liquid crystal drive scanning voltage Vy1 305 are a fixed voltage of 0 (V). The liquid crystal drive data voltage Vx2 311 is produced by dividing the voltage difference between the VyH voltage 301 and the Vy1 voltage 305 for the scanning driver power supply by means of the resistors R1 and R2. The liquid crystal drive data voltage Vx0 309 is produced by dividing the voltage difference between the Vy1 voltage 305 and the VyL voltage 303 for the scanning driver power supply by means of the resistors R3 and R4. The VyC voltage 302 for the scanning driver power supply is produced by dividing the voltage difference between the VyH voltage 301 and the VyL voltage 303 for the scanning driver power supply by means of the resistors R5 and R6.

The relationship between the resistors R1 to R4 is the same as that expressed by formulas (8) and (9) in the eighth embodiment. The relationship between the abovementioned voltages has the relationship expressed by the formulas (10)–(16) in the eighth embodiment, In order to operate the internal logic circuits normally within the scanning driver 102, it is necessary to always maintain the relationship of (VyC−VyL=5 (V)±10%). In order to realize this relationship, it is necessary to consider the resistance ratio of the resistor R5 to the resistor R6 and the adjustment width of each of the VyH and VyL adjusted by the Vcon 119. The potential difference Vg between the Vx2 voltage 311 and the Vx0 voltage 309 is expressed by the formula (2). The potential difference Vf between the Vy2 voltage 306 and the Vy0 voltage 304 is expressed by the formula (3). The liquid crystal drive data voltages 309 to 311 and the liquid crystal drive scanning Vy1 voltage 305 are produced by performing an impedance conversion via the voltage follower circuit using the operational amplifiers 313. The VxH voltage 307 and the VxL voltage 308 for the data driver power supply are used as a power supply of the operational amplifiers 313.

Furthermore, in the eleventh embodiment, the difference between the Vx2 voltage and the Vx0 voltage for liquid crystal driver data of the data driver is within 5 (V). However, it is no problem to drive the data driver on the condition that the difference between the data driver drive VxH voltage and the VxL voltage is (5 (V)+α), not 5 (V), even when the difference exceeds 5 (V). The value a is set to as large as 10%, being the allowable range of the rating of the logic power supply of the conventional data driver.

Furthermore, in the eleventh embodiment, the input signal level shifter and the output signal level shifter are arranged inside the scanning driver 102. However, it should not be limited only to such a configuration. It is no problem to arrange the input signal level shifter and the output signal level shifter externally to the scanning driver, like the tenth embodiment.

According to the present invention, since the output voltage range of the data driver can be set to less than 5 volts, all the internal logic circuits and liquid crystal voltage output portions can be made using the low-withstand voltage process. As a result, the power consumption can be decreased, compared with the prior-art voltage averaging driving method by which the liquid crystal voltage output portion with high-withstand voltage is fabricated. There is no shortcoming even that the output voltage range of the data driver exceeds 5 volts, since the internal logic circuits and the liquid crystal voltage output portion are driven within the rated power supply voltage (e.g. 5 V+10%) of the low-withstand process.

Moreover, since the orthogonal function generating means and the arithmetic function for operating the display data and the orthogonal function are incorporated, the prior art liquid crystal controller can be used without any modification so that a high general versatility can be provided.

We claim:

1. A liquid crystal driving method which drives a liquid crystal panel including dots where scanning electrodes and data electrodes intersect, by applying a 2-level selection voltage to said scanning electrodes which belong to a scanning electrode group according to an orthogonal function data value, said 2-level selection voltage having a positive polarity and a negative polarity with respect to a non-selection voltage acting as a center point, said scanning electrode group being formed of a set of n (≧2) scanning electrodes;

summing identity values every scanning electrode group, said identity values being a number of times that a display data value on each scanning electrode of a scanning electrode group on which said selection voltage is applied agrees with said orthogonal function data value provided to each of said scanning electrodes; and applying a data voltage corresponding to said summation value to each of said data electrodes, comprising the steps of:

dividing one frame period into plural virtual block periods;

dividing a selection period in which said selection voltage is applied, into n divisional selection periods which are separated from each other at predetermined intervals, for all the scanning electrode groups to be selected in each of said virtual block periods; and sequentially setting the i-th divisional selection period to each of remaining scanning electrode groups, continuously to the i-th (i=1 to n) divisional selection period of said scanning electrode group to be first selected for said block period.

2. The liquid crystal driving method in accordance with claim 1, further comprising repeating a voltage applying operation n-times for each block period, with one cycle being the sum of said divisional selection period and said predetermined interval, said voltage applying operation being performed sequentially and continuously to all said scanning electrode groups to be selected in said block period, corresponding to a series of divisional selection periods set continuously and sequentially from the first selected scanning electrode group in each block period.

3. The liquid crystal driving method in accordance with claim 2, wherein each of said divisional selection periods is t, being (said one frame period)/(the sum of the number of said scanning electrodes constituting said liquid crystal panel); and wherein said predetermined interval is an integral multiple of a duration t.

4. The liquid crystal driving method in accordance with claim 3, wherein the voltage level applied to each scanning electrode during said i-th divisional selection period is a voltage level during the i-th division obtained by equally dividing the selection period by n, said selection period corresponding to said selection voltage, among said selection voltages to be applied to said scanning electrodes for said frame period.

5. The liquid crystal driving method in accordance with claim 2, wherein a combination of voltage levels applied to each of said scanning electrode groups at every divisional selection period is the same in all of said voltage applying operations which are repeated n times for each block period.

6. The liquid crystal driving method in accordance with claim 2, wherein the ratio of the number of positive levels to the number of negative levels included in a voltage applied to said scanning electrode group in the last divisional selection period of a block period is the same as the ratio of the number of positive levels to the number of negative levels included in a voltage applied to said scanning electrode group in the first divisional selection period of the next block period.

7. The liquid crystal driving method in accordance with claim 1, further comprising the step of switching the first selected scanning electrode group in each of said block periods in every frame.

8. The liquid crystal driving method in accordance with claim 1, further comprising the step of changing the order in which said divisional selection period is set to said scanning electrode group of each block period in every frame.

9. A liquid crystal display device comprising:

a liquid crystal panel including dots where scanning electrodes and data electrodes intersect;

scanning voltage driving means for applying a 2-level selection voltage to said scanning electrode which belong to a scanning electrode group according to an orthogonal function data value, said 2-level selection voltage having a positive polarity and a negative polarity with respect to a non-selection voltage acting as a center point, said scanning electrode group being formed of a set of n (≧2) scanning electrodes;

data voltage driving means for summing identity values every scanning electrode group, said identity value being a number of times that a display data value on each scanning electrode of each scanning electrode group on which said selection voltage is applied agrees with said orthogonal function data value provided to each of said scanning electrodes, and then applying a data voltage corresponding to the sum value to each of said data electrodes; and power supply means for producing drive voltages to said scanning voltage driving means and said data voltage driving means to drive said liquid crystal panel; said scanning voltage driving means dividing one frame period into plural virtual block periods;

said scanning voltage driving means dividing a selection period in which said selection voltage is applied, into n divisional selection periods which are separated from each other at predetermined intervals, for all the scanning electrode groups to be selected in each of said block periods; and said scanning voltage driving means sequentially setting the i-th divisional selection period to each of remaining scanning electrode groups, continuously to the i-th (i=1 to n) divisional selection period of said scanning electrode group to be first selected in said block period.

10. The liquid crystal display device in accordance with claim 9, wherein each of said divisional selection periods is t, being (said one frame period)/(the sum of the number of said scanning electrodes constituting said liquid crystal panel); and wherein said predetermined interval is an integral multiple of a duration t.

11. The liquid crystal display device in accordance with claim 9, wherein said data voltage driving means comprises:

an arithmetic-logic unit for summing identity values between a display data value input and the orthogonal function data value in every scanning electrode group; and a driving unit for applying a data voltage corresponding to the sum obtained by said arithmetic-logic unit to each of said data electrodes.

12. The liquid crystal display device in accordance with claim 9, wherein said power supply means comprises a DC/DC converter and an output amplifier; said power supply means producing drive voltages for said scanning voltage driving means and said data voltage driving means, using a single external power supply, and controlling said selection voltage produced by said scanning voltage driving means according to a level of an externally input control voltage.

13. The liquid crystal display device in accordance with claim 9, wherein said scanning voltage driving means comprises:

orthogonal function generating means for producing said orthogonal function data from input synchronous display signal groups;

scanning line selecting means for creating a scanning line selection signal from said synchronous display signal groups to indicate an output terminal for the selection voltage; and voltage selecting means for selecting a voltage amount said 2 levels of selection voltages and said non-selection voltage every scanning electrode according to the value of said scanning line selection signal and the value of said orthogonal function data, to apply the selected one;

said scanning line selecting means dividing one frame period into plural virtual block periods and then repeatedly creating said scanning line selection signal which sequentially selects all said scanning electrodes to be selected for said block period every plural scanning electrodes.

14. The liquid crystal display device in accordance with claim 9, wherein said data voltage driving means comprises:

data latching means for sequentially capturing said display data according to an input synchronous display signal group, and then latching said display data for plural lines;

clock controlling means for producing a data capture signal and a select signal according to said synchronous display signal group;

line data latching means for capturing outputs from said data latching means according to said data capture signal and then latching said outputs for plural lines;

line data selecting means for selecting the output from said line data latching means according to said select signal and then outputting the same as select data;

arithmetic-logic means for summing the identity values between said selection data and said orthogonal function data input; and voltage selecting means for selecting a data voltage corresponding to the sum value obtained by said arithmetic-logic means and then applying said selected data voltage to each of said data electrodes.

15. The liquid crystal display device in accordance with claim 9, wherein said scanning voltage driving means changes the order in which said divisional selection periods in each block period are set in every frame.

16. The liquid crystal display device in accordance with claim 15, wherein said scanning voltage driving means includes line switching signal producing means that produces a line switching signal to change the order in which said divisional selection periods in each block period are set in every frame.

17. The liquid crystal display device in accordance with claim 16, wherein said data voltage driving means includes line data selecting means for sequentially selecting said scanning electrode groups, each in which the identity values between said display data value and said orthogonal function data value are summed, corresponding to the setting order of said divisional selection periods to be changed according to said line switching signal for every frame, said scanning electrode group.

18. A scanning voltage driving device suitable for a liquid crystal panel with plural output terminals, said scanning voltage driving device producing a 2-level selection voltage to plural scanning electrode groups which drive said liquid crystal panel according to a value of an orthogonal function data, said 2-level selection voltage having a positive polarity and a negative polarity with respect to a center point being a non-selection voltage, comprising:

orthogonal function producing means for producing said orthogonal function data from input synchronous display signal groups;

scanning line selecting means for creating a scanning line selection signal from said synchronous display signal groups to indicate an output terminal for the selection voltage; and voltage selecting means for selectively outputting a voltage amount said 2 levels of the selection voltages and the non-selection voltage every output terminal according to the value of said scanning line selection signal and the value of said orthogonal function data;

said scanning line selecting means dividing one frame period into plural virtual block periods and then repeatedly creating said scanning line selection signal which sequentially selects all said scanning electrodes to be selected for said block period every plural scanning electrodes.

19. A liquid crystal driving method which drives a liquid crystal panel including dots where scanning electrodes and data electrodes intersect, by applying a 2-level selection voltage to said scanning electrodes which belong to a scanning electrode group according to an orthogonal function data value, said 2-level selection voltage having a positive polarity and a negative polarity with respect to a non-selection voltage acting as a center point, said scanning electrode group being formed of a set of n ($\geqq 2$) scanning electrodes;

summing identity values every scanning electrode group, said identity values being a number of times that a display data value on each scanning electrode of a scanning electrode group on which said selection voltage is applied agrees with said orthogonal function data value provided to each of said scanning electrodes; and applying a data voltage corresponding to said summation value to each of said data electrodes, comprising the steps of;

dividing one frame period into plural virtual block periods;

dividing a selection period in which said selection voltage is applied, into n divisional selection periods which are separated from each other at predetermined intervals, for all the scanning electrode groups to be selected in each of said virtual block periods; and applying said selection voltage every divisional selection period.

20. A liquid crystal display device comprising:

a liquid crystal panel including dots where scanning electrodes and data electrodes intersect;

scanning voltage driving means for applying a 2-level selection voltage to said scanning electrode which belong to a scanning electrode group according to an orthogonal function data value, said 2-level selection voltage having a positive polarity and a negative polarity with respect to a non-selection voltage acting as a center point, said scanning electrode group being formed of a set of n ($\geqq 2$) scanning electrodes;

data voltage driving means for summing identity values every scanning electrode group, said identity value being a number of times that a display data value on each scanning electrode of each scanning electrode group on which said selection voltage is applied agrees with said orthogonal function data value provided to each of said scanning electrodes, and then applying a data voltage corresponding to the sum value to each of said data electrodes; and power supply means for producing drive voltages to said scanning voltage driving means and said data voltage driving means to drive said liquid crystal panel;

said scanning voltage driving means dividing one frame period into plural virtual block periods;

said scanning voltage driving means dividing a selection period in which said selection voltage is applied, into n divisional selection periods which are separated from each other at predetermined intervals, for all the scanning electrode groups to be selected in each of said block periods; and said scanning voltage driving means applying said selection voltage every divisional selection period.

21. The liquid crystal display device in accordance with claim 20, wherein said scanning voltage driving means sets a divisional selection period for each scanning electrode group every each block period, according to a predetermined selection order of said scanning electrode groups included in said block period.

22. The liquid crystal display device in accordance with claim 21, wherein said scanning voltage driving means sequentially sets the first i-th divisional selection period of each of the remaining scanning electrode groups, following the i-th (i=1 to n) divisional selection period of said scanning electrode group to be first selected for each block period.

23. The liquid crystal display device in accordance with claim 20, wherein said scanning voltage driving means includes orthogonal function setting means which sets said orthogonal function used for said liquid crystal display device; wherein said orthogonal function is set in such a way that the number of positive polarities of said selection voltage applied to each dot in a 2 frame period equals to the number of negative polarities thereof, and that the difference between the number of positive polarities and the number of negative polarities of said data voltage with respect to said non-selection voltage, applied to each dot for one frame period, is within a predetermined range, when said liquid crystal panel displays the same data over the whole screen.

24. The liquid crystal display device in accordance with claim 20, wherein said scanning voltage driving means includes orthogonal function setting means that sets said orthogonal function used for said liquid crystal display device; and wherein said orthogonal function is set in such a way that a combination of the positive polarities and negative polarities of said selection voltage applied to each dot during the n-th divisional selection period is equally provided to all said scanning electrodes during one completion period of said orthogonal function.

25. The liquid crystal display device in accordance with claim 20, wherein said scanning voltage driving means includes orthogonal function setting means that sets an orthogonal function used for said liquid crystal display device; and wherein said orthogonal function is set in such a way that when said liquid crystal panel has a display area where a display on/off operation is repeated every one dot and a background area where the same data is displayed, said orthogonal function is set in such a way that one among the phase of a voltage waveform applied to said data electrode corresponding to said display area and the phase of a voltage waveform applied to said data electrode corresponding to said background area, is switched every constant period, and the other is not switched.

26. The liquid crystal display device in accordance with claim 20, wherein said scanning voltage driving means includes orthogonal function setting means used for said liquid crystal display device; and wherein said orthogonal function is set in such a way that its unit period is equal to a duration of twice a unit frame period of the gray-scale display according to the FRC system and the polarity of said orthogonal function is reversed every unit frame period according to the FRC system.

27. The liquid crystal display device in accordance with claim 20, wherein the number of said scanning electrode groups to be selected for said block period is neither a factor of a unit line number which realizes said gray-scale display according to the FRC system, nor a multiple of the unit line number.

28. The liquid crystal display device in accordance with claim 20, wherein said one frame period comprises a display interval, during which said selection voltage is applied to all the scanning electrodes included to said liquid crystal panel, and a retrace line interval during which said selection voltage is not applied to any scanning electrode; and wherein said block period is obtained by dividing said display interval into plural periods; and wherein each of said divisional selection periods has a duration of t obtained by dividing said display interval by the total number of said scanning electrodes; and wherein said predetermined interval is an integral multiple of the duration t.

29. The liquid crystal display device in accordance with claim 28, wherein said scanning voltage driving means includes orthogonal function setting means for setting an orthogonal function used for said liquid crystal display device;

said orthogonal function is set in such a way that the number of positive polarities of said selection voltage applied to each dot in a 2 frame period equals to the number of negative polarities thereof, and that the difference between the number of positive polarities and the number of negative polarities of said data voltage with respect to said non-selection voltage, applied to each dot for one frame period, is within a predetermined range, when said liquid crystal panel displays the same data over the whole screen;

a combination of the positive polarities and negative polarities of said selection voltage applied to each dot during the n-th divisional selection period is equally provided to all said scanning electrodes during one completion period of said orthogonal function;

when said liquid crystal panel has a display area where a display on/off operation is repeated every one dot and a background area where the same data is displayed, said orthogonal function is set in such a way that one among the phase of a voltage waveform applied to said data electrode corresponding to said display area and the phase of a voltage waveform applied to said data electrode corresponding to said background area, is switched every constant period, and the other is not switched; and its unit period is equal to a duration of twice a unit frame period of the gray-scale display according to the FRC system and the polarity of said orthogonal function is reversed every unit frame period according to the FRC system.

30. The liquid crystal display device in accordance with claim 22, further comprising repeating a voltage applying operation n-times for each block period, with one cycle being the sum of said divisional selection period and said predetermined interval, said voltage applying operation being performed sequentially and continuously to all said scanning electrode groups to be selected in said block period, corresponding to a series of divisional selection periods set continuously and sequentially from the first selected scanning electrode group in each block period.

31. The liquid crystal display device in accordance with claim 30, wherein the voltage level applied to each scanning electrode during said i-th divisional selection period is a voltage level during the i-th division obtained by equally dividing the selection period by n, said selection period corresponding to said selection voltage, among said selection voltages to be applied to said scanning electrodes for said frame period.

32. The liquid crystal display device in accordance with claim 30, wherein a combination of voltage levels applied to each of said scanning electrode groups at every divisional selection period is the same in all of said voltage applying operations which are repeated n times for each block period.

33. The liquid crystal display device in accordance with claim 30, wherein the ratio of the number of positive levels to the number of negative levels included in a voltage applied to said scanning electrode group in the last divisional selection period of a block period is the same as the ratio of the number of positive levels to the number of negative levels included in a voltage applied to said scanning electrode group in the first divisional selection period of the next block period.

34. The liquid crystal display device in accordance with claim 20, further comprising the step of switching the first selected scanning electrode group in each of said block periods in every frame.

35. A liquid crystal display device having a liquid crystal module, said liquid crystal module comprising:

a liquid crystal panel including dots at which a scanning electrode intersects perpendicularly with a data electrode;

scanning voltage driving means for applying a selection voltage and a non-selection voltage to said scanning electrode;

data voltage driving means for applying a data voltage to said data electrode; and a power supply circuit for producing drive voltages to said liquid crystal panel, said scanning voltage driving means and said data voltage driving means;

said scanning voltage driving means producing an orthogonal function and outputting said selection voltage corresponding to said orthogonal function every two scanning electrodes;

said data voltage driving means outputting a data voltage corresponding to an arithmetic value of said display data and said orthogonal function input from said scanning voltage driving means, to said data electrode;

said scanning voltage driving means driving an internal logic circuit with a standard logic voltage and driving a liquid crystal voltage output means, which outputs said selection voltage, with a voltage higher than said standard logic voltage;

said data voltage driving means driving said internal logic circuit and an output circuit which outputs said data voltage with said standard logic voltage;

said liquid crystal module further comprising:

first level shift means for shifting voltage levels of input logic signal voltages while maintaining same voltage differences between said input logic voltage signals to produce shifted input logic signal voltages; and second level shift means for shifting voltage levels of said shifted input logic signal voltages to produce liquid crystal output voltages.

36. Scanning voltage driving means suitable to a liquid crystal display device, which applies a selection voltage and a non-selection voltage to said liquid crystal panel including dots where a scanning electrode and a data electrode intersect perpendicularly, comprising:

a level shifter which produces a scanning function, outputs said selection voltage corresponding to said scanning function every two scanning electrodes, and shifts a logic signal to be input to an internal logic circuit drive voltage (vyc−VyL), said internal logic circuit being driven with a level shifted signal;

a liquid crystal voltage output circuit which outputs said selection voltage or non-selection voltage being driven with a voltage (VyH−VyL) higher than said drive voltage;

first level shift means for shifting voltage levels of input logic signal voltages while maintaining same voltage differences between said input logic voltage signals to produce shifted input logic signal voltages; and second level shift means for shifting voltage levels of said shifted input logic signal voltages to produce liquid crystal output voltages.

37. A power supply circuit suitable for a liquid crystal display device, which produces drive voltages to a scanning voltage driving means and data voltage driving means for driving a liquid crystal panel;

said power supply circuit including a DC/DC converter and an output amplifier for producing said drive voltage from a single power supply;

the selection voltage of said scanning voltage driving means being variable according to the level of a control voltage input;

wherein said non-selection voltage (Vy1), a 2-level selection voltage (Vy0, Vy2) with a positive level and a negative level symmetrically arranged with respect to said non-selection voltage, an internal logic reference voltage (VyC), and a high-withstand voltage portion drive voltage (VyL, VyH) are produced as the drive voltage of said scanning voltage driving means; and wherein the data voltage (Vx1) having the same level as said non-selection voltage, a 2-level data voltage (Vx0, Vx2) with a positive level and a negative level with respect to the data voltage, and an internal logic driving voltage (VxH, VxL) are produced as drive voltages of said data voltage driving means;

said power supply circuit further including:

first level shift means for shifting voltage levels of input logic signal voltages while maintaining same voltage differences between said input logic voltage signals to produce shifted input logic signal voltages; and second level shift means for shifting voltage levels of said shifted input logic signal voltages to produce liquid crystal output voltages.

38. The power supply circuit suitable for a liquid crystal display device in accordance with claim 37, wherein said output voltage is Vy0=VyL, Vy2=VyH, VyC=VyL+(5±10% (V)), VxH=5±10% (V), and VxL=0(V).

39. A liquid crystal display device having a liquid crystal module, said liquid crystal module comprising:

a liquid crystal panel including dots at which a scanning electrode intersects perpendicularly with a data electrode;

scanning voltage driving means for applying a selection voltage and a non-selection voltage to said scanning electrode;

data voltage driving means for applying a data voltage to said data electrode; and a power supply circuit for producing drive voltages to said liquid crystal panel, said scanning voltage driving means and said data voltage driving means;

said scanning voltage driving means producing an orthogonal function and outputting said selection voltage corresponding to said orthogonal function every two scanning electrodes;

said data voltage driving means outputting a data voltage corresponding to an arithmetic value of said display data and said orthogonal function input from said scanning voltage driving means, to said data electrode;

said liquid crystal module further comprising:

a level shift circuit for shifting a logic signal input to said scanning voltage driving means, to a reference voltage of said scanning voltage driving means;

said scanning voltage driving means for driving an internal logic circuit at a voltage lower than said reference voltage and driving a liquid crystal voltage driving means which outputs said selection voltage at a voltage higher than said reference voltage;

said data voltage driving means for driving said internal logic circuit, and an output circuit which outputs said data voltage, at a lower voltage;

said liquid crystal module further comprising:

first level shift means for shifting voltage levels of input logic signal voltages while maintaining same voltage differences between said input logic voltage signals to produce shifted input logic signal voltages; and second level shift means for shifting voltage levels of said shifted input logic signal voltages to produce liquid crystal output voltages.

40. A liquid crystal display device having a liquid crystal module, said liquid crystal module comprising:

a liquid crystal panel including dots at which a scanning electrode intersects perpendicularly with a data electrode;

scanning voltage driving means for applying a selection voltage and a non-selection voltage to said scanning electrode;

data voltage driving means for applying a data voltage to said data electrode; and a power supply circuit for producing drive voltages to said liquid crystal panel, said scanning voltage driving means and said data voltage driving means;

said scanning voltage driving means producing an orthogonal function and outputting said selection voltage corresponding to said orthogonal function every two scanning electrodes;

said data voltage driving means outputting a data voltage corresponding to an arithmetic value of said display data and said orthogonal function input from said scanning voltage driving means, to said data electrode;

said liquid crystal module further comprising:

a level shift circuit for shifting a logic signal input to said data voltage driving means to a drive voltage of said data voltage driving means;

said data voltage driving means being operated with a logic signal after said level shifting operation;

said liquid crystal module further comprising:

first level shift means for shifting voltage levels of input logic signal voltages while maintaining same voltage differences between said input logic voltage signals to produce shifted input logic signal voltages; and second level shift means for shifting voltage levels of said shifted input logic signal voltages to produce liquid crystal output voltages.

41. The liquid crystal display device in accordance with claim 40, wherein said level shifter level-converts the logic signal input to said data voltage driving means into a signal of ±2.5 volts; and wherein said data voltage driving means is driven on a drive voltage of ±2.5 volts and then outputs 0 volts (Vx1) as a data voltage and 2-level data voltages (Vx0, Vx2) having a positive level and a negative level symmetrical to said data voltage; and wherein said scanning voltage driving means outputs 0 volts (Vy1) as said non-selection voltage and 2-level selection voltages (Vy0, Vy2) having a positive level and a negative level symmetrical to said non-selection voltage.

42. The liquid crystal driving method in accordance with claim 5, wherein the ratio of the number of positive levels to the number of negative levels included in a voltage applied to said scanning electrode group in the last divisional selection period of a block period is the same as the ratio of the number of positive levels to the number of negative levels included in a voltage applied to said scanning electrode group in the first divisional selection period of the next block period.

43. The liquid crystal display device in accordance with claim 32, wherein the ratio of the number of positive levels to the number of negative levels included in a voltage applied to said scanning electrode group in the last divisional selection period of a block period is the same as the ratio of the number of positive levels to the number of negative levels included in a voltage applied to said scanning electrode group in the first divisional selection period of the next block period.

* * * * *